US012473897B2

(12) United States Patent
Nowell et al.

(10) Patent No.: US 12,473,897 B2
(45) **Date of Patent: *Nov. 18, 2025**

(54) FRACTURING PUMP ARRANGEMENT USING A PLUNGER WITH AN INTERNAL FLUID PASSAGE

(71) Applicant: Kerr Machine Co., Sulphur, OK (US)

(72) Inventors: Mark S. Nowell, Ardmore, OK (US); Kelcy Jake Foster, Sulphur, OK (US); Micheal Cole Thomas, Ardmore, OK (US); Christopher Todd Barnett, Stratford, OK (US); Guy J. Lapointe, Sulphur, OK (US); Brandon Scott Ayres, Ardmore, OK (US)

(73) Assignee: Kerr Machine Co., Sulphur, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/602,257

(22) Filed: Mar. 12, 2024

(65) Prior Publication Data

US 2024/0209845 A1 Jun. 27, 2024

Related U.S. Application Data

(60) Continuation of application No. 18/433,703, filed on Feb. 6, 2024, which is a continuation of application (Continued)

(51) Int. Cl.

| | |
|---|---|
| ***F04B 1/0408*** | (2020.01) |
| ***F04B 53/12*** | (2006.01) |
| *E21B 43/26* | (2006.01) |

(52) U.S. Cl.
CPC ..... *F04B 1/0408* (2013.01); *F04B 53/12* (2013.01); *E21B 43/2607* (2020.05)

(58) Field of Classification Search
CPC .... F04B 39/0005; F04B 39/10; F04B 1/0408; F04B 53/12; E21B 43/129
See application file for complete search history.

(56) References Cited

U.S. PATENT DOCUMENTS 742,940 A * 11/1903 Whitaker ..... F04B 15/023 417/570
1,524,222 A * 1/1925 Warner ..... F04B 53/164 417/454

(Continued)

FOREIGN PATENT DOCUMENTS

CN 104179676 A * 12/2014
CN 207974953 U 10/2018

(Continued)

*Primary Examiner* — Nathan C Zollinger
(74) *Attorney, Agent, or Firm* — Tomlinson McKinstry, P.C.

(57) ABSTRACT

A fluid end for use with a power end. The fluid end comprises a plurality of fluid end sections positioned adjacent one another. Each section includes a single horizontally positioned bore. A plunger is installed within the bore and includes a fluid passageway. Low-pressure fluid enters the bore through the plunger and high-pressure fluid exits the fluid end through an outlet valve installed within the bore. The intake of low-pressure fluid within the fluid end section is regulated by an inlet valve installed within the plunger. Low-pressure fluid enters the plunger through an inlet component attached to both the plunger and an inlet manifold.

23 Claims, 39 Drawing Sheets

Related U.S. Application Data

No. 18/163,317, filed on Feb. 2, 2023, now Pat. No. 11,952,990, which is a continuation of application No. 17/692,420, filed on Mar. 11, 2022, now Pat. No. 11,592,011, which is a division of application No. 16/860,146, filed on Apr. 28, 2020, now Pat. No. 11,578,710.

(60) Provisional application No. 62/950,746, filed on Dec. 19, 2019, provisional application No. 62/939,339, filed on Nov. 22, 2019, provisional application No. 62/901,445, filed on Sep. 17, 2019, provisional application No. 62/882,328, filed on Aug. 2, 2019, provisional application No. 62/880,409, filed on Jul. 30, 2019, provisional application No. 62/878,146, filed on Jul. 24, 2019, provisional application No. 62/872,664, filed on Jul. 10, 2019, provisional application No. 62/842,009, filed on May 2, 2019.

(56) References Cited

U.S. PATENT DOCUMENTS 1,662,725 A * 3/1928 Toney, Jr. ..... F04B 53/143 277/467
1,836,498 A 12/1931 Gustav
2,545,506 A 3/1951 Walsh
2,567,496 A 9/1951 Pittenger
2,842,060 A * 7/1958 Barry ..... F04B 1/0536 92/72
2,898,858 A 8/1959 Fisher
2,957,422 A 10/1960 Loeber
3,005,412 A 10/1961 Camp
3,301,197 A * 1/1967 Dodson ..... F04B 13/00 92/151
3,446,156 A * 5/1969 Lightfoot ..... F04B 53/101 137/512.1
3,558,244 A * 1/1971 Uchiyama ..... F04B 53/164 417/511
3,601,234 A * 8/1971 Ingraham ..... G01N 1/06 74/354
3,801,234 A 4/1974 Heilhecker et al.
3,809,508 A * 5/1974 Uchiyama ..... F04B 53/164 417/511
3,887,305 A 6/1975 Ito
3,920,356 A * 11/1975 Bruggeman ..... F04B 53/144 417/511
4,494,415 A * 1/1985 Elliston ..... F04B 9/045 92/255
4,915,602 A * 4/1990 Tschopp ..... F04B 15/06 417/555.1
5,061,159 A 10/1991 Pryor
5,073,096 A 12/1991 King et al.
8,590,614 B2 11/2013 Surjaatmadja et al.
9,371,919 B2 6/2016 Forrest et al.
11,105,327 B2 8/2021 Hurst et al.
11,578,710 B2 * 2/2023 Nowell ..... F04B 39/10
11,592,011 B2 * 2/2023 Nowell ..... E21B 43/129
11,952,990 B2 * 4/2024 Nowell ..... E21B 43/129
11,965,503 B2 * 4/2024 Beisel ..... F04B 53/143
2006/0045782 A1 3/2006 Kretzinger et al.
2013/0045123 A1 2/2013 Roman et al.
2014/0127058 A1 * 5/2014 Buckley ..... F04B 39/10 417/415
2014/0127062 A1 5/2014 Buckley et al.
2015/0219096 A1 8/2015 Jain et al.
2016/0090980 A1 3/2016 Howard et al.
2016/0281699 A1 9/2016 Gnessin et al.
2019/0145391 A1 5/2019 Davids
2020/0232455 A1 7/2020 Blume

FOREIGN PATENT DOCUMENTS

GB 190629137 A 12/1907
GB 633661 A * 7/1947
JP 06167277 A 7/1993

* cited by examiner

FRACTURING PUMP ARRANGEMENT USING A PLUNGER WITH AN INTERNAL FLUID PASSAGE

SUMMARY

The present application discloses an apparatus comprising a fluid end body having a borehole formed therein, and a plunger positioned within the borehole. The plunger comprises a plunger body having a first end, a second end, and a first fluid passageway. The first fluid passageway interconnects the first end and the second end of the plunger body. The plunger further comprises an inlet valve positioned at the first end of the plunger body. The apparatus further comprises an inlet component attached to the second end of the plunger body. A second fluid passageway is formed within the inlet component and is in communication with the first fluid passageway.

The present application also discloses a kit. The kit comprises a fluid end body having a borehole formed therein, and a plunger. The plunger comprises a body having a first end, a second end, a first fluid passageway, and an inlet valve. The first fluid passageway interconnects the first and second end of the plunger. The kit further comprises an inlet component.

BACKGROUND

Various industrial applications may require the delivery of high volumes of highly pressurized fluids. For example, hydraulic fracturing (commonly referred to as "fracking") is a well stimulation technique used in oil and gas production, in which highly pressurized fluid is injected into a cased wellbore. As shown for example in FIG. 1, the pressured fluid flows through perforations 10 in a casing 12 and creates fractures 14 in deep rock formations 16. Pressurized fluid is delivered to the casing 12 through a wellhead 18 supported on the ground surface 20. Sand or other small particles (commonly referred to as "proppants") are normally delivered with the fluid into the rock formations 16. The proppants help hold the fractures 14 open after the fluid is withdrawn. The resulting fractures 14 facilitate the extraction of oil, gas, brine, or other fluid trapped within the rock formations 16.

Fluid ends are devices used in conjunction with a power source to pressurize the fluid used during hydraulic fracturing operations. A single fracking operation may require the use of two or more fluid ends at one time. For example, six fluid ends 22 are shown operating at a wellsite 24 in FIG. 2. Each of the fluid ends 22 is attached to a power end 26 in a one-to-one relationship. The power end 26 serves as an engine or motor for the fluid end 22. Together, the fluid end 22 and power end 26 function as a hydraulic pump.

Continuing with FIG. 2, a single fluid end 22 and its corresponding power end 26 are typically positioned on a truck bed 28 at the wellsite 24 so that they may be easily moved, as needed. The fluid and proppant mixture to be pressurized is normally held in large tanks 30 at the wellsite 24. An intake piping system 32 delivers the fluid and proppant mixture from the tanks 30 to each fluid end 22. A discharge piping system 33 transfers the pressurized fluid from each fluid end 22 to the wellhead 18, where it is delivered into the casing 12 shown in FIG. 1.

Fluid ends operate under notoriously extreme conditions, enduring the same pressures, vibrations, and abrasives that are needed to fracture the deep rock formations shown in FIG. 1. Fluid ends may operate at pressures of 5,000-15,000 pounds per square inch (psi) or greater. Fluid used in hydraulic fracturing operations is typically pumped through the fluid end at a pressure of at least 8,000 psi, and more typically between 10,000 and 15,000 psi. However, the pressure may reach up to 22,500 psi. The power end used with the fluid end typically has a power output of at least 2,250 horsepower during hydraulic fracturing operations.

High operational pressures may cause a fluid end to expand or crack. Such a structural failure may lead to fluid leakage, which leaves the fluid end unable to produce and maintain adequate fluid pressures. Moreover, if proppants are included in the pressurized fluid, those proppants may cause erosion at weak points within the fluid end, resulting in additional failures.

It is not uncommon for conventional fluid ends to experience failure after only several hundred operating hours. Yet, a single fracking operation may require as many as fifty (50) hours of fluid end operation. Thus, a traditional fluid end may require replacement after use on as few as two fracking jobs.

During operation of a hydraulic pump, the power end is not exposed to the same corrosive and abrasive fluids that move through the fluid end. Thus, power ends typically have much longer lifespans than fluid ends. A typical power end may service five or more different fluid ends during its lifespan.

With reference to FIGS. 3 and 4, a traditional power end 34 is shown. The power end 34 comprises a housing 36 having a mounting plate 38 formed on its front end 40. A plurality of stay rods 42 are attached to and project from the mounting plate 38. A plurality of pony rods 44 are disposed at least partially within the power end 34 and project from openings formed in the mounting plate 38. Each of the pony rods 44 is attached to a crank shaft installed within the housing 36. Rotation of the crank shaft powers reciprocal motion of the pony rods 44 relative to the mounting plate 38.

A fluid end 46 shown in FIGS. 3 and 4 is attached to the power end 34. The fluid end 46 comprises a fluid end body 48 having a flange 50 machined therein. The flange 50 provides a connection point for the plurality of stay rods 42. The stay rods 42 rigidly interconnect the power end 34 and the fluid end 46. When connected, the fluid end 46 is suspended in offset relationship to the power end 34.

A plurality of plungers 52 are disposed within the fluid end 46 and project from openings formed in the flange 50. The plungers 52 and pony rods 44 are arranged in a one-to-one relationship, with each plunger 52 aligned with and connected to a corresponding one of the pony rods 44. Reciprocation of each pony rod 44 causes its connected plunger 52 to reciprocate within the fluid end 46. In operation, reciprocation of the plungers 52 pressurizes fluid within the fluid end 46. The reciprocation cycle of each plunger 52 is differently phased from that of each adjacent plunger 52.

With reference to FIG. 6, the interior of the fluid end 46 includes a plurality of longitudinally spaced bore pairs. Each bore pair includes a vertical bore 56 and an intersecting horizontal bore 58. The zone of intersection between the paired bores defines an internal chamber 60. Each plunger 52 extends through a horizontal bore 58 and into its associated internal chamber 60. The plungers 52 and horizontal bores 58 are arranged in a one-to-one relationship.

Each horizontal bore 58 is sized to receive a plurality of packing seals 64. The seals 64 are configured to surround the installed plunger 52 and prevent high-pressure fluid from passing around the plunger 52 during operation. The packing seals 64 are maintained within the bore 58 by a retainer 65.

The retainer 65 has external threads 63 that mate with internal threads 67 formed in the walls surrounding the bore 58. In some traditional fluid ends, the packing seals 64 are installed within a removable stuffing box sleeve that is installed within the horizontal bore.

Each vertical bore 56 interconnects opposing top and bottom surfaces 66 and 68 of the fluid end 46. Each horizontal bore 58 interconnects opposing front and rear surfaces 70 and 72 of the fluid end 46. A discharge plug 74 seals each opening of each vertical bore 56 on the top surface 66 of the fluid end 46. Likewise, a suction plug 76 seals each opening of each horizontal bore 58 on the front surface 70 of the fluid end 46.

The discharge and suction plugs 74 and 76 are retained within their corresponding bores 56 and 58 by a retainer 78, shown in FIGS. 3, 5, and 6. The retainer 78 has a cylindrical body having external threads 79 formed in its outer surface. The external threads 79 mate with internal threads 81 formed in the walls surrounding the bore 56 or 58 above the installed plug 74 or 76.

As shown in FIGS. 3 and 4, a manifold 80 is attached to the fluid end 46. The manifold 80 is also connected to an intake piping system, of the type shown in FIG. 2. Fluid to be pressurized is drawn from the intake piping system into the manifold 80, which directs the fluid into each of the vertical bores 56, by way of openings (not shown) in the bottom surface 68.

When a plunger 52 is retracted, fluid is drawn into each internal chamber 60 from the manifold 80. When a plunger 52 is extended, fluid within each internal chamber 60 is pressurized and forced towards a discharge conduit 82. Pressurized fluid exits the fluid end 46 through one or more discharge openings 84, shown in FIGS. 3-5. The discharge openings 84 are in fluid communication with the discharge conduit 82. The discharge openings 84 are attached to a discharge piping system, of the type shown in FIG. 2.

A pair of valves 86 and 88 are installed within each vertical bore 56, on opposite sides of the internal chamber 60. The valve 86 prevents backflow in the direction of the manifold 80, while the valve 88 prevents backflow in the direction of the internal chamber 60. The valves 86 and 88 each comprise a valve body 87 that seals against a valve seat 89.

Traditional fluid ends are normally machined from high strength alloy steel. Such material can corrode quickly, leading to fatigue cracks. Fatigue cracks occur because corrosion of the metal decreases the metal's fatigue strength—the amount of loading cycles that can be applied to a metal before it fails. Such cracking can allow leakage that prevents a fluid end from achieving and maintaining adequate pressures. Once such leakage occurs, fluid end repair or replacement becomes necessary.

Fatigue cracks in fluid ends are commonly found in areas that experience high stress. For example, with reference to the fluid end 46 shown in FIG. 6, fatigue cracks are common at a corner 90 formed in the interior of the fluid end 46 by the intersection of the walls surrounding the horizontal bore 58 with the walls surrounding the vertical bore 56. A plurality of the corners 90 surround each internal chamber 60. Because fluid is pressurized within each internal chamber 60, the corners 90 typically experience the highest amount of stress during operation, leading to fatigue cracks. Fatigue cracks are also common at the neck that connects the flange 50 and the fluid end body 48. Specifically, fatigue cracks tend to form at an area 92 where the neck joins the body 48, as shown for example in FIGS. 4-6.

For the above reasons, there is a need in the industry for a fluid end configured to avoid or significantly delay the structures or conditions that cause wear or failures within a fluid end.

DETAILED DESCRIPTION

Figure 7:
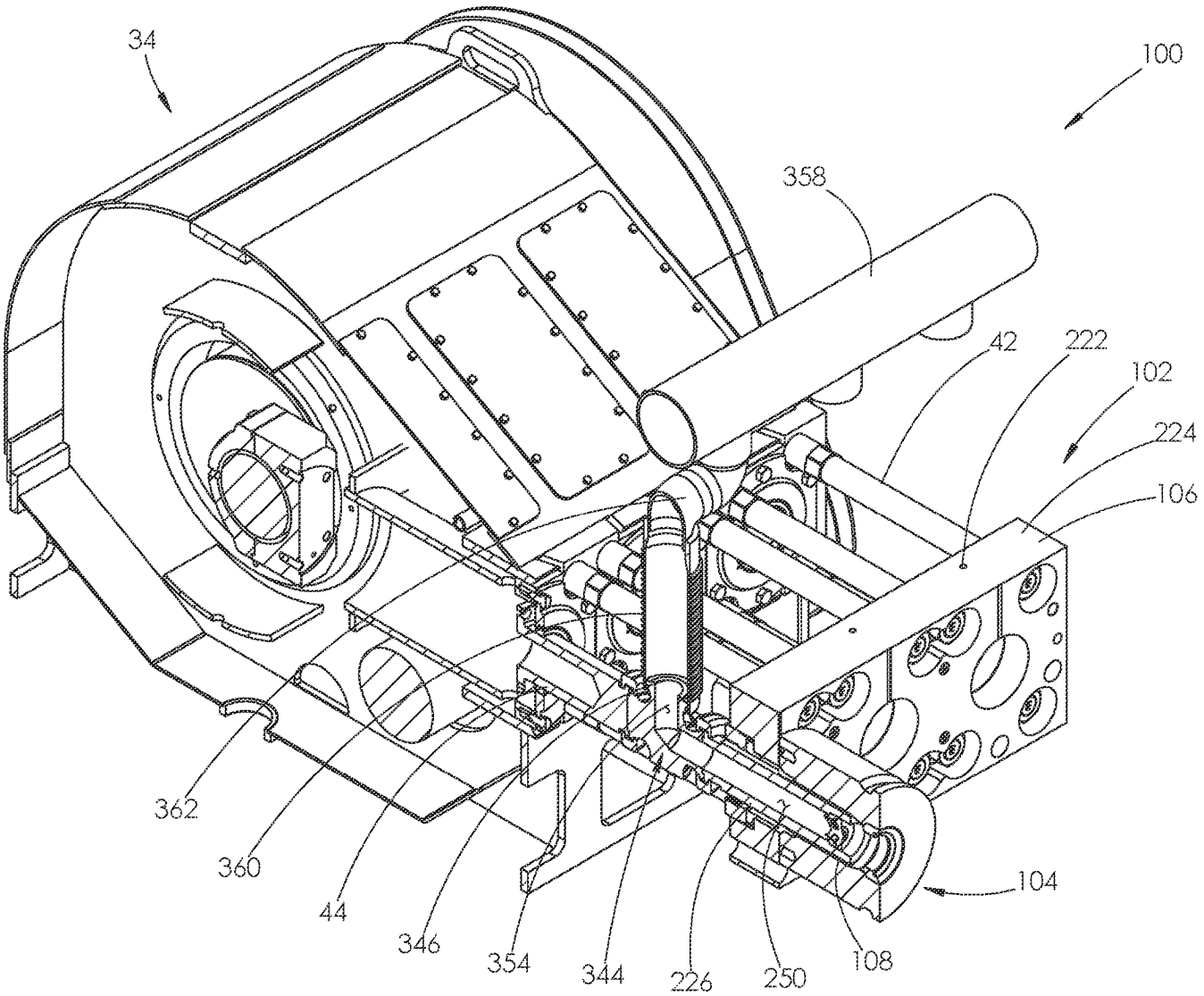
FIG. 7 is a perspective cross-sectional view of a fluid end attached to a power end. Only one fluid end section of the fluid end is shown.
Figure 8:
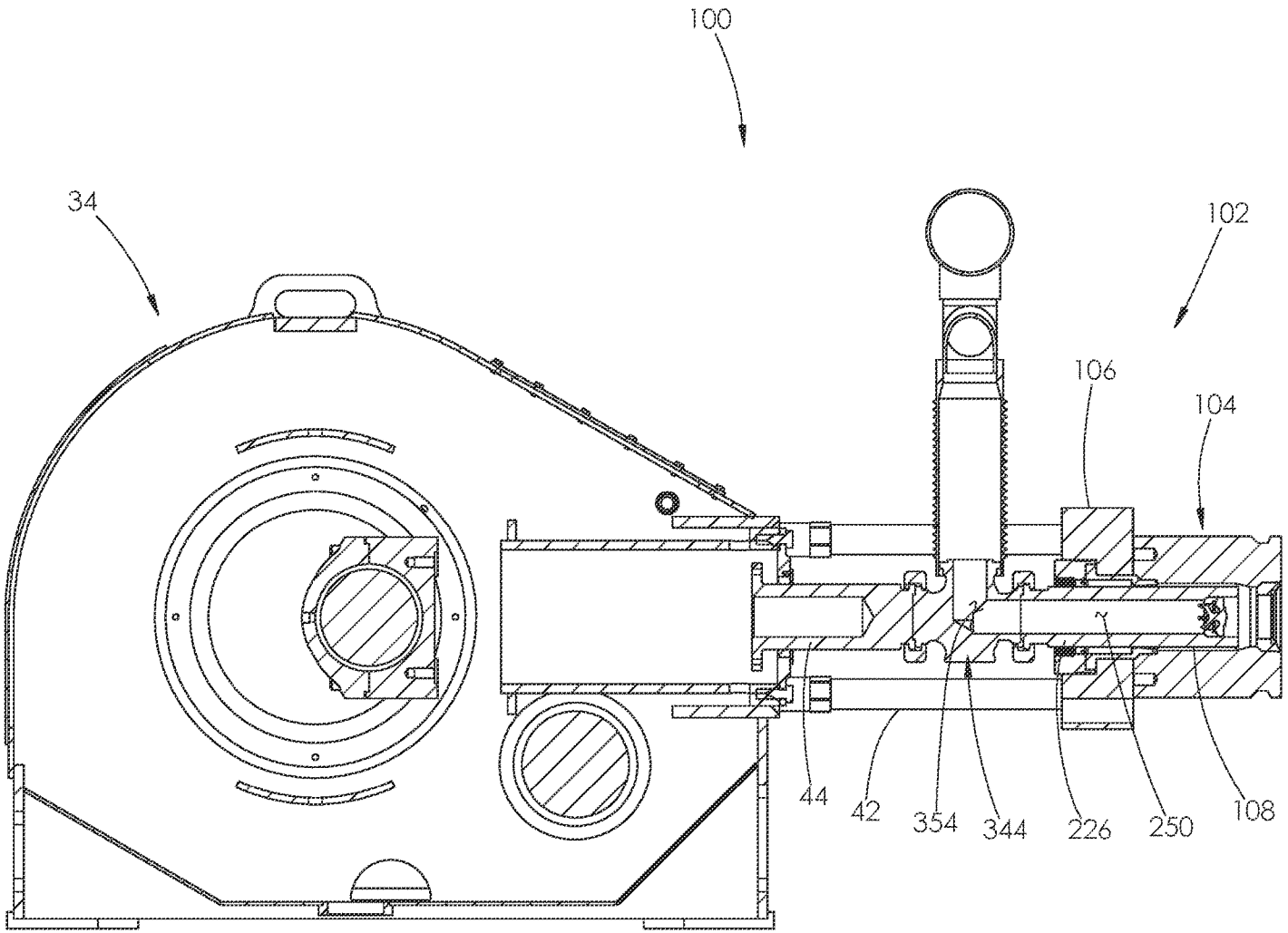
FIG. 8 is a cross-sectional view of the fluid end and power end shown in FIG. 7.

Turning now to the figures, FIGS. 7 and 8 show a portion of a high-pressure hydraulic fracturing pump 100. The pump 100 comprises the traditional power end 34 shown in FIGS. 3 and 4 and an in-line fluid end 102. In alternative embodiments, the in-line fluid end 102 may be attached to different embodiments of power ends.

The in-line fluid end 102 comprises a plurality of fluid end sections 104 positioned adjacent one another. Each section 104 is secured to a connect plate 106. The fluid end 102 may comprise five fluid end sections 104, for example, attached to a single connect plate 106. The connect plate 106 is rigidly secured to the power end 34 using the stay rods 42.

Figure 1:
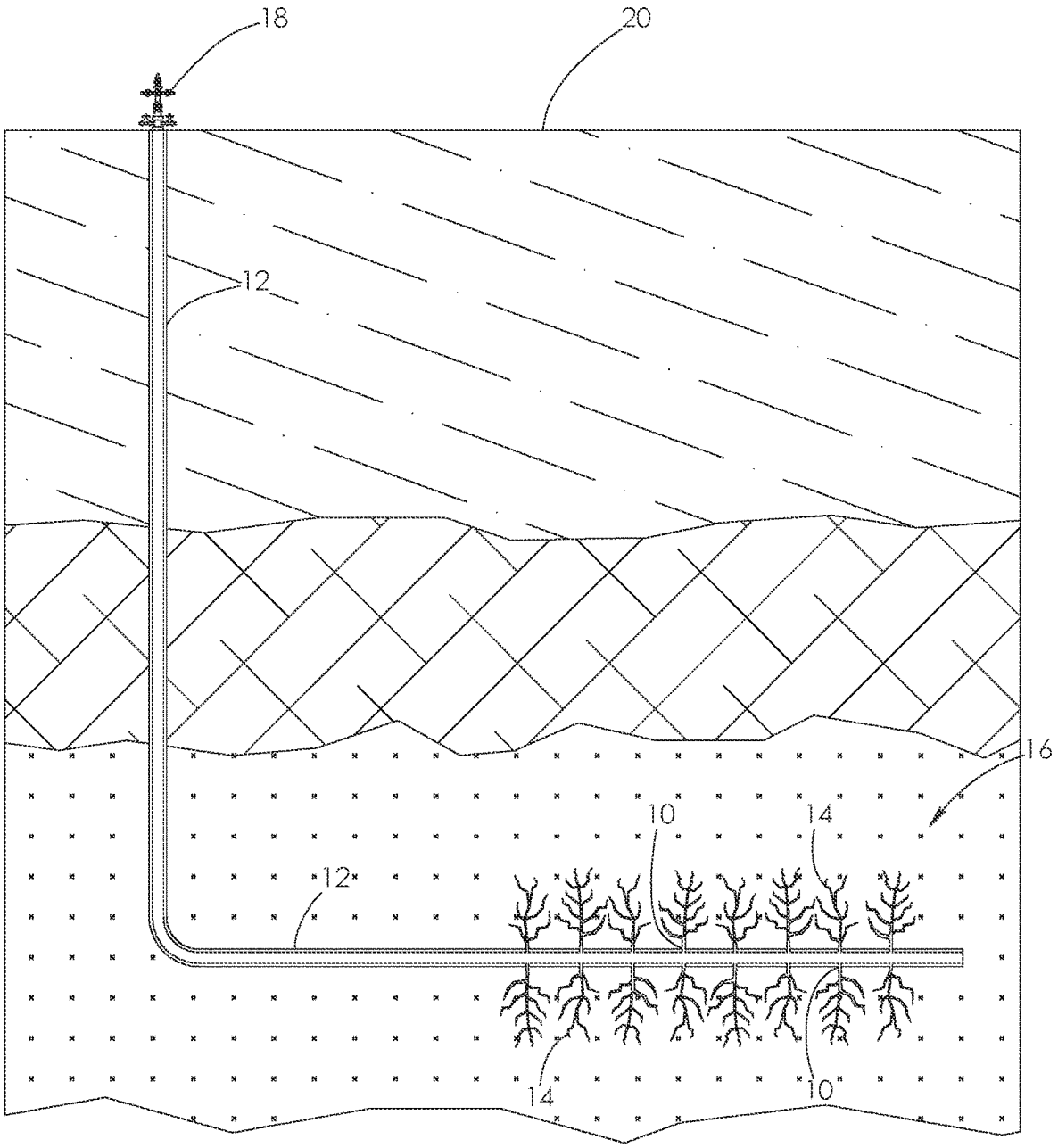
FIG. 1 is an illustration of the underground environment of a hydraulic fracturing operation.
Figure 2:
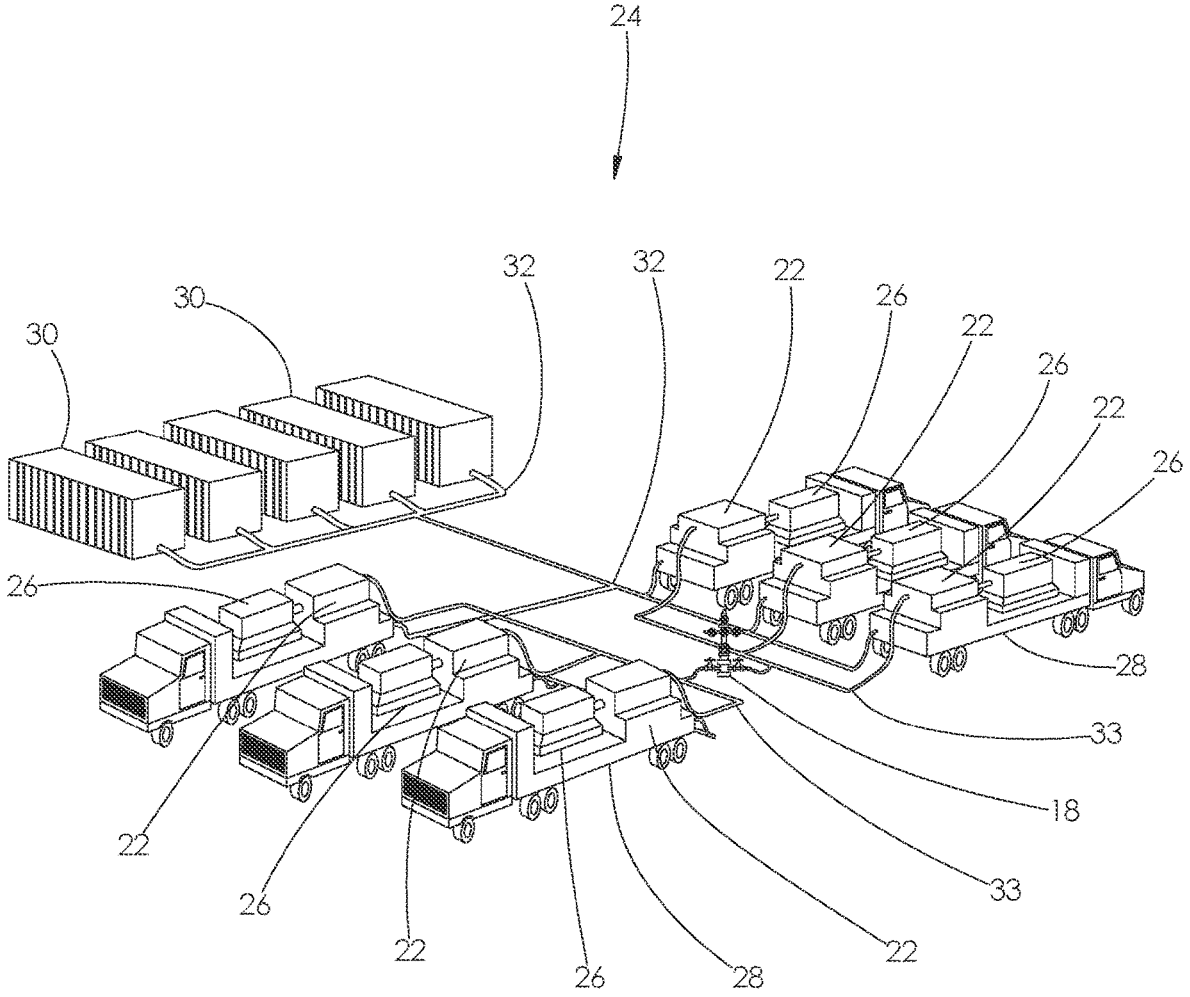
FIG. 2 illustrates above-ground equipment used in a hydraulic fracturing operation.
Figure 3:
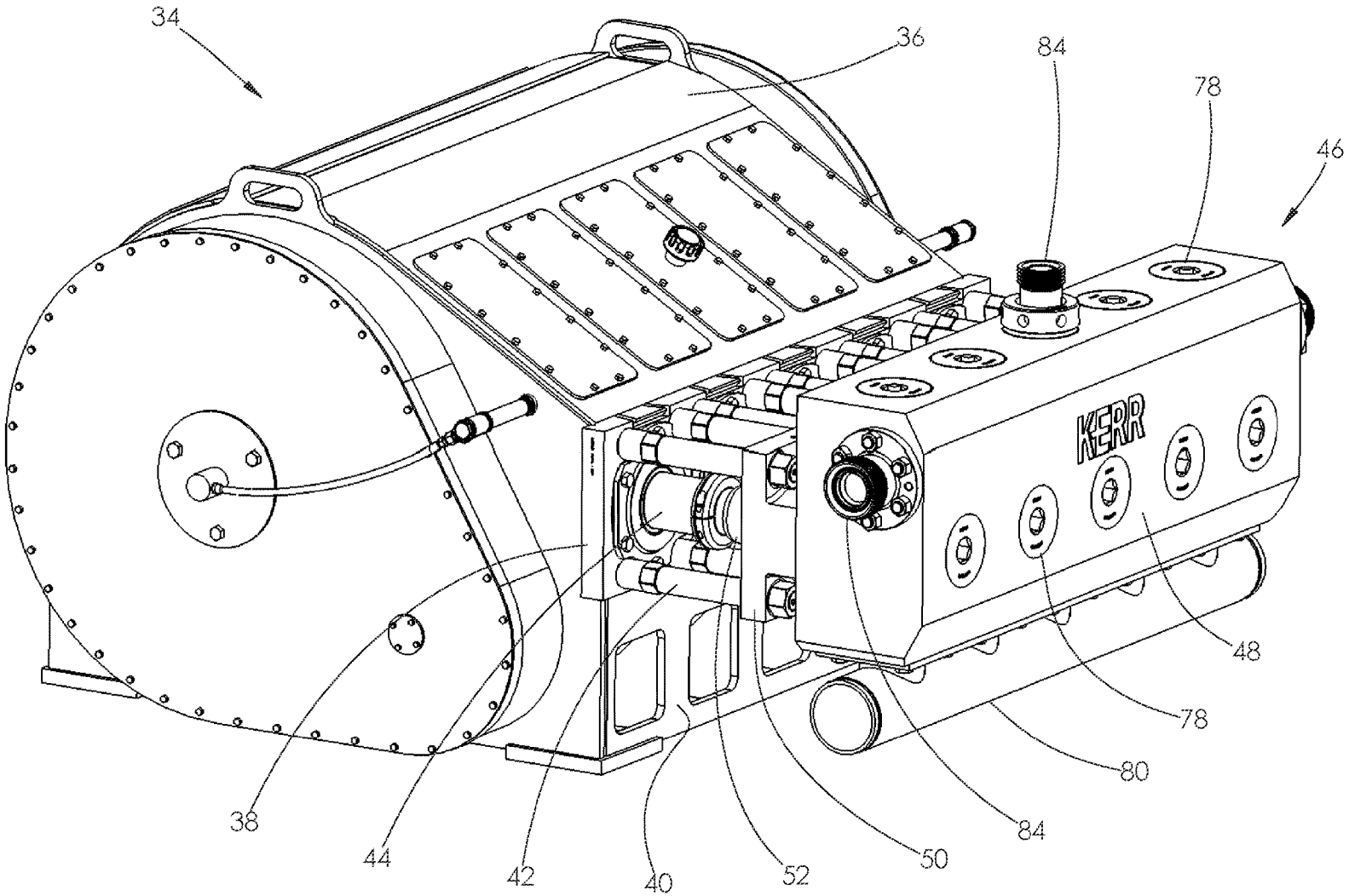
PRIOR ART FIG. 3
FIG. 3 is a left side perspective view of a traditional fluid end attached to a traditional power end.
Figure 4:
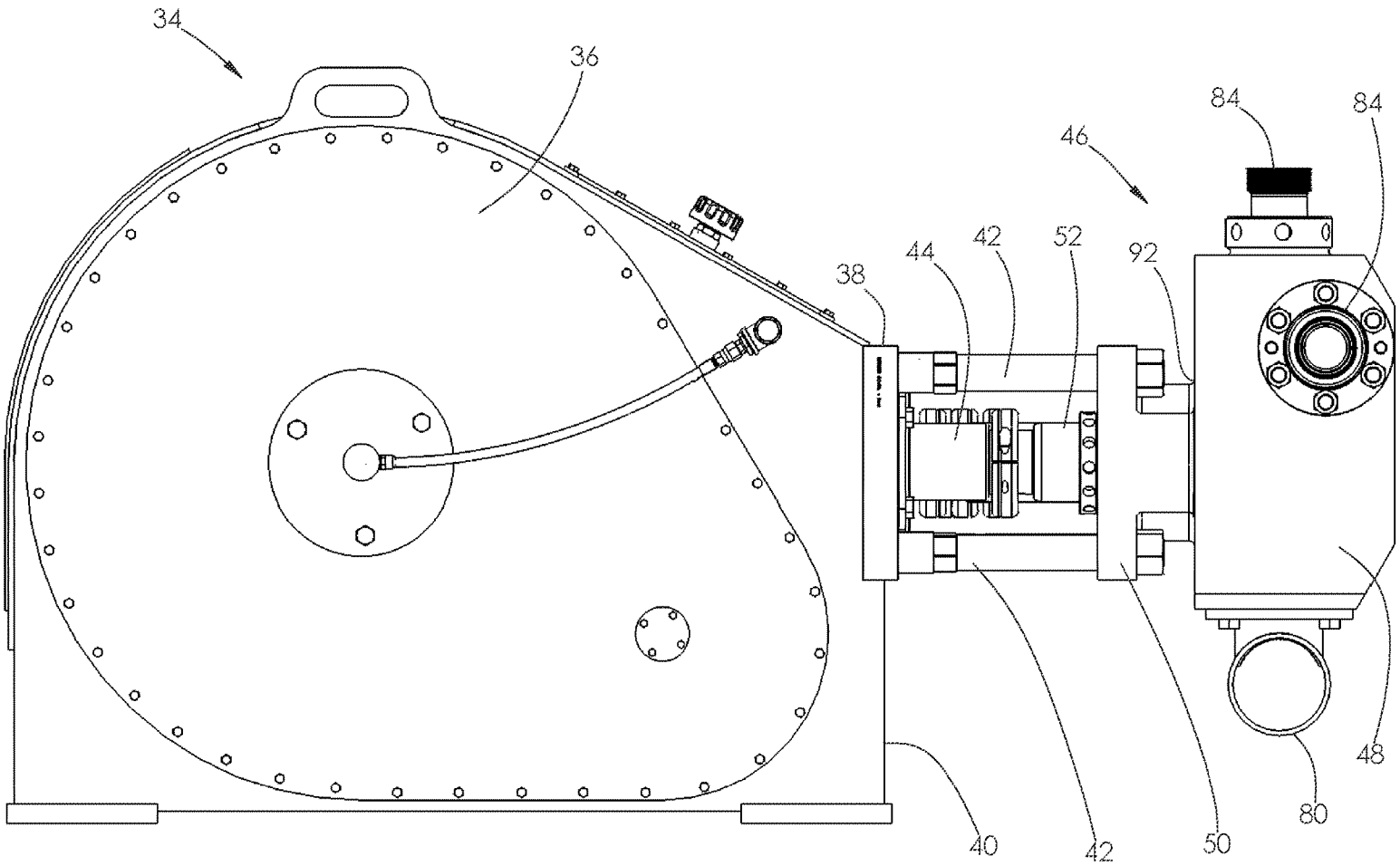
PRIOR ART FIG. 4
FIG. 4 is a left side elevational view of the fluid end and power end shown in FIG. 3.
Figure 5:
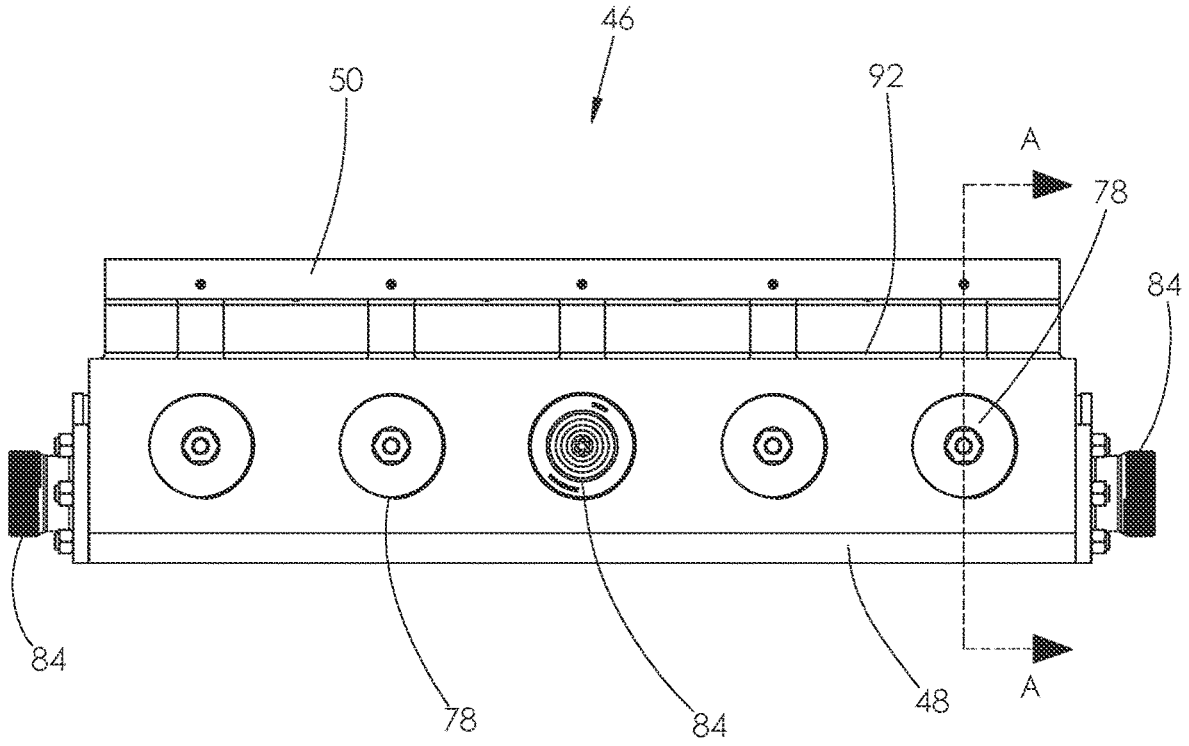
PRIOR ART FIG. 5
FIG. 5 is a top plan view of the fluid end shown in FIGS. 3 and 4.

In contrast to the traditional fluid end 46, shown in FIGS. 3 and 4, the in-line fluid end 102 does not include any intersecting bores. Rather, each fluid end section 104 only has a single horizontally positioned bore 108. Removing the vertically positioned second bore removes the central bore intersection found in traditional fluid ends. Thus, the in-line fluid end 102 does not have the potentially fatal stress concentration areas found at the central bore intersection like traditional fluid ends.

Eliminating the intersecting bore also reduces the cost of manufacturing the in-line fluid end 102 as compared to traditional fluid ends. The time required to manufacture the in-line fluid end 102 is greatly reduced without the need for machining an intersecting bore, and the fluid end 102 may be manufactured on a lathe instead of a machining center. The in-line fluid end 102 may also be manufactured out of lower strength and less costly materials since it does not include the high stress areas found in traditional fluid ends.

Figure 9:
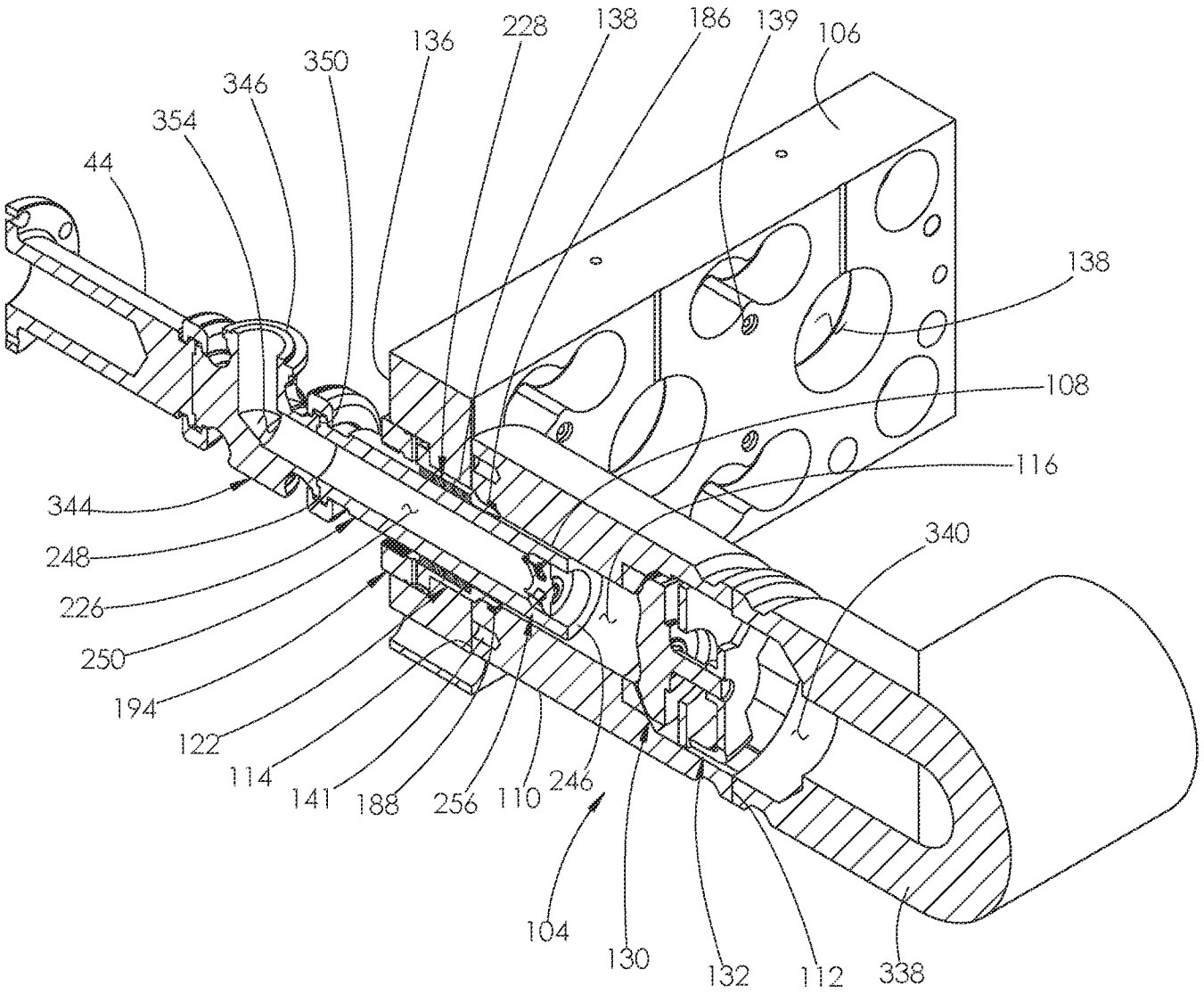
FIG. 9 is a perspective cross-sectional view of the fluid end shown in FIG. 7.
Figure 10:
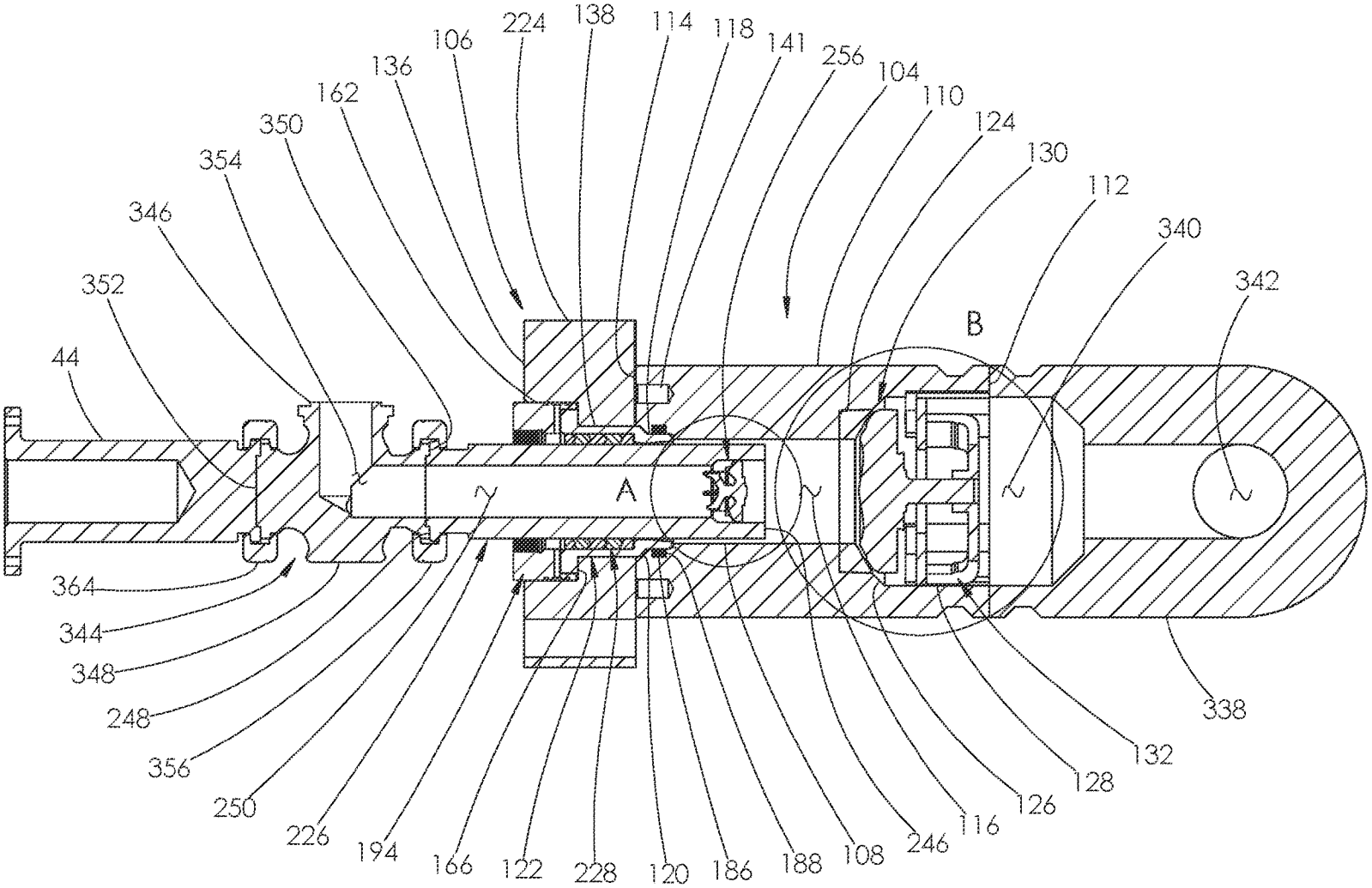
FIG. 10 is a cross-sectional view of the fluid end shown in FIG. 7.

With reference to FIGS. 9 and 10, each fluid end section 104 comprises a generally cylindrical body 110 having opposed front and rear surfaces 112 and 114. The bore 108 is formed within the body 110 and opens at its opposed front and rear surfaces 112 and 114. The bore 108 includes a central chamber 116 that opens into larger diameter sections adjacent each surface 112 and 114 of the body 110.

Continuing with FIG. 10, adjacent the rear surface 114 of the body 110, the bore 108 opens into a larger diameter section 118 joined to a tapered section 120. As will be described later herein, the larger diameter section 118 and tapered section 120 are configured to receive a portion of a tubular stuffing box sleeve 122.

Adjacent the front surface 112 of the body 110, the bore 108 opens into a first section 124 joined to a tapered section 126. The tapered section 126 joins a second section 128 that extends between the front surface 112 and the tapered section 126. The second section 128 has a larger diameter than the first section 124. As will be described later herein, the first and second sections 124 and 128 are configured to receive an outlet valve 130 and a valve retention system 132.

Figure 11:
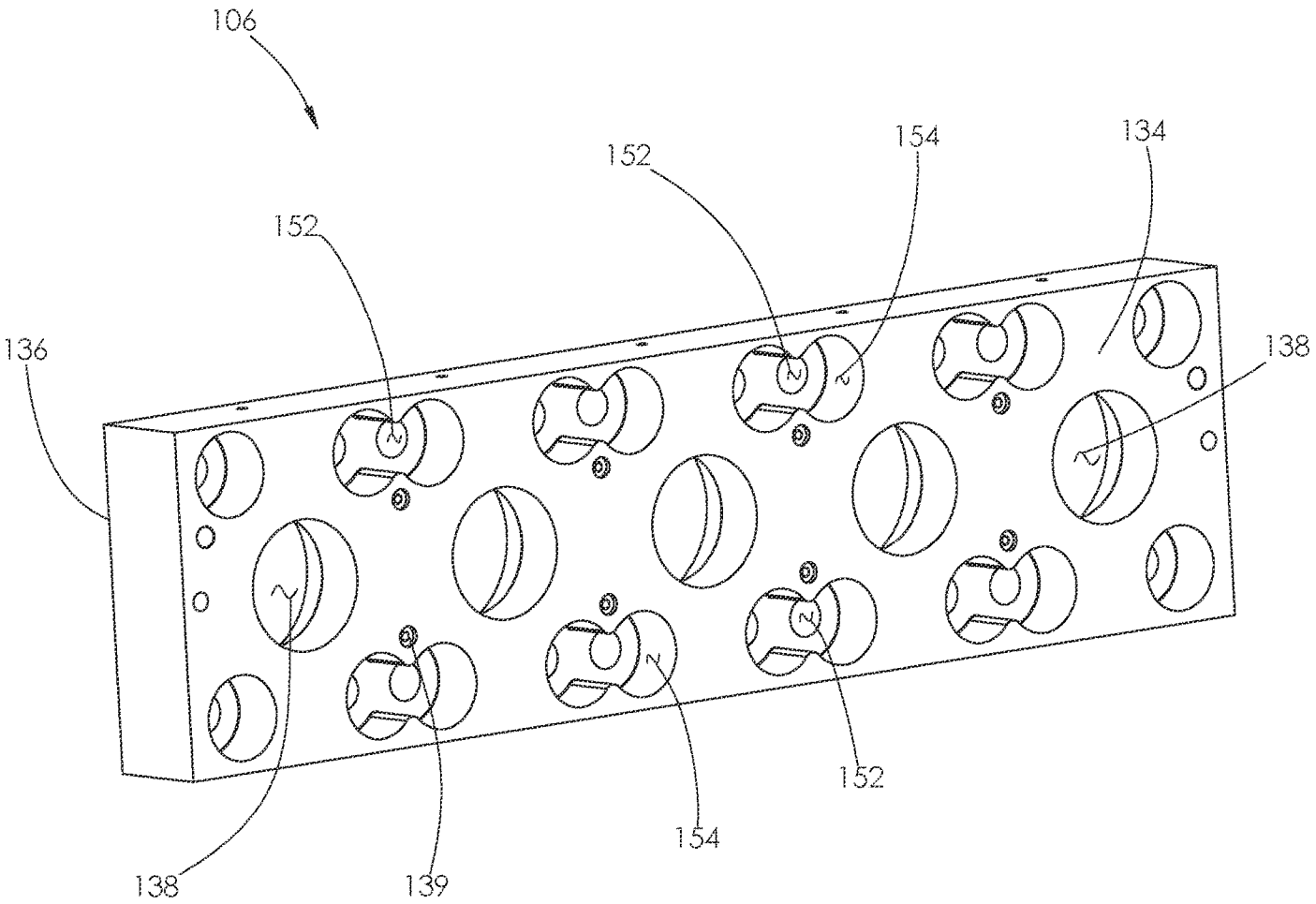
FIG. 11 is a perspective view of the connect plate used with the fluid end shown in FIG. 7.

With reference to FIG. 11, the connect plate 106 has a generally rectangular shape and opposed front and rear surfaces 134 and 136. A plurality of central bores 138 are formed in the connect plate 106 and interconnect the plate's front and rear surfaces 134 and 136. Each bore 138 corresponds with a single fluid end section 104.

Figure 12:
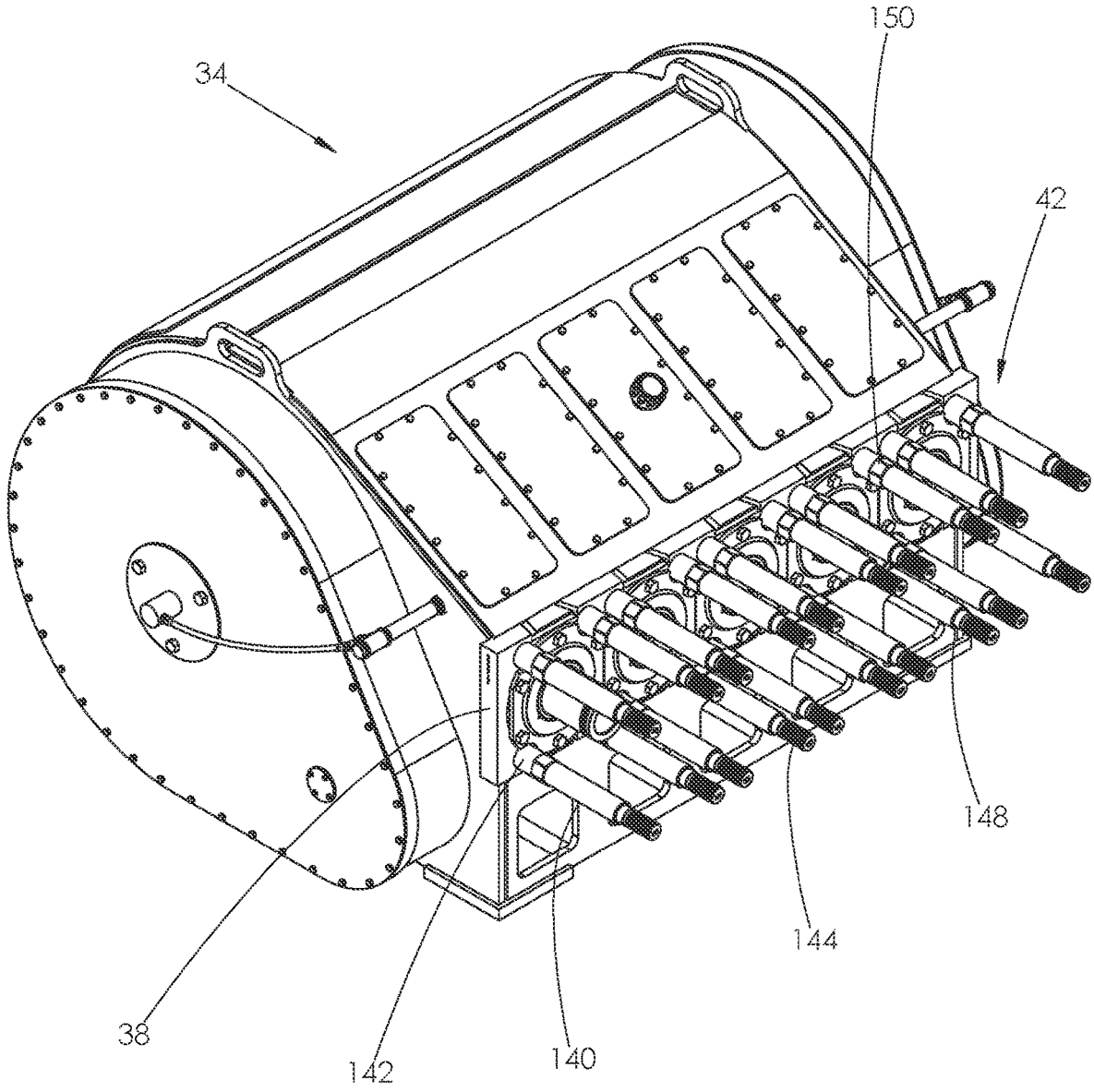
FIG. 12 is a front perspective view of the power end shown in FIG. 7.
Figure 13:
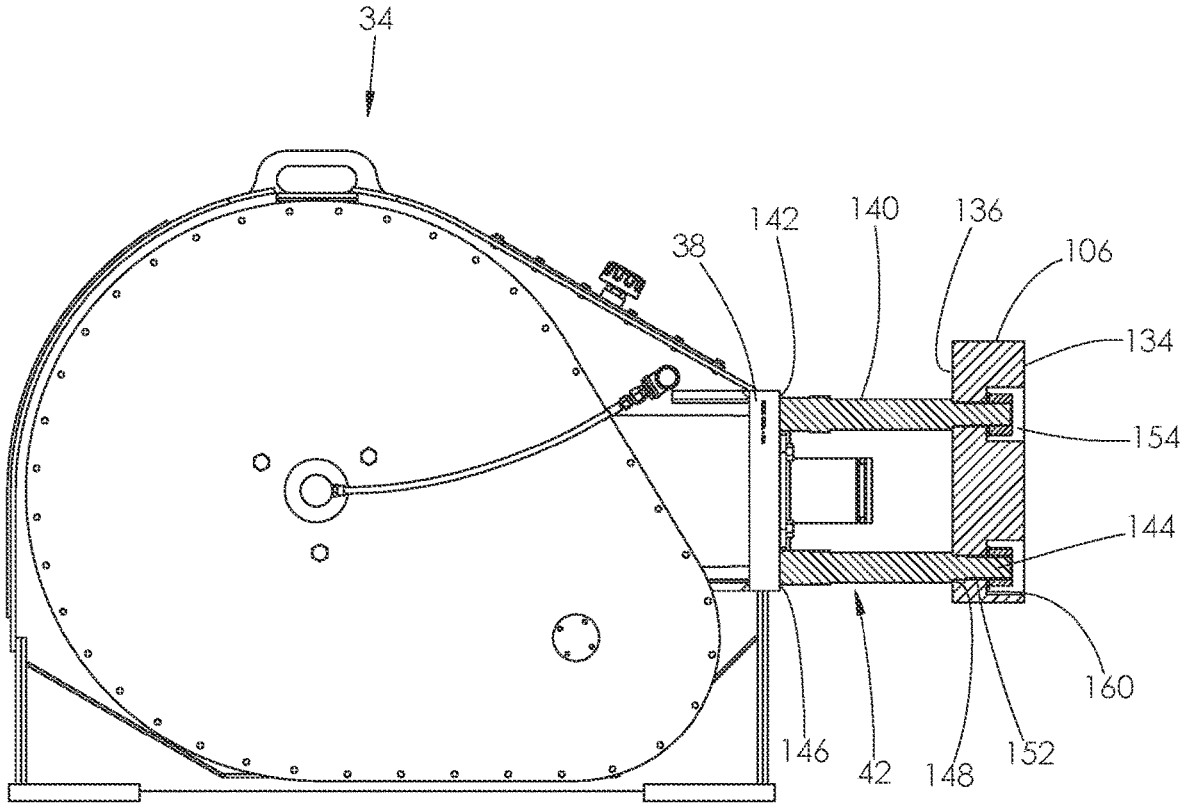
FIG. 13 is a side elevational view of the power end and connect plate shown in FIG. 7. The stay rods and connect plate are shown in cross-section.
Figure 14:
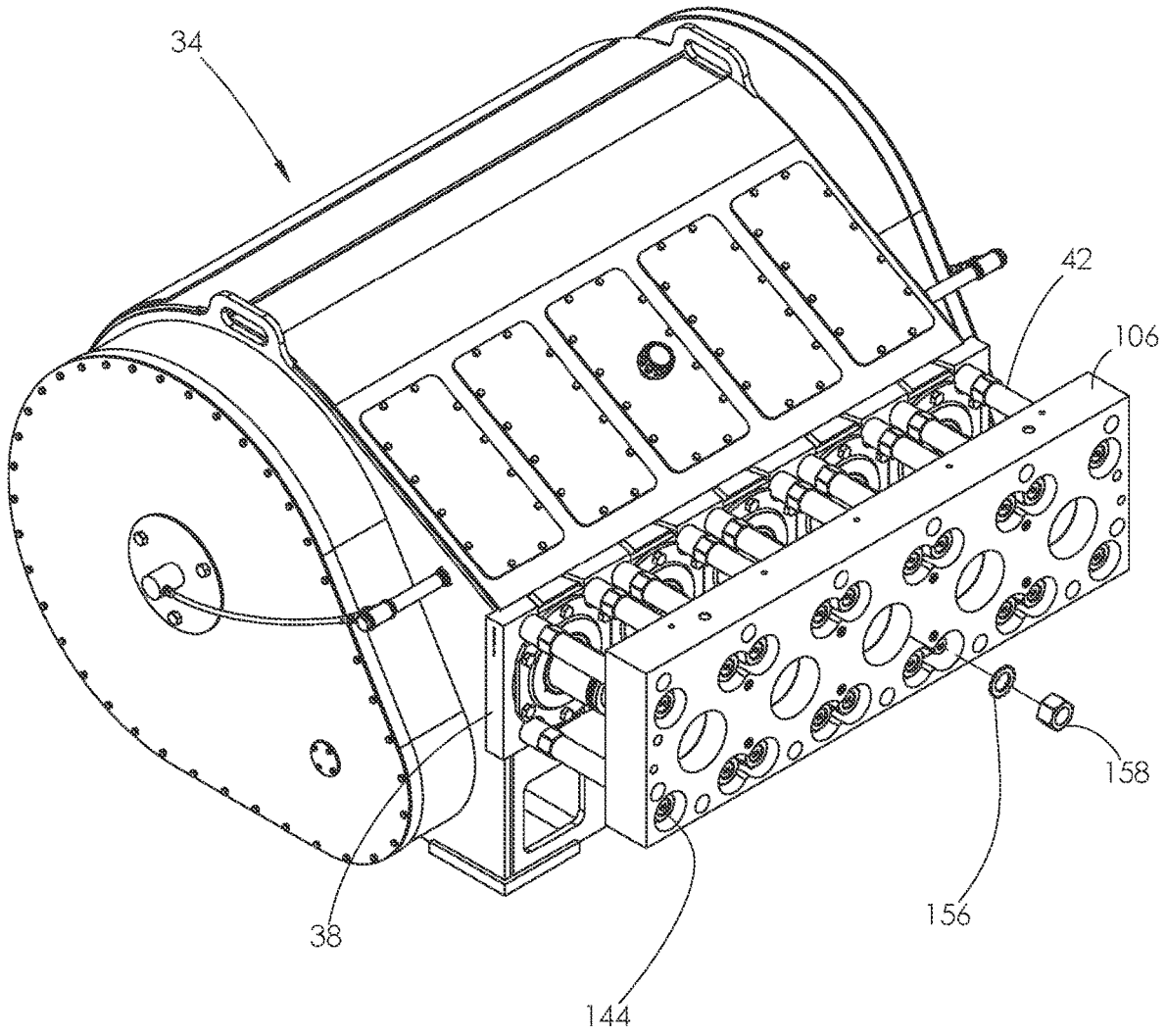
FIG. 14 is a front perspective view of the power end and connect plate shown in FIG. 7. A nut and washer used with the stay rods are shown exploded.
Figure 15:
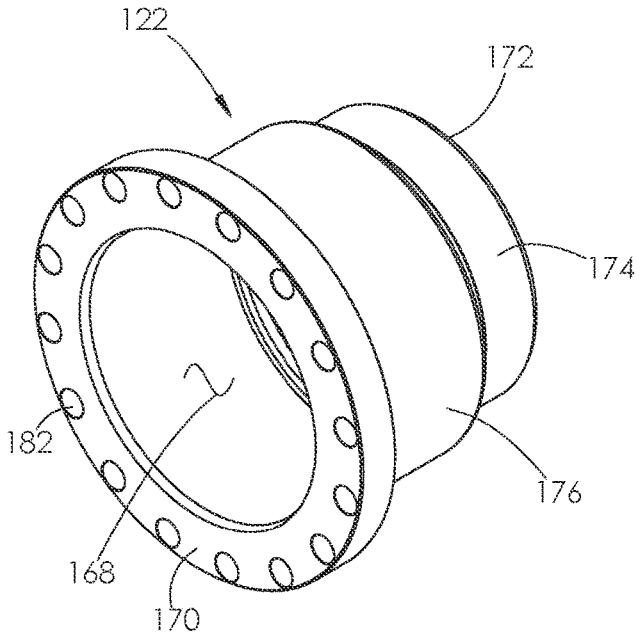
FIG. 15 is a top perspective view of a sleeve used with the fluid end shown in FIG. 9.
Figure 16:
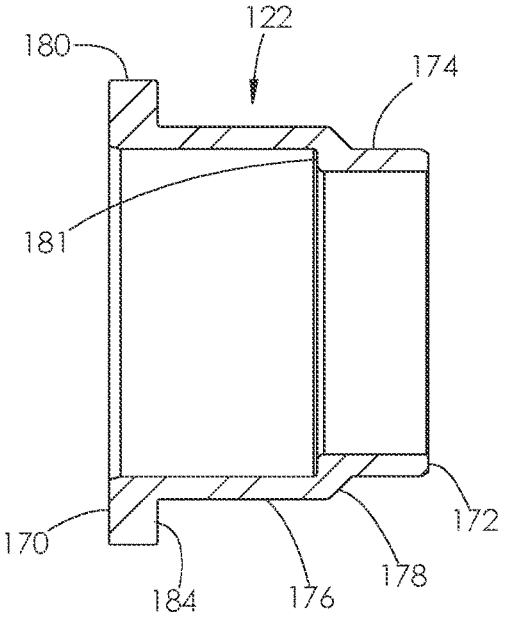
FIG. 16 is a cross-sectional view of the sleeve taken along line Q-Q from FIG. 18.
Figure 17:
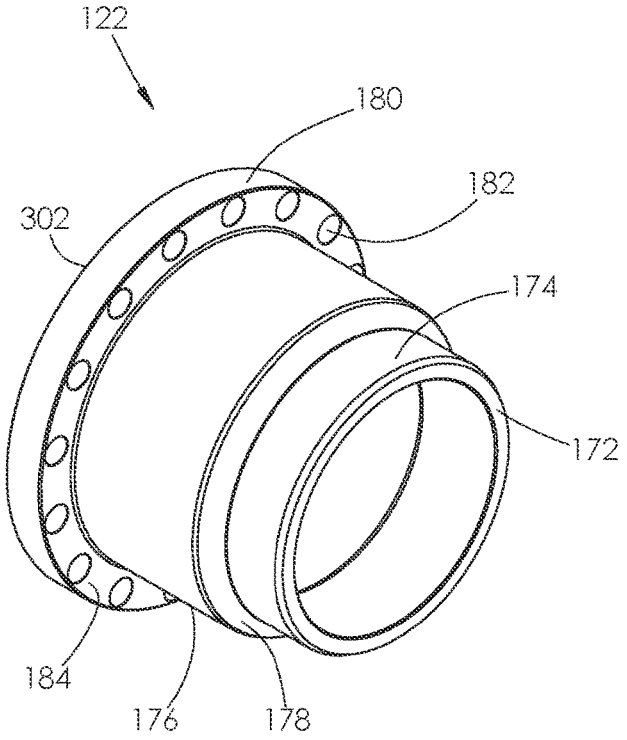
FIG. 17 is a bottom perspective view of the sleeve shown in FIG. 15.
Figure 18:
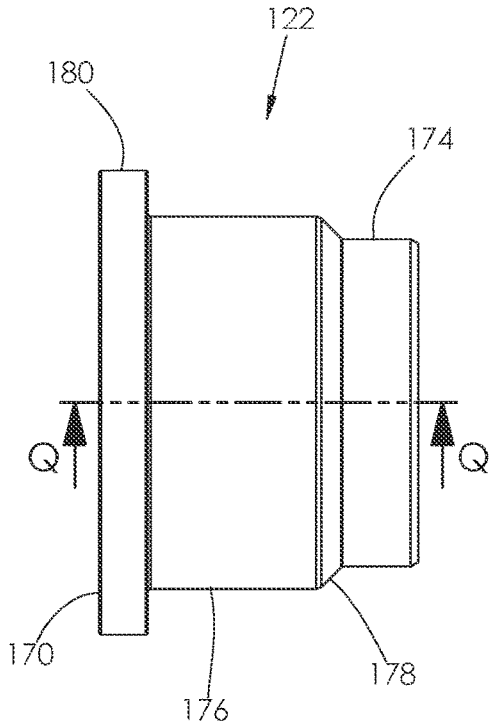
FIG. 18 is a side elevational view of the sleeve shown in FIG. 15.

With reference to FIGS. 12-14, the stay rods 42 interconnecting the connect plate 106 and the power end 34 each comprise an elongate body 140 having opposed first and second ends 142 and 144. External threads are formed in the body 140 adjacent each of its ends 142 and 144. These threaded portions of the body 140 are of lesser diameter than the rest of the body 140. A step separates each threaded portion of the body 140 from its unthreaded portion. Step 146 is situated adjacent its first end 142 and step 148 is situated adjacent its second end 144.

A plurality of internally threaded openings are formed about the periphery of the mounting plate 38 on the power end 34. Each threaded opening mates with a threaded first end 142 of one of the stay rods 42 in a one-to-one relationship. An integral nut 150 is formed on each stay rod 42 adjacent its first end 142. The nut 150 provides a gripping surface where torque may be applied to the stay rod 42 when installing the stay rod 42 in the mounting plate 38. Once a stay rod 42 has been installed in the mounting plate 38, the elongate body 140 and second end 144 project from the front surface of the mounting plate 38, as shown in FIG. 12. In alternative embodiments, the stay rods may be installed within threaded connectors supported on the mounting plate.

With reference to FIGS. 11, 13 and 14, a plurality of bores 152 are formed about the periphery of the connect plate 106 for receiving the second end 144 of each stay rod 42, as shown in FIG. 13. Each of the bores 152 opens on the front surface 134 and rear surface 136 of the connect plate 106. The number of bores 152 is equal to the number of stay rods 42, and the bores 152 are positioned such that they are alignable with the stay rods 42, in a one-to-one relationship. In alternative embodiments, the bores in the connect plate may be spaced so as to match different stay rod spacing configurations used with different power ends.

A counterbore 154 is formed in each bore 152 adjacent the front surface 134 of the connect plate 106. Adjacent counterbores 154 may overlap each other, as shown in FIG. 11. In alternative embodiments, each bore may be spaced from each adjacent bore such that their respective counterbores do not overlap.

Continuing with FIG. 13, a stay rod 42 is installed within one of the bores 152 by inserting its second end 144 into the opening of the bore 152 formed on the rear surface 136 of the connect plate 106. The stay rod 42 is extended into the bore 152 until the step 148 abuts the rear surface 136. When a stay rod 42 is installed, its second end 144 projects within the counterbore 154 of its associated bore 152. To secure each stay rod 42 to the connect plate 106, a washer 156 and nut 158 are installed on the second end 144 of the stay rod 42, as shown in FIG. 14. Once installed, each nut 158 and its underlying washer 156 press against a flat bottom 160 of a counterbore 154 within which they are installed, as shown in FIG. 13. The nut 158 is fully contained within that counterbore 154.

Turning back to FIG. 9, the body 110 of each fluid end section 104 is attached to the connect plate 106 such that the bore 108 aligns with one of the bores 138 formed in the connect plate 106. The body 110 is attached to the connect plate 106 at its front surface 134 via a fastening system (not shown).

The fastening system may comprise a plurality of screws, or alternatively, a plurality of studs, nuts, and washers. A plurality of bores 139 are formed in the connect plate 106, as shown in FIGS. 7 and 11. A plurality of blind bores 141, as shown in FIGS. 9 and 10, are formed in the rear surface 114 of the fluid end body 110 and are configured to align with the bores 139 when the body 110 is positioned over the bore 138. The screws or studs may be installed within the aligned bores 139 and 141 and tightened in order to attach the body 110 to the connect plate 106.

Continuing with FIG. 10, each bore 138 formed in the connect plate 106 may open into a counterbore 162 adjacent its rear surface 136. A plurality of threaded peripheral openings may be formed within a base 166 of the counterbore 162 and extend into the connect plate 106. The openings may be configured to receive screws, as will be described in more detail later herein.

Continuing with FIGS. 9 and 10, the sleeve 122 is installed into the bore 138 through the opening at the rear surface 136 of the connect plate 106. When installed, the sleeve 122 extends through the bore 138 and into the bore 108.

With reference to FIGS. 15-18, the sleeve 122 has a central passage 168 that opens on the sleeve's opposed top and bottom surfaces 170 and 172. The sleeve 122 includes a cylindrical lower portion 174 joined to cylindrical upper portion 176 by a tapered portion 178. An annular internal seat 181 is formed in the walls surrounding the central passage 168 adjacent the tapered portion 178.

The lower portion 174 has a reduced diameter relative to that of the upper portion 176. A flange 180 is formed around the upper portion 176 and serves as an extension of the top surface 170. A plurality of peripheral passages 182 are formed within the flange 180 and surround the central passage 168. Each of the peripheral passages 182 interconnects the sleeve's top surface 170 and a bottom surface 184 of the flange 180. The sleeve 122 is preferably made of metal, such as high strength steel.

Continuing with FIGS. 9 and 10, when the sleeve 122 is installed within the connect plate 106 and the body 110, the lower portion 174 of the sleeve 122 is positioned within the larger diameter section 118 of the bore 108. The tapered portion 178 engages with the tapered section 120 of the bore 108 and the flange 180 engages with the base 166 of the counterbore 162. Such engagement prevents further axial movement of the sleeve 122 within the bore 108. When installed, each of the peripheral passages 182 formed in the flange 180 aligns with one of the peripheral openings formed in the base 166, in a one-to-one relationship.

Continuing with FIGS. 9 and 10, the outer surface of the sleeve 122 includes no annular recess for housing a seal. Instead, an annular recess 186 is formed in the walls surrounding the larger diameter section 118 of the bore 108, as shown in FIG. 10. The recess 186 is configured to house an annular seal 188. Preferably, the seal 188 is a high-pressure seal.

The recess 186 comprises two sidewalls joined by a base. The seal 188 is closely received within the recess 186. After the seal 188 is installed within the recess 186, the sleeve 122 is installed within the bore 108.

When the sleeve 122 is installed within the bore 108, the seal 188 within the bore tightly engages the outer surface of the sleeve's lower portion 174. During operation, the seal 188 wears against the lower portion 174. If the outer surface of the lower portion 174 begins to erode, allowing fluid to leak around the sleeve 122, the sleeve is removed and replaced with a new sleeve. The seal 188 may also be removed and replaced with a new seal, if needed.

Continuing with FIGS. 9 and 10, the bottom surface 172 of the sleeve 122 is exposed to high fluid pressure within the interior of the body 110. The fluid pressure may be high enough to dislodge the sleeve 122 from the aligned bores 138 and 108. To keep the sleeve 122 within the bores 138 and 108, a retainer 194 is attached to the connect plate 106 above the sleeve 122.

Figure 19:
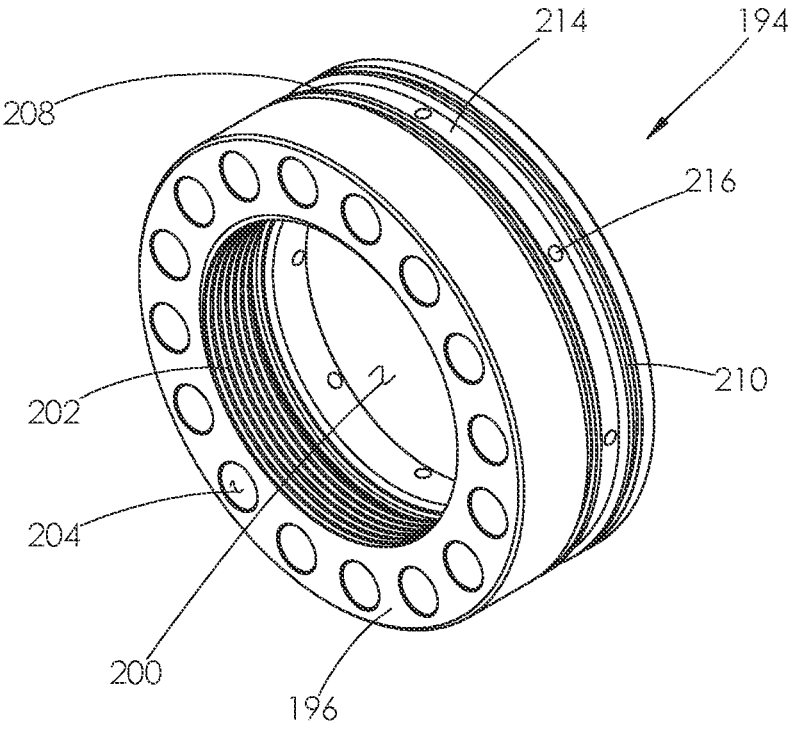
FIG. 19 is a top perspective view of a retainer used with the fluid end shown in FIG. 9.
Figure 20:
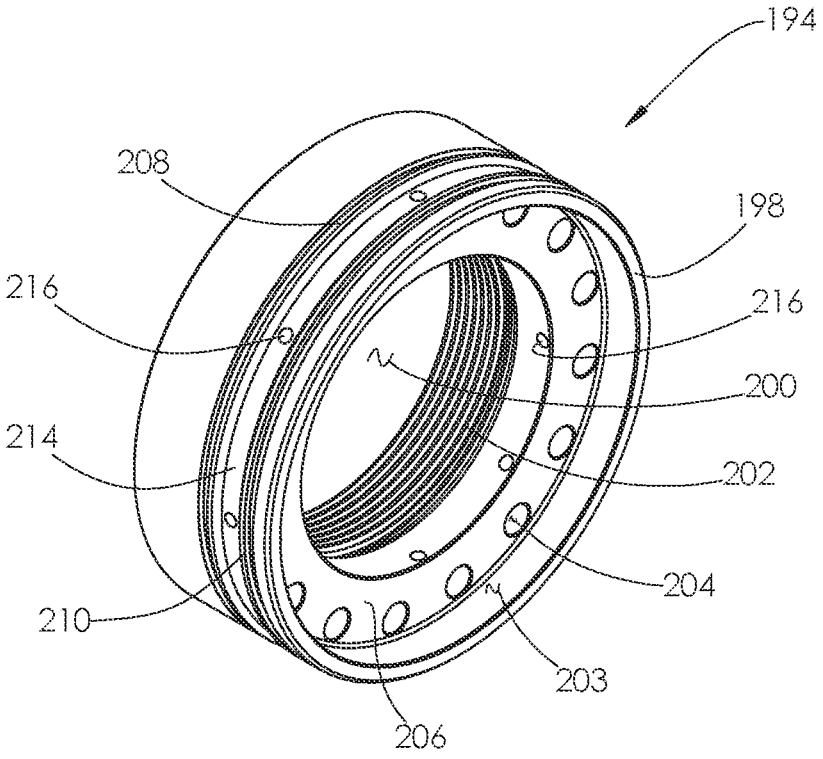
FIG. 20 is a bottom perspective view of the retainer shown in FIG. 19.

With reference to FIGS. 19 and 20, the retainer 194 has a cylindrical body having opposed top and bottom surfaces 196 and 198. A central passage 200 is formed in the interior of the retainer 194. Internal threads 202 are formed in the walls surrounding the central passage 200 adjacent the retainer's top surface 196. A counterbore 203 is formed in the central passage 200 adjacent the retainer's bottom surface 198. A plurality of peripheral passages 204 are formed in the retainer 194 and surround the central passage 200. Each peripheral passage 204 interconnects the retainer's top surface 196 and the base 206 of the counterbore 203. The retainer 194 is preferably made of metal, such as high strength steel.

A plurality of annular recesses are formed in the outer surface of the retainer 194 adjacent its bottom surface 198. A first and a third annular recess 208 and 210 are each configured for housing a seal. Preferably, the seal is an O-ring. The first and third recesses 208 and 210 are formed on opposite sides of a second annular recess 214. A plurality of passages 216 are formed in the second annular recess 214. The passages 216 interconnect the inner and outer surfaces of the retainer 194.

Turning back to FIGS. 9 and 10, the retainer 194 is sized to be closely received within the counterbore 162 in the connect plate 106. When the retainer 194 is installed within the connect plate 106, the bottom surface 198 of the retainer 194 engages the base 166 of the counterbore 162. The sleeve's flange 180 is sized to be closely received within the counterbore 203 formed in the retainer 194. When assembled, the top surface 170 of the sleeve 122 engages with the base 206 of the counterbore 203.

The retainer 194 is secured to the connect plate 106 using a fastening system (not shown). The fastening system may comprise a plurality of threaded screws, such as socket-headed cap screws. Each of the screws is received within one of the openings formed in the counterbore's base 166, one of the passages 182 formed in the flange 180, and one of the passages 204 formed in the retainer 194, in a one-to-one relationship.

The screws are rotated until they tightly attach the retainer 194 to the connect plate 106 and securely hold the sleeve 122 within the aligned bores 138 and 108. Because the retainer 194 is attached to the connect plate 106 using the fastening system, no external threads are formed on the outer surface of the retainer 194. Likewise, no internal threads are formed within the walls of the aligned horizontal bores 138 and 108.

When the retainer 194 is installed within the counterbore 162, the retainer's second annular recess 214 aligns with a weep hole 222 formed in the connect plate 106, as shown in FIG. 7. The weep hole 222 is a bore that interconnects a top surface 224 of the connect plate 106 and the counterbore 162. A plurality of weep holes 222 are formed in the connect plate 106, as shown in FIG. 7. Each weep hole 222 opens into one of the counterbores 162, in a one-to-one relationship.

During operation, small amounts of fluid may leak around the sleeve 122. The fluid may pass through the passages 216 in the retainer 194 and into the second annular recess 214. From the second annular recess 214, the fluid may flow into the corresponding weep hole 222 and eventually exit the fluid end 102. Thus, the second annular recess 214 and the corresponding weep hole 222 serve as a fluid flow path for excess fluid to exit the fluid end 102.

Continuing with FIGS. 9 and 10, a plunger 226 is installed within the sleeve 122 and extends into the bore 108. Prior to installing the plunger 226 within the sleeve 122, a plunger packing 228 is installed within central passage 168 of the sleeve 122. The plunger packing 228 prevents high-pressure fluid from passing around the plunger 226 as the plunger reciprocates. Each plunger packing 228 comprises a plurality of annular seals compressed together and having aligned central passages. The outer seals may be made of metal and compress the inner pressure seals. The inner pressure seals are preferably high-pressure seals.

Figure 21:
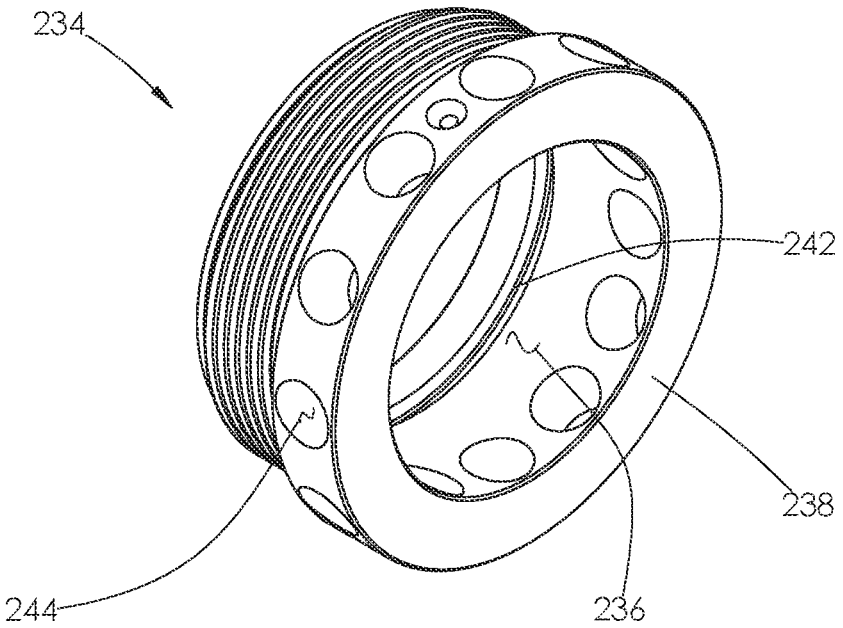
FIG. 21 is a top perspective view of a packing nut used with the fluid end shown in FIG. 9.
Figure 22:
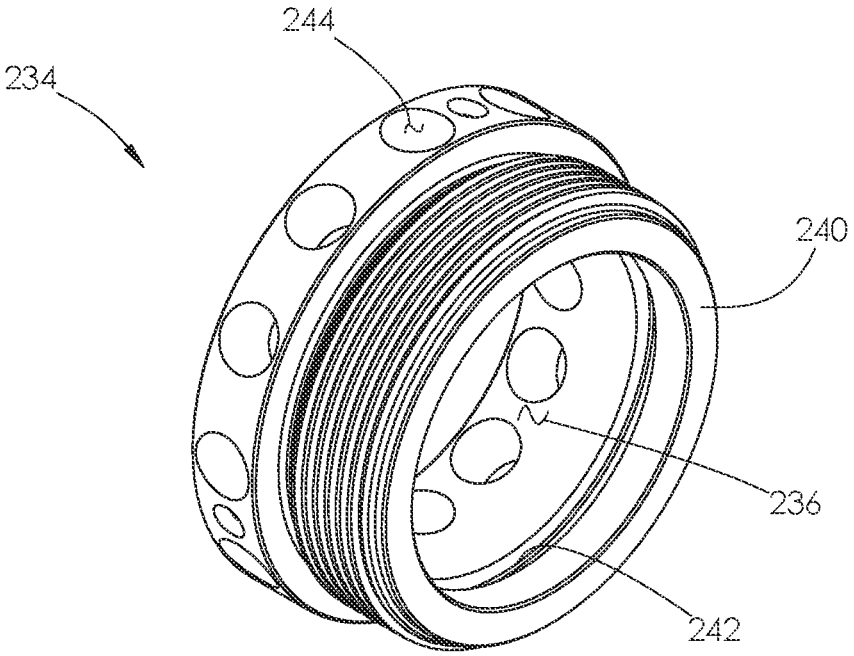
FIG. 22 is a bottom perspective view of the packing nut shown in FIG. 21.

When the plunger packing 228 is installed within the sleeve 122, one of the outer seals engages the sleeve's internal seat 181. The plunger packing 228 is secured within the sleeve 122 by a packing nut 234, shown in FIGS. 21 and 22.

The packing nut 234 comprises a cylindrical body having a central passage 236 formed therein. The central passage 236 interconnects the packing nut's top and bottom surfaces 238 and 240. An annular recess 242 is formed within the walls surrounding the central passage 236 and is configured to house a seal. Preferably, the seal is a lip seal. The seal helps prevent fluid from leaking around the packing nut 234 during operation. The outer surface of the packing nut 234 is threaded adjacent its bottom surface 240. The external threads are matingly engageable with the internal threads formed in the retainer 194. The packings nut 234 is preferably made of metal, such as high strength steel.

When the packing nut 234 is installed within the retainer 194, the bottom surface 240 of the packing nut 234 engages with one of the outer seals of the plunger packing 228. Such engagement compresses the plunger packing 228, creating a tight seal. When installed within the retainer 194, the packing nut's central passage 236 aligns with the central passage formed in the plunger packing 228.

A plurality of peripheral passages 244 are formed in the outer surface of the packing nut 234 adjacent its top surface 238. The passages 242 interconnect the central passage 236 and the outer surface of the packing nut 234. The passages 242 serve as connection points for a spanner wrench. When assembling the fluid end section 104, the spanner wrench is used to tightly thread the packing nut 234 into its corresponding retainer 194.

Once the sleeve 122, plunger packing 228, retainer 194, and packing nut 234 are installed within the pair of aligned bores 138 and 108, the plunger 226 is then installed within those bores. Alternatively, the plunger 226 may be installed prior to installing the packing nut 234. When the plunger 226 is installed within the fluid end section 104, the components installed within the aligned bores 138 and 108 surround the outer surface of the plunger 226.

Figure 10A:
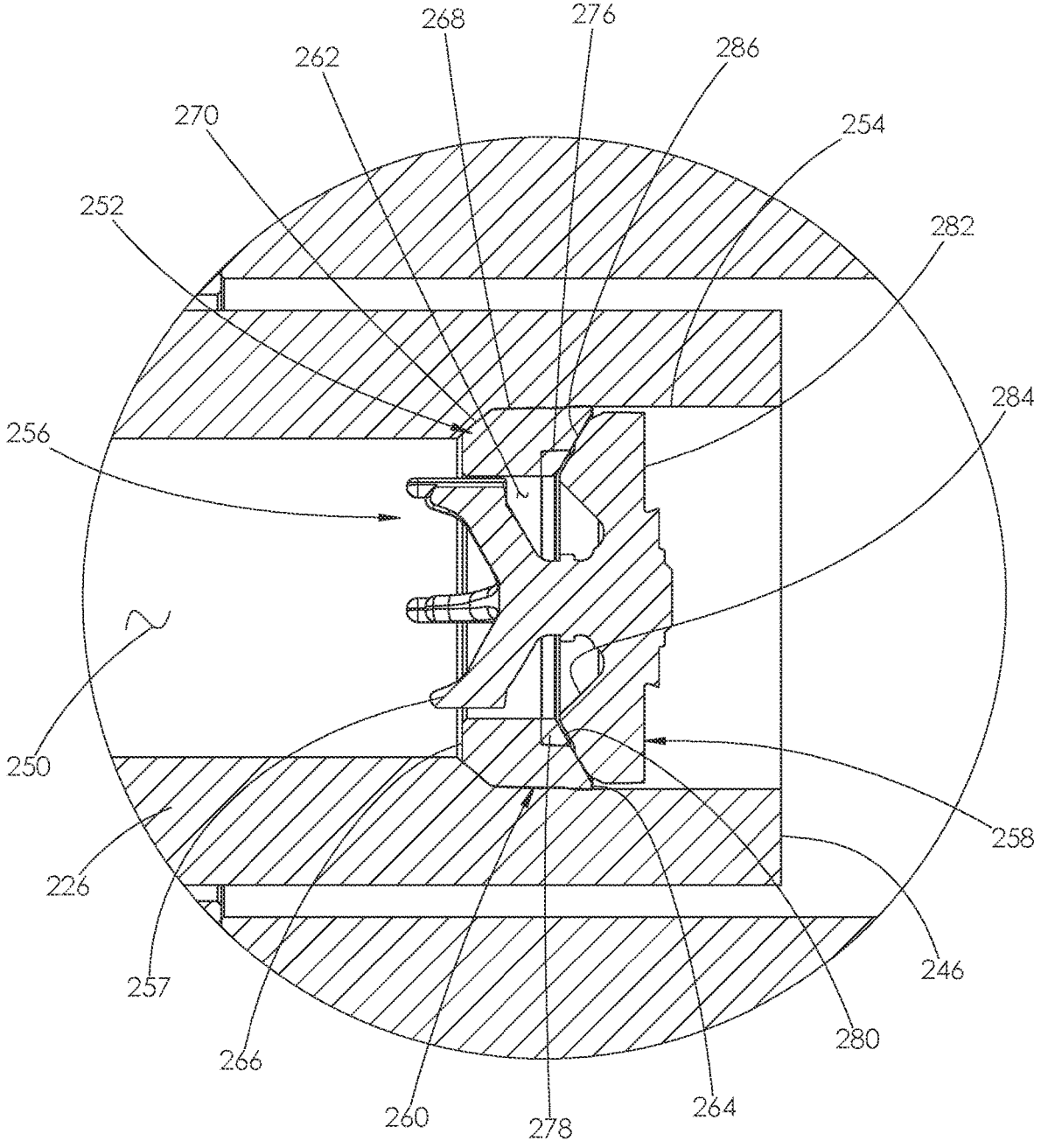
FIG. 10A is an enlarged view of area A shown in FIG. 10.

Continuing with FIGS. 9 and 10, the plunger 226 comprises an elongate body having opposed first and second ends 246 and 248. A central fluid passage 250 extends through the body and opens at each end 246 and 248. The passage 250 widens adjacent the first end 246 into a tapered section 252 joined to a larger diameter section 254, as shown in FIG. 10A. An inlet valve 256 is installed within the tapered and larger diameter sections 252 and 254 of the passage 250.

Continuing with FIG. 10A, the inlet valve 256 comprises a valve body 258 that seals against a valve seat 260. The valve seat 260 is preferably made of metal, such as high strength steel, and has a cylindrical body having a central passage 262 formed therein. The central passage 262 interconnects the seat's top and bottom surfaces 264 and 266. When the valve seat 260 is installed within the plunger 226, the seat's central passage 262 is in fluid communication with the passage 250.

The outer surface of the valve seat 260 has an upper section 268 that joins a tapered section 270. The tapered section 270 is between the upper section 268 and the seat's bottom surface 266. The upper section 268 has a uniform diameter. However, an annular recess may also be formed in the outer surface of the valve seat 260 for housing a seal, preferably an O-ring. The seal helps prevent fluid from leaking between the outer surface of the valve seat 260 and the walls surrounding the central passage 250.

When the valve seat 260 is installed within the passage 250, the tapered section 270 of the valve seat 260 engages the tapered section 252 of the passage 250. Such engagement prevents further axial movement of the valve seat 260 within the passage 250.

An annular recess 276 is formed in the top surface 264 of the valve seat 260. The location of the recess 276 corresponds with the area of the valve seat 260 known to erode over time. The recess 276 is configured for housing a hardened insert 278. The insert 278 is preferably made of a hardened material, such as tungsten carbide. Such material resists wear and erosion, significantly extending the life of the valve seat 260. The insert 278 is sized to be closely received with the recess 276. The top surface of the insert 278 is characterized by a taper 280.

The valve body 258 is preferably made of metal, such as high strength steel, and has a cylindrical body having opposed top and bottom surfaces 282 and 284. A sealing surface 286 is formed on the bottom surface 284 of the valve body 258. The sealing surface 286 is characterized by a taper that corresponds with the taper 280 formed in the top surface of the insert 278. During operation, the sealing surface 286 engages the insert's taper 280. Such engagement blocks the flow of fluid around the valve body 258. The valve body 258 has legs 257 projecting from its bottom surface 284. The legs 257 help center the valve body 258 on the valve seat 260 during operation.

While not shown in FIGS. 9 and 10, a valve retention system and valve return system may be installed within the larger diameter section 254 of the fluid passage 250 above the valve body 258. Examples of such systems are described with reference to an alternative embodiment of a plunger 287 and inlet valve 291, shown in FIGS. 23 and 24.

Figure 23:
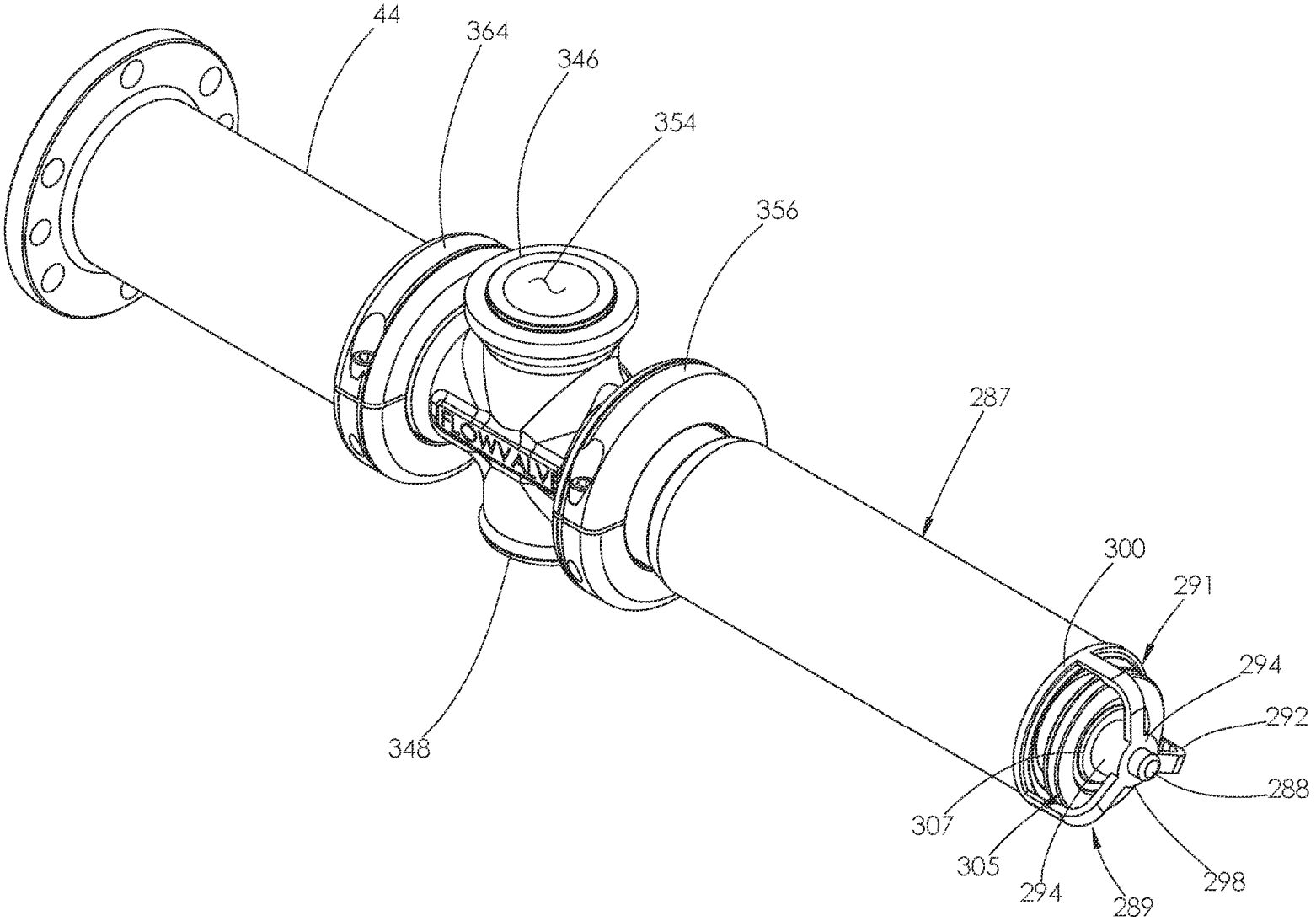
FIG. 23 is a perspective view of an alternative embodiment of a plunger for use with the fluid end shown in FIG. 9. The plunger is shown attached to an inlet tee and a pony rod.
Figure 24:
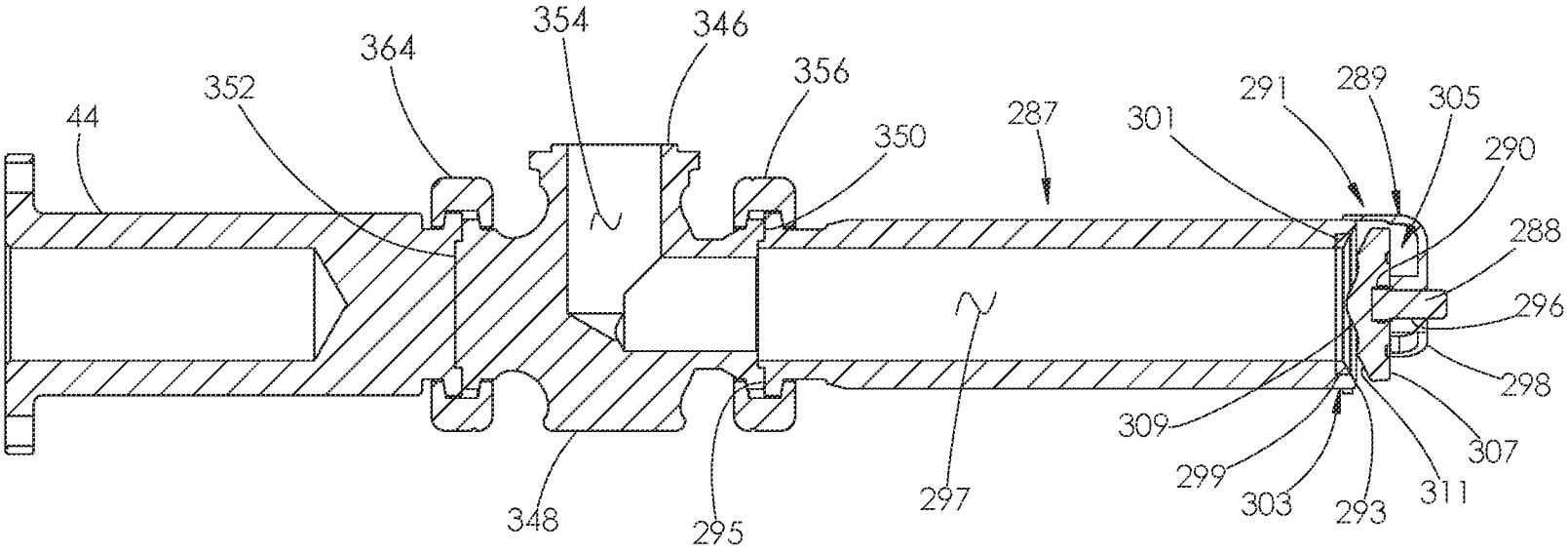
FIG. 24 is a cross-sectional view of the plunger, inlet tee, and pony rod shown in FIG. 23.

With reference to FIGS. 23 and 24, the plunger 287 comprises a body having opposed first and second ends 293 and 295. A fluid passageway 297 is formed within the body and interconnects the first and second ends 293 and 295. The passageway opens into a counterbore 299 adjacent its first end 293. An insert 301 is installed within the counterbore 299. The insert 301 is constructed the same as the insert 278, shown in FIGS. 9 and 10. The installed insert 301 forms a replaceable portion of the valve seat 303 of the inlet valve 291.

Continuing with FIG. 24, the inlet valve 291 further comprises a valve body 305. The valve body 305 has opposed top and bottom surfaces 307 and 309. A sealing surface 311 is formed on the bottom surface 309 that corresponds with a tapered top surface of the insert 301. An elongate stem 288 is installed within a threaded bore 290 formed in the top surface 307 of the valve body 305. The stem 288 projects away from the body's top surface 307 and engages a valve retention system 289.

The valve retention system 289 shown in FIGS. 23 and 24 is a cage 298 attached to the first end 293 of the plunger 287. The cage 298 comprises three legs 292 joined to a central retainer 294 on one end and a ring 300 on the opposed end, as shown in FIG. 23. In alternative embodiments, the cage may comprise more or less than three legs.

The retainer 294 is generally cylindrical and has a central passage 296 that interconnects its top and bottom surfaces, as shown in FIG. 24. The passage 296 is sized to receive the stem 288. During operation, further axial movement of the valve body 305 is prevented by engagement of the top surface 307 of the valve body 305 with the bottom surface of the retainer 294.

The cage 298 is shown attached to the outer surface of the plunger 287 via its legs 292 and ring 300 in FIGS. 23 and 24. However, if the cage 298 is used with the inlet valve 256 shown in FIGS. 9 and 10, the cage 298 may be installed within the central passage 250 at the first end 246 of the plunger 226. Placing the cage 298 inside of the plunger 226 provides more room for the plunger 226 to reciprocate within the bore 108.

A valve return system (not shown) may be installed between the top surface 307 of the valve body 305 and the valve retention system 289. The valve return system may comprise a spring. The spring provides a force biasing the valve body 305 against the valve seat 303 during operation.

Figure 10B:
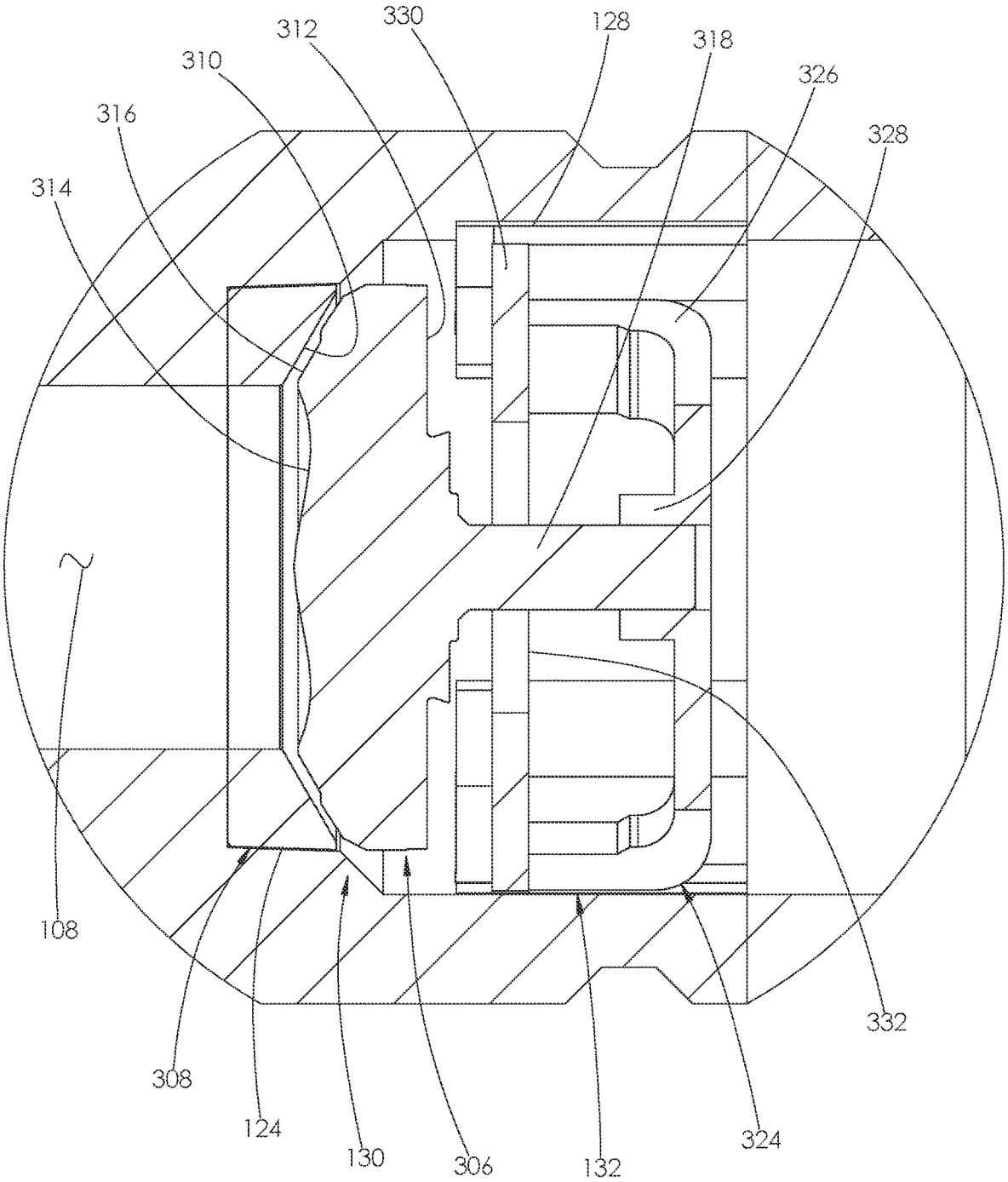
FIG. 10B is an enlarged view of area B shown in FIG. 10.

With reference to FIGS. 9, 10 and 10B, the outlet valve 130 comprises a valve body 306 that seals against a valve seat 308, similar to the inlet valve 256. The valve seat 308 is sized to fit within the first section 124 of the bore 108. The top surface of the seat 308 is characterized by a taper 310. The seat 308 may be made of the same material as the insert 278.

The valve body 306 has a cylindrical body having opposed top and bottom surfaces 312 and 314. A sealing surface 316 is formed on a bottom surface 314 of the valve body 306. The sealing surface 316 is characterized by a taper that corresponds with the taper 310 formed in the top surface of the seat 308. During operation, the sealing surface 316 engages the taper 310. Such engagement blocks the flow of fluid around the valve body 306.

Continuing with FIG. 10B, a stem 318 may project from the top surface 312 of the valve body 306. The stem 318 may engage the valve retention system 132.

The valve retention system 132 shown in FIG. 10B comprises a cage 324 installed within a second section 128 of the bore 108. The cage 324 has a plurality of legs 326 joined on one end to a central retainer 328 and to a plate 330 on the opposed end. The plate 330 has a central opening 332. An outer surface of the plate 330 engages with slots formed in the walls surrounding the second section 128 of the bore 108. The stem 318 extends through the central opening 332 and into a passage formed in the retainer 328. During operation, further axial movement of the valve body 306 is prevented by engagement of a top surface 312 of the valve body 306 with a bottom surface of the plate 330.

A valve return system (not shown) may be installed between the top surface 312 of the valve body 306 and the plate 330. The valve return system may comprise a spring. The spring provides a force biasing the valve body 306 against the valve seat 308 during operation.

Turning back to FIGS. 9 and 10, a discharge manifold 338 is attached to the front surface 112 of the body 110. The discharge manifold 338 may be attached to the body 110 via a clamp (not shown). One or more seals may be positioned between the body 110 and the manifold 338 to prevent fluid leakage. The discharge manifold 338 includes a flow passage 340 that leads to a discharge conduit 342. The flow passage 340 is sized to serve as an extension of the second section 128 of the bore 108. Fluid within the bore 108 passes around the valve body 306, valve retention system 132, and valve return system and into the flow passage 340.

With reference to FIGS. 7-10, the second end 248 of the plunger 226 is attached to an inlet tee 344. The inlet tee 344 has opposed top and bottom surfaces 346 and 348 and opposed front and rear surfaces 350 and 352, as shown in FIG. 10. An internal conduit 354 is formed in the inlet tee 344 that interconnects its top and front surfaces 346 and 350. The front surface 350 of the inlet tee 344 is attached to the second end 248 of the plunger 226 via a clamp 356. When attached, the conduit 354 aligns with and is in fluid communication with the central passage 250 formed in the plunger 226.

Figure 25:
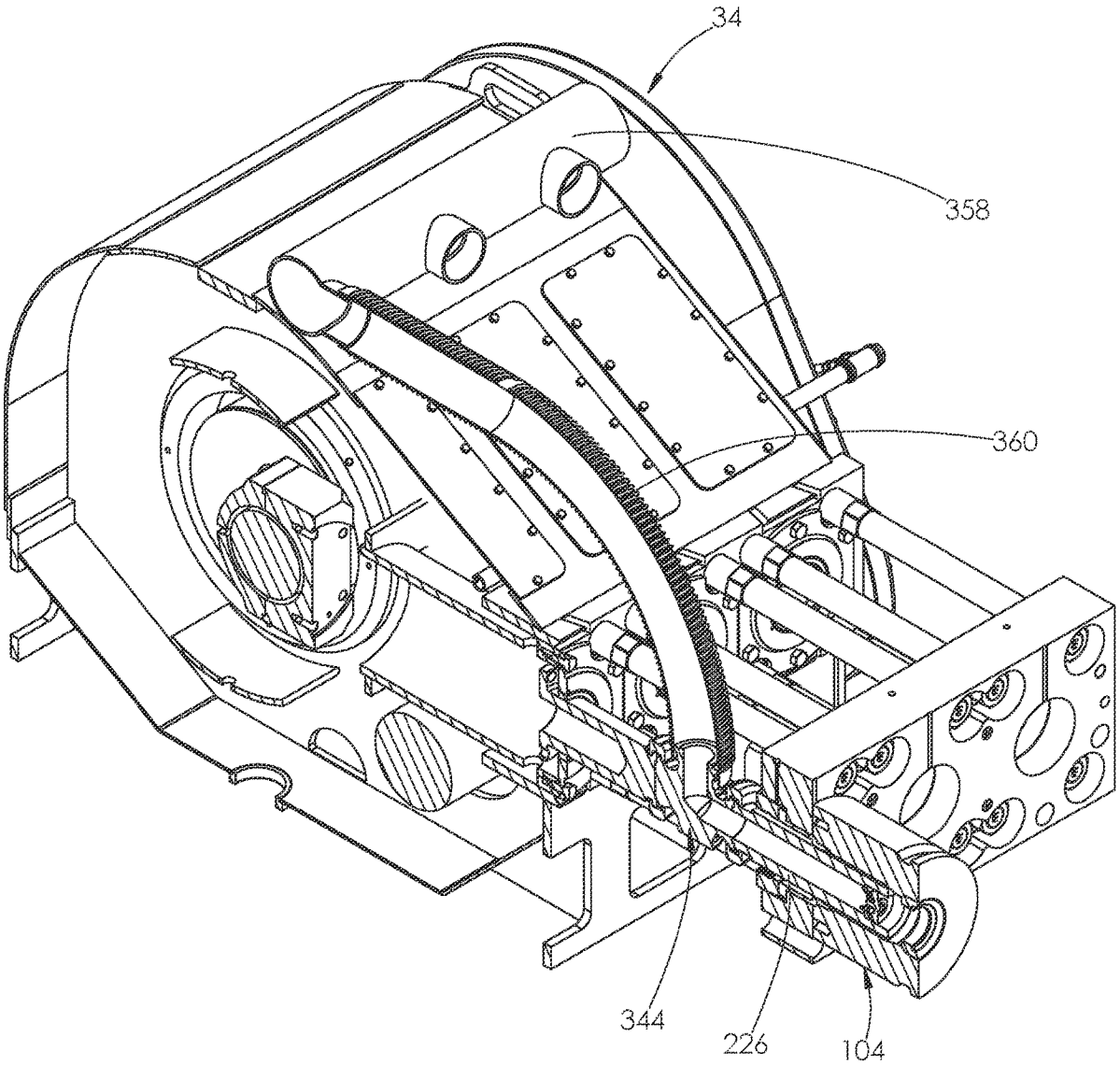
FIG. 25 is a perspective cross-sectional view of the fluid end and power end shown in FIG. 7. The inlet manifold is shown supported on the power end.
Figure 26:
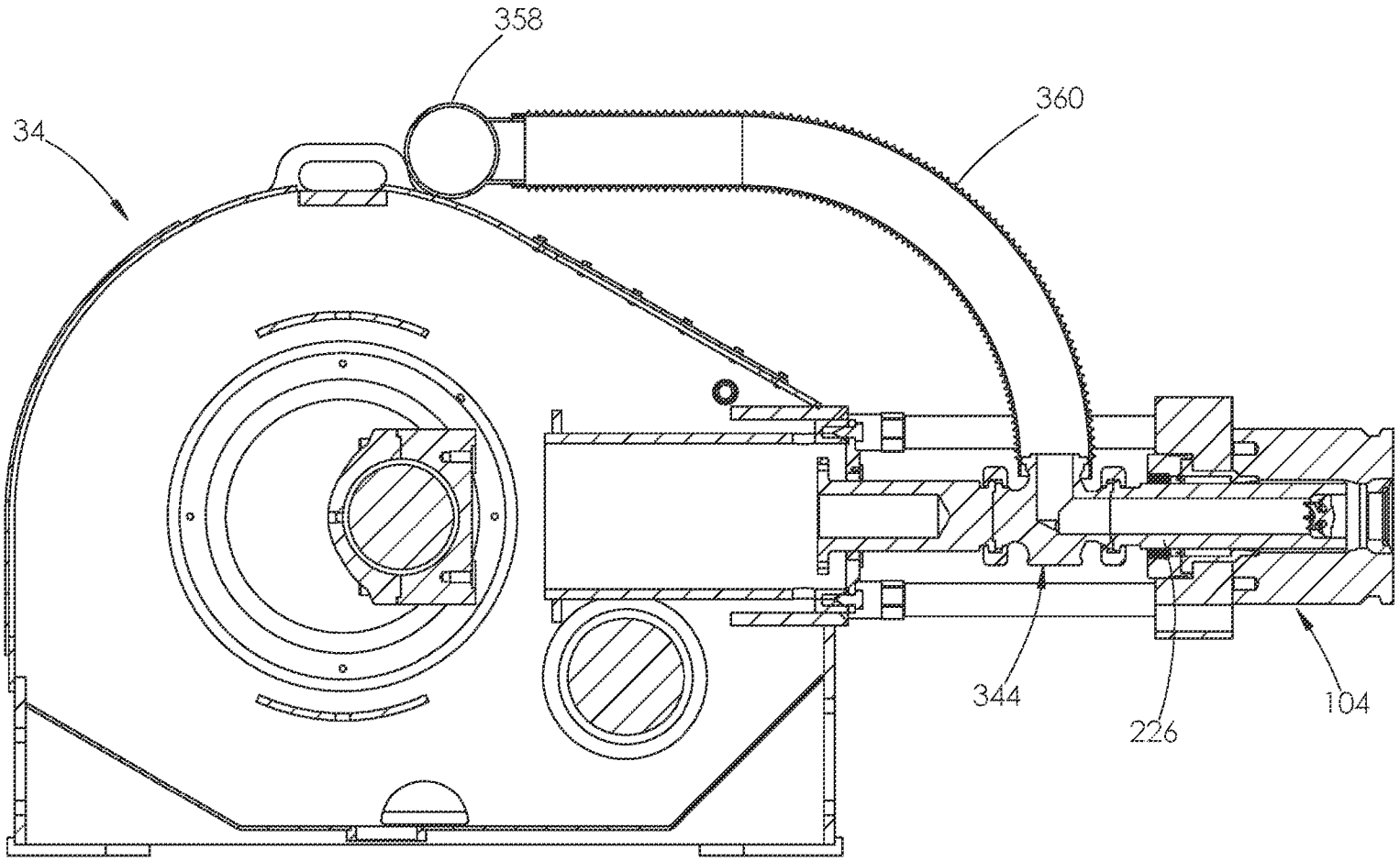
FIG. 26 is a cross-sectional view of the fluid end and power end shown in FIG. 25.

Turning to FIGS. 7 and 8, an inlet manifold 358 is connected to the top surface 346 of the inlet tee 344 via an inlet conduit 360. The inlet conduit 360 may be made of a flexible material and may be attached to the inlet manifold 358 via one or more connector conduits 362. The inlet manifold 358 may be supported over the fluid end 102, as shown in FIGS. 7 and 8. Alternatively, the inlet manifold 358 may be supported on the power end 34, as shown in FIGS. 25 and 26.

Continuing with FIGS. 7-10, the rear surface 352 of the inlet tee 344 is attached to a pony rod 44 via a clamp 364, as shown in FIG. 10. During operation, the power end 34 drives reciprocal movement of the pony rod 44, which in turn drives reciprocal movement of the inlet tee 344 and the plunger 226. The flexible inlet conduit 360 moves with the inlet tee 344 as it reciprocates, while the inlet manifold 358 remains stationary.

In operation, low-pressure fluid passes from the inlet manifold 358 to the inlet tee 344 through the inlet conduit 360. From the inlet conduit 360, the lower pressure fluid passes into the passage 250 formed in the plunger 226. As the plunger 226 is retracted out of the chamber 116 of the bore 108, the low-pressure fluid within the plunger 226 pushes the inlet valve body 258 away from the valve seat 260, opening the inlet valve 256. The low-pressure fluid flows around the inlet valve 256, the valve retention system 289, and the valve return system and into the chamber 116. As the fluid enters the chamber 116, the spring of the valve return system (not shown) pushes on the valve body 306, closing the inlet valve 256.

Low-pressure fluid within the chamber 116 is pressurized as the plunger 226 extends into the chamber 116. High-pressure fluid within the chamber 116 pushes the outlet valve body 306 away from the valve seat 308, opening the outlet valve 130. The high-pressure fluid flows around the outlet valve 130, the valve retention system 132, and the valve return system and into the flow passage 340 formed in the discharge manifold 338. The high-pressure fluid then exits the discharge manifold 338 through the discharge conduit 342. As the high-pressure fluid enters the flow passage 340, the spring of the valve return system (not shown) pushes on the valve body 306, closing the outlet valve 130.

Figure 6:
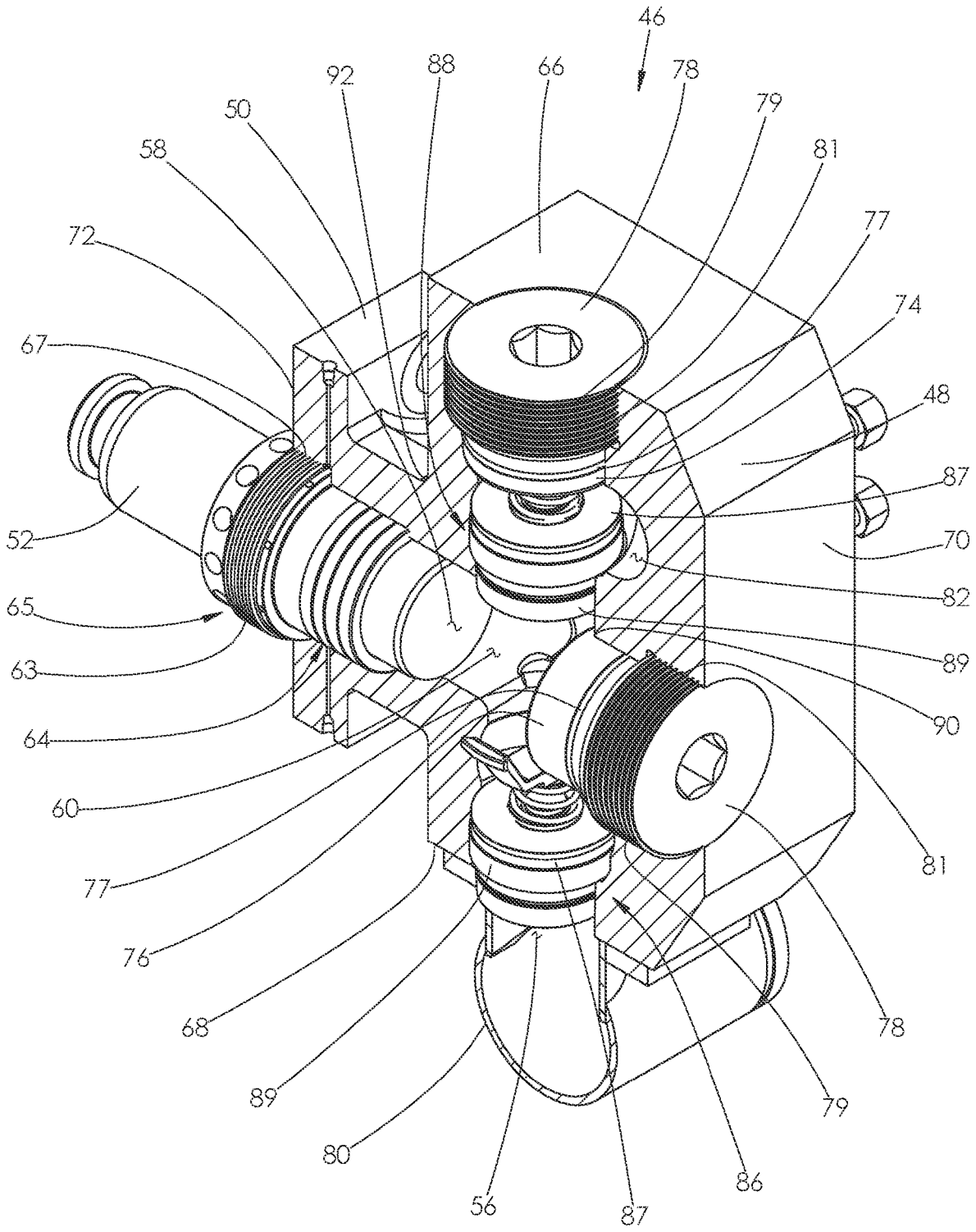
PRIOR ART FIG. 6
FIG. 6 is a sectional view of the fluid end shown in FIG. 5, taken along line A-A.

During operation, the valves 256 and 130 continually open and close as the plunger 226 reciprocates within the body 110. The inlet and outlet valves 256 and 130 may be larger, in diameter, than those used in traditional fluids ends, like the valves 86 and 88, shown in FIG. 6. The larger diameter results in larger sealing surface areas in the valves 256 and 130. The increase in surface area reduces the strike force per unit area of the valve body 258 and 306 against the valve seat 260 and 308 during operation. A reduced strike force reduces erosion of the sealing surfaces 286 and 316 and increases the life of the valves 256 and 130. Utilizing larger valves also allows a larger volume of fluid flow for the same opening distance. The larger fluid volume reduces the velocity of fluid as it goes through the valves, further reducing erosion of the sealing surfaces.

In an alternative embodiment, the inlet tee 344 may be attached to the plunger 287, as shown in FIGS. 23 and 24. The plunger 287 may be used in place of the plunger 226 in FIGS. 7-10.

Figure 27:
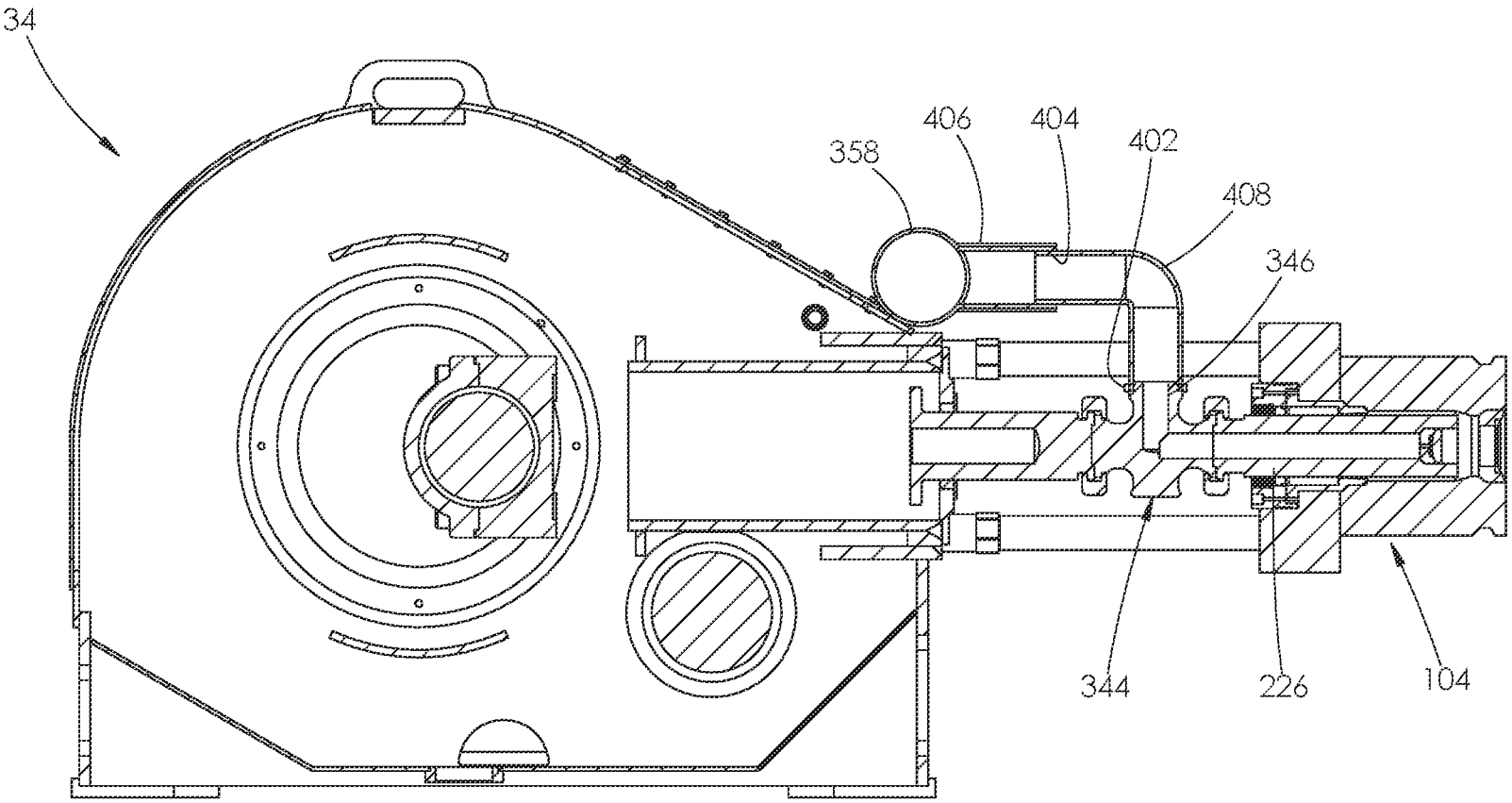
FIG. 27 is a cross-sectional view of the fluid end and power end shown in FIG. 7. Another embodiment of an inlet conduit is shown attached to the inlet manifold.

With reference to FIG. 27, another embodiment of an inlet conduit 400 is shown attached to the inlet manifold 358. The inlet conduit 400 is rigid, not flexible. A first end 402 of the inlet conduit 400 is attached to the top surface 346 of the inlet tee 344. A second end 404 of the inlet conduit 400 is disposed within a rigid connector conduit 406 attached to the inlet manifold 358. The inlet manifold 358 is supported on the power end 34. As the inlet tee 344 reciprocates, the second end 404 of the inlet conduit 400 reciprocates within the interior of the connector conduit 406. The inlet conduit 400 shown in FIG. 27 has an elbow shape.

Figure 28:
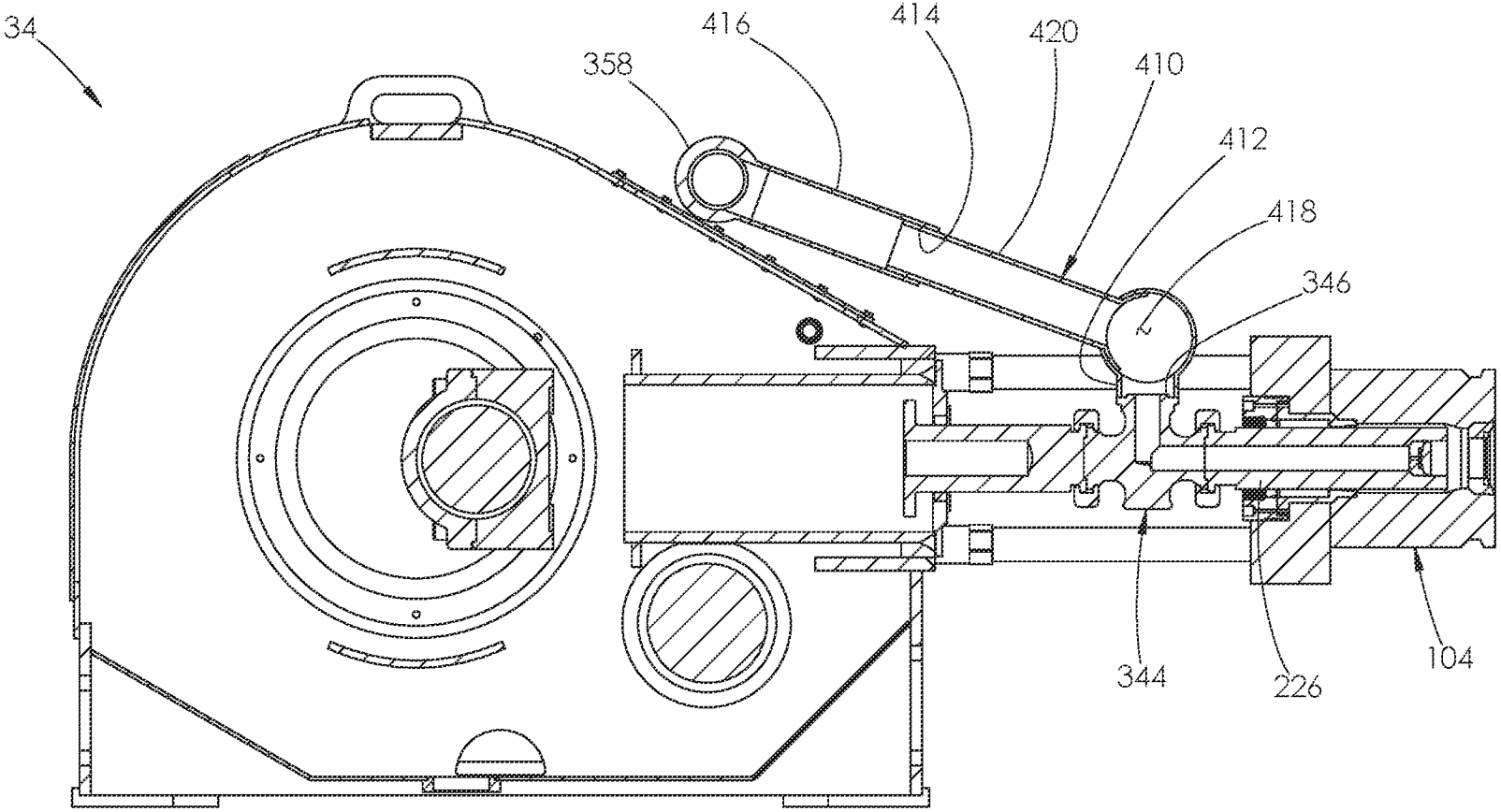
FIG. 28 is a cross-sectional view of the fluid end and power end shown in FIG. 7. Another embodiment of an inlet conduit is shown attached to the inlet manifold.

With reference to FIG. 28 another embodiment of an inlet conduit 410 is shown. Like the inlet conduit 400, the inlet conduit 410 is rigid. A first end 412 of the inlet conduit 410 is attached to the top surface 346 of the inlet tee 344. A second end 414 of the inlet conduit 410 is disposed within a rigid connector conduit 416 attached to the inlet manifold 358. The inlet manifold 358 is supported on the power end 34. As the inlet tee 344 reciprocates, the second end 414 of the inlet conduit 410 reciprocates within the interior of the connector conduit 416. Instead of having the shape of an elbow, like the inlet conduit 400, the inlet conduit 410 includes a central chamber 418 and a straight section 420.

Figure 29:
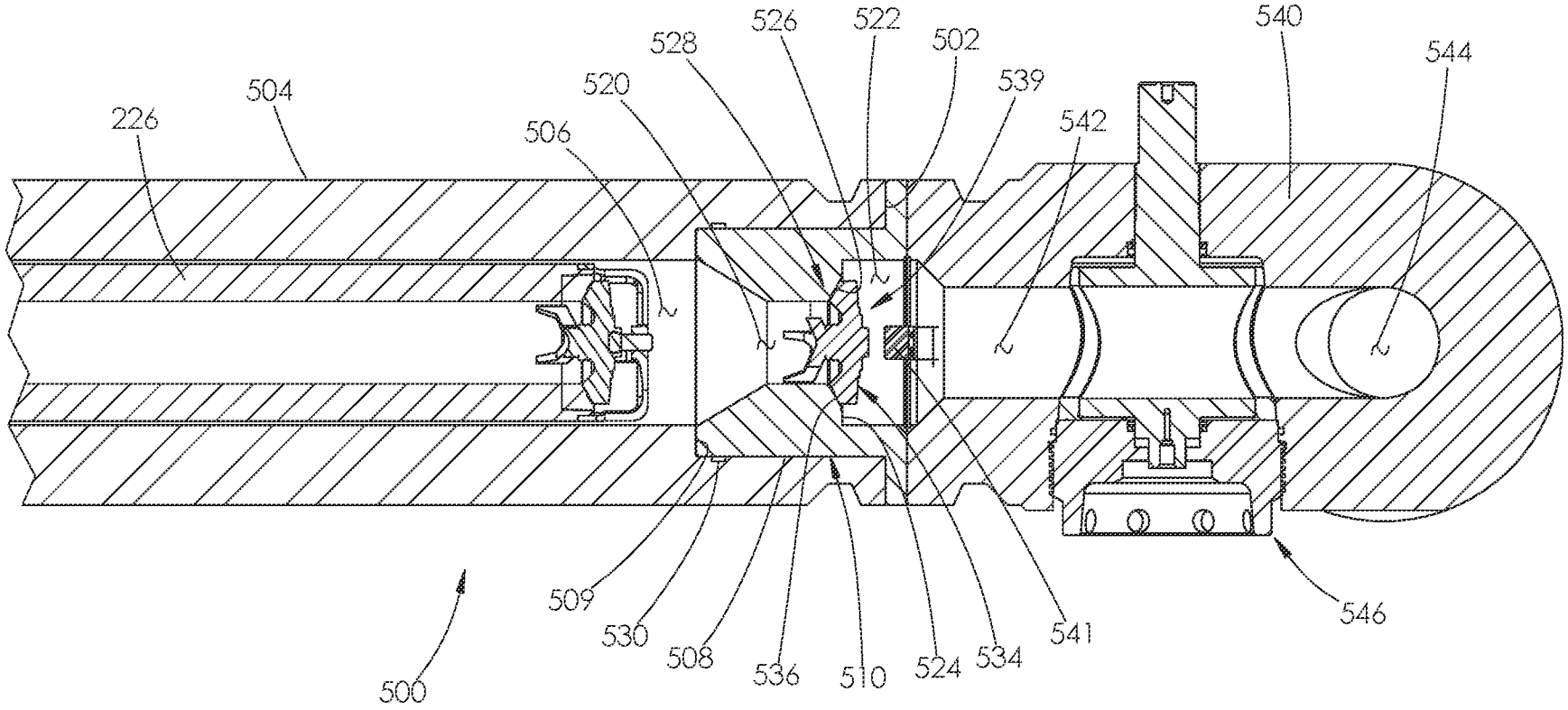
FIG. 29 is a cross-sectional view of an alternative embodiment of a fluid end section for use with the fluid end shown in FIG. 7.

Turning to FIG. 29, an alternative fluid end section 500 is shown. The fluid end section 500 is identical to the fluid end section 104, with the exception of the construction of its front surface 502. The fluid end section 500 comprises a body 504 having a bore 506 formed therein. The bore 506 opens into a counterbore 508 adjacent its front surface 502. A sleeve 510 is installed within the counterbore 508.

Figure 30:
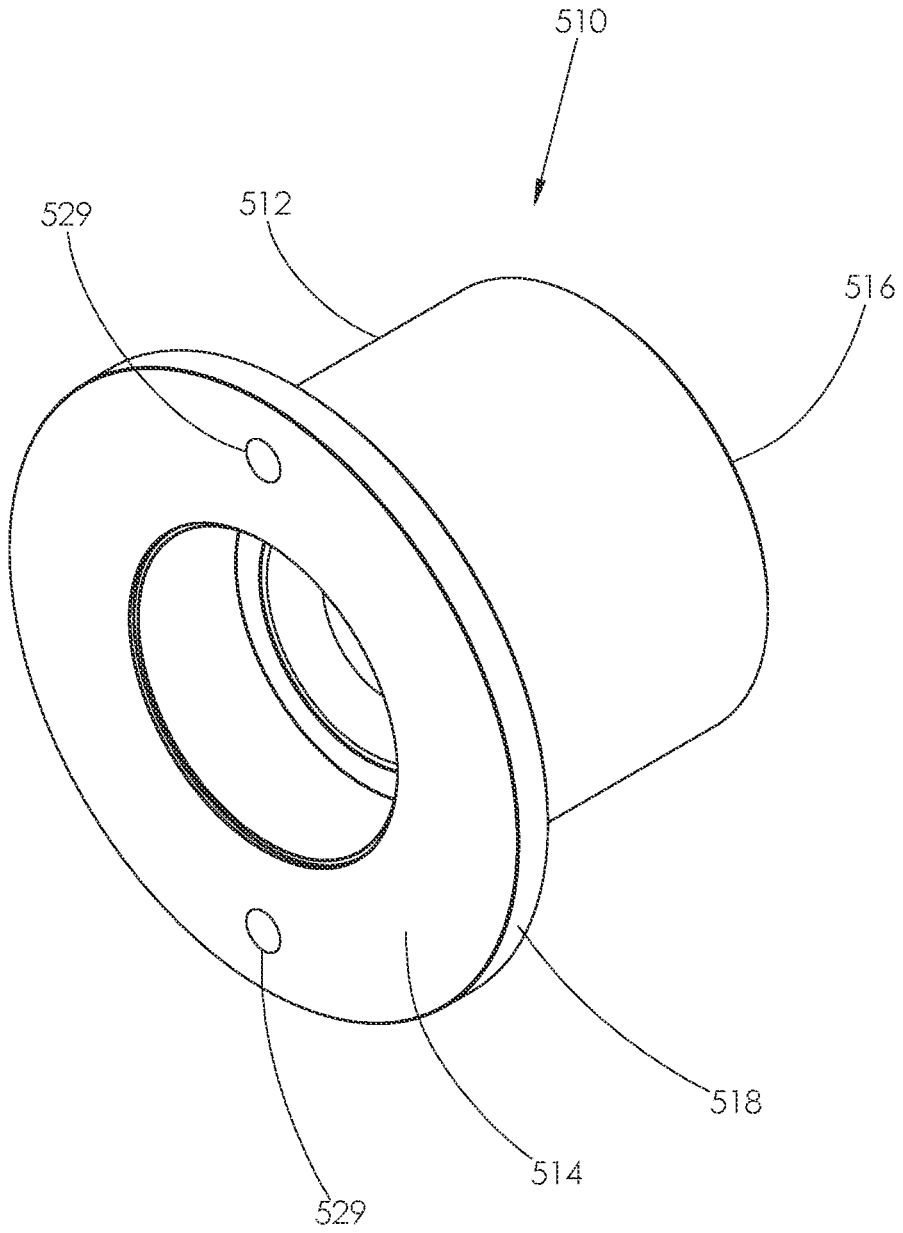
FIG. 30 is a top perspective view of a sleeve used with the fluid end section shown in FIG. 29.

With reference to FIGS. 29 and 30, the sleeve 510 comprises a cylindrical body 512 having opposed top and bottom surfaces 514 and 516. A flange 518 is formed around the body 512 at its top surface 514. A central passage 520 is formed within the body 512 and interconnects the body's top and bottom surfaces 514 and 516. The passage 520 widens adjacent the bottom surface 516 of the body 512 and opens into a counterbore 522 adjacent the top surface 514. A base 524 of the counterbore 522 includes a taper 526. The taper 526 and the walls surrounding the passage 520 form a valve seat 528.

When the sleeve 510 is installed within the body 504, the flange 518 engages the front surface 502 of the body 504 and the bottom surface 516 of the sleeve 510 engages or sits slightly above a base 509 of the counterbore 508. To assist in proper orientation of the sleeve 510 within the body 504, a plurality of pins (not shown) are installed in the front surface 502 of the body 504 and within a plurality of holes 529 formed in the flange 518 of the sleeve 510, as shown in FIG. 30.

A recess 530 is formed in the walls of the body 504 surrounding the counterbore 508. A seal may be installed within the recess 530 and engages the outer surface of the sleeve 510. The seal prevents fluid from leaking around the sleeve 510 during operation.

A valve body 534 is installed within the counterbore 522 formed in the sleeve 510. A sealing surface 536 is formed on a bottom surface of the valve body 534. The sealing surface 536 has a taper that corresponds with the taper 526 formed in the valve seat 528. The valve body 534 and the valve seat 528 make up an outlet valve 539. A valve retention system 541 and valve return system (not shown) may be installed within the counterbore 522 above the valve body 534.

Continuing with FIG. 29, a discharge manifold 540 is attached to the front surface 502 of the body 504 and the sleeve 510. When attached, the sleeve 510 is trapped between the body 504 and the manifold 540. The body 504 and manifold 540 may be secured together using a clamp (not shown) or other attachment means known in the art.

The discharge manifold 540 includes a flow passage 542 that leads to a discharge conduit 544. The flow passage 542 is sized to serve as an extension of the bore 506. Fluid within the bore 506 flows through the sleeve 510 and passes around the valve body 534, valve retention system 541, and valve return system and into the flow passage 542. A plug valve 546 may also be installed within the discharge manifold's flow passage 542. The plug valve 546 may shut off or otherwise regulate the flow of fluid through the discharge manifold 540, if desired.

Installing a sleeve 510 within the bore 506 adjacent the front surface 502 of the body 504 allows for easier access to the inlet valve 256 installed within the plunger 226. When the sleeve 510 is removed, the plunger 226 may be detached from the inlet tee 344 and pulled from the bore 506 at the front surface 502 of the body 504. Removing the sleeve 510 with the assembled outlet valve 539 installed therein also allows for easier service of the outlet valve 539. The sleeve 510 may also be replaced with alternative sleeve and outlet valve constructions having different flow capacities in order to allow for flow optimization at different flow rates.

During operation, the outlet valve 539 may no longer seal properly and allow high-pressure fluid to jet out between the valve seat 528 and valve body 534. Such fluid may wear against the interior of the sleeve 510, causing the sleeve to erode. If such erosion occurs, the sleeve 510 may be removed and replaced with a new sleeve. Without the sleeve 510, such erosion may occur in the walls surrounding the bore 506, causing the fluid end body 504 to eventually fail. Thus, the sleeve 510 helps extend the life of the fluid end body 504. A separate valve seat having an insert (not shown) may also be installed within the sleeve in order to further increase the life of the sleeve.

Figure 31:
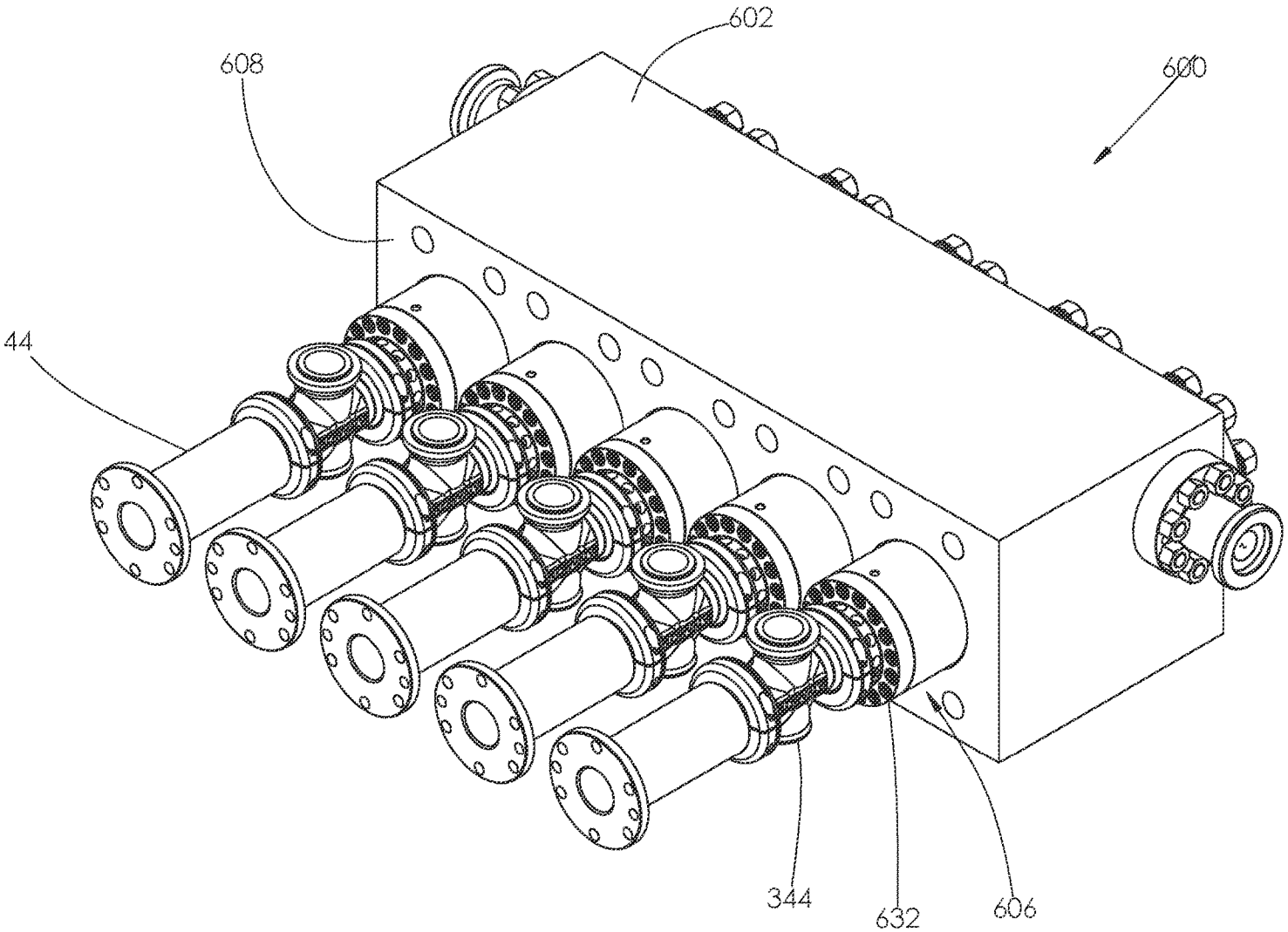
FIG. 31 is a rear perspective view of another embodiment of a fluid end.
Figure 32:
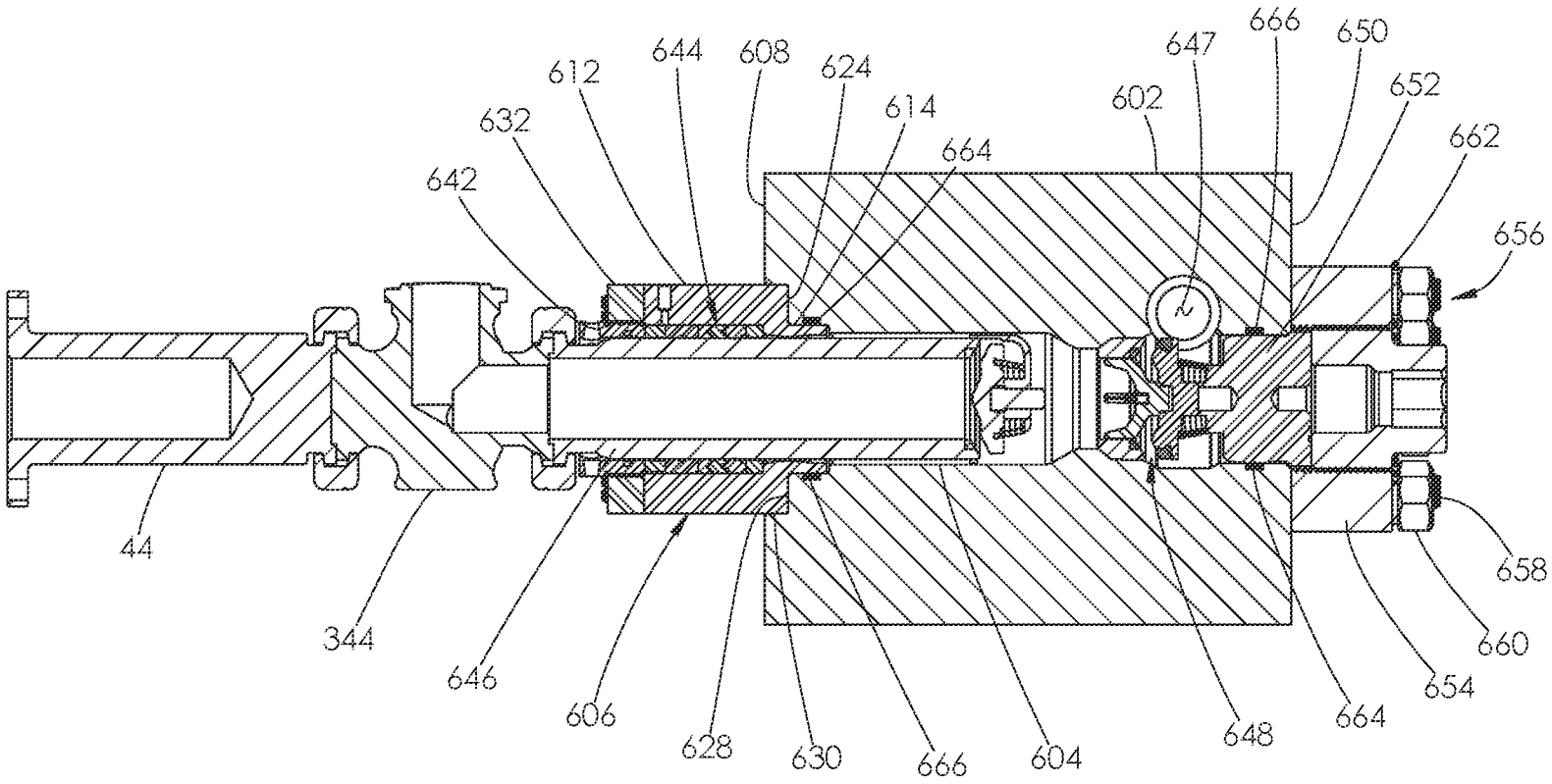
FIG. 32 is a cross-sectional view of the fluid end shown in FIG. 31.

Turning to FIGS. 31 and 32, another embodiment of a fluid end 600 is shown. Rather than comprise separate fluid end sections, like the fluid end 102, the fluid end 600 comprises a single body 602 having a plurality of adjacent horizontal bores 604 formed therein. No intersecting vertical bores are formed within the body 602. A sleeve 606 is installed within the opening of each bore 604 at a rear surface 608 of the body 602. When installed, the sleeve 606 projects from the rear surface 608 of the body 602. The sleeve 606 is similar to the sleeve 510 but does not include a flange or outer tapered section.

Figure 33:
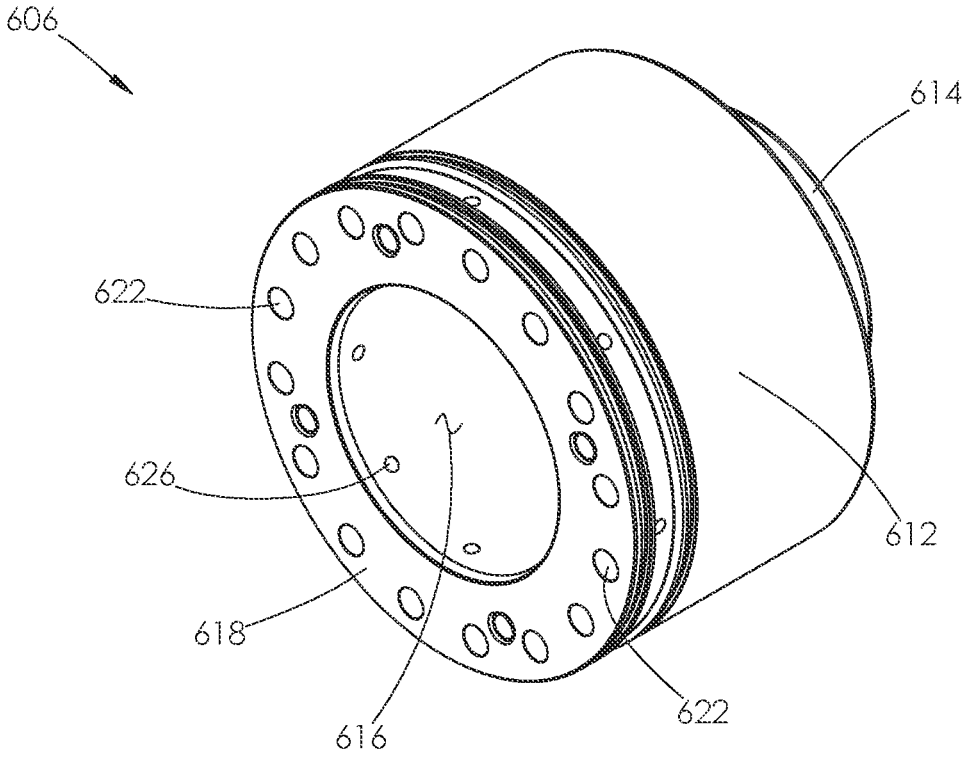
FIG. 33 is a top perspective view of a sleeve used with the fluid end shown in FIG. 31.
Figure 34:
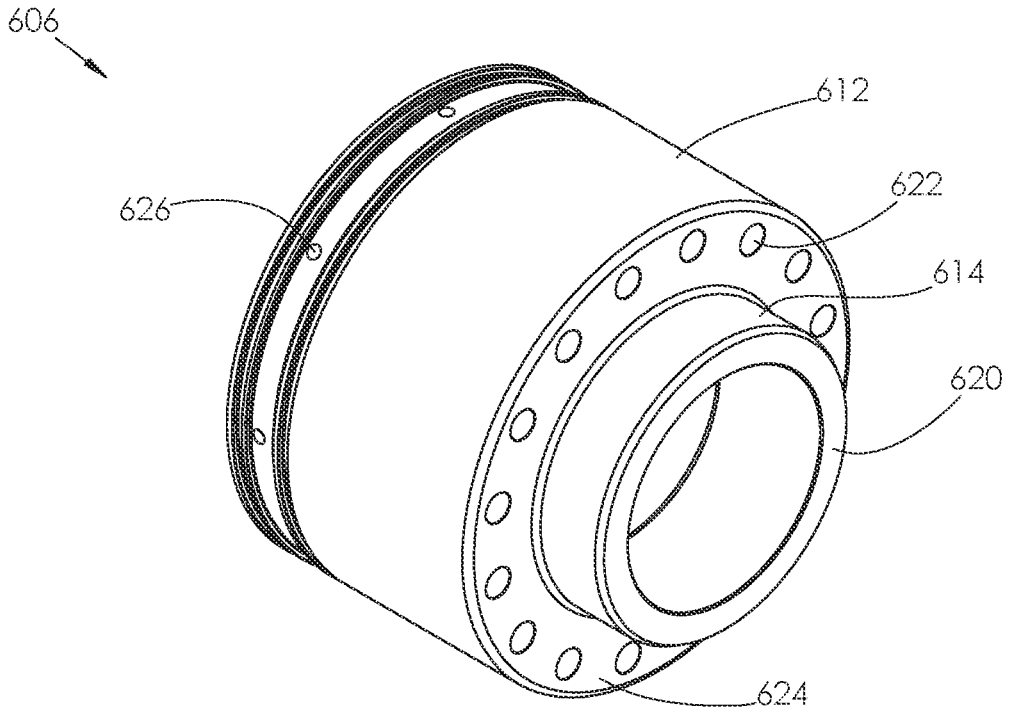
FIG. 34 is a rear perspective view of the fluid end shown in FIG. 34.

With reference to FIGS. 33 and 34, the sleeve 606 comprises a cylindrical upper portion 612 joined to a cylindrical lower section 614. A central passage 616 extends through the sleeve 606 and interconnects its opposed top and bottom surfaces 618 and 620. A plurality of passages 622 are formed in the upper section 612 and surround the passage 616. The passages 622 interconnect the top surface 618 and a bottom surface 624 of the upper section 612. A plurality of passages 626 are also formed around the upper section through the sleeve 606 and interconnects its opposed top and bottom surfaces 618 and 620. A plurality of passages 622 are formed in the upper section 612 and surround the passage 616. The passages 622 interconnect the top surface 618 and a bottom surface 624 of the upper section 612. A plurality of passages 626 are also formed around the upper section 612 and interconnect the sleeve's inner and outer surfaces. The passages 626 function as weep holes and allow any leaking fluid to exit the sleeve.

Continuing with FIG. 32, when the sleeve 606 is installed within the body 602, the bottom surface 624 of the upper section 612 engages with a base 628 of a counterbore 630 formed in the body 602 as an extension of the bore 604. A plurality of threaded openings (not shown) are formed in the base 628 and are alignable with the passages 622.

Figure 35:
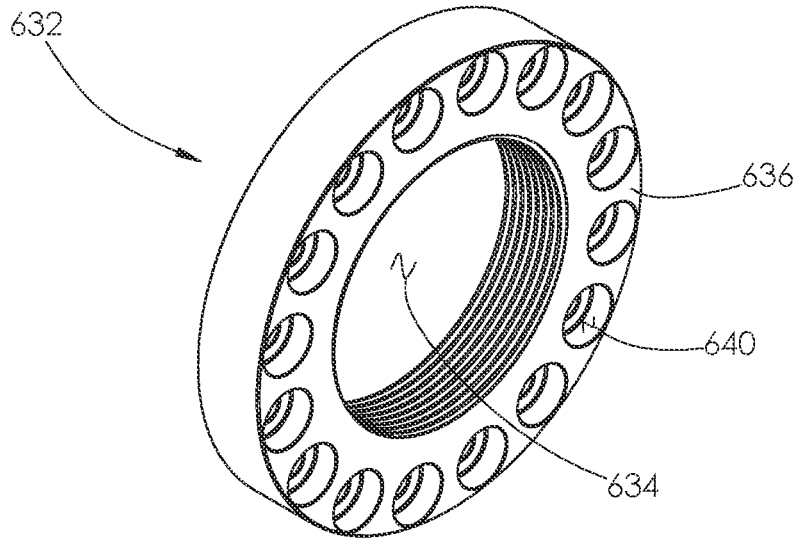
FIG. 35 is a top perspective view of a retainer used with the fluid end shown in FIG. 31.
Figure 36:
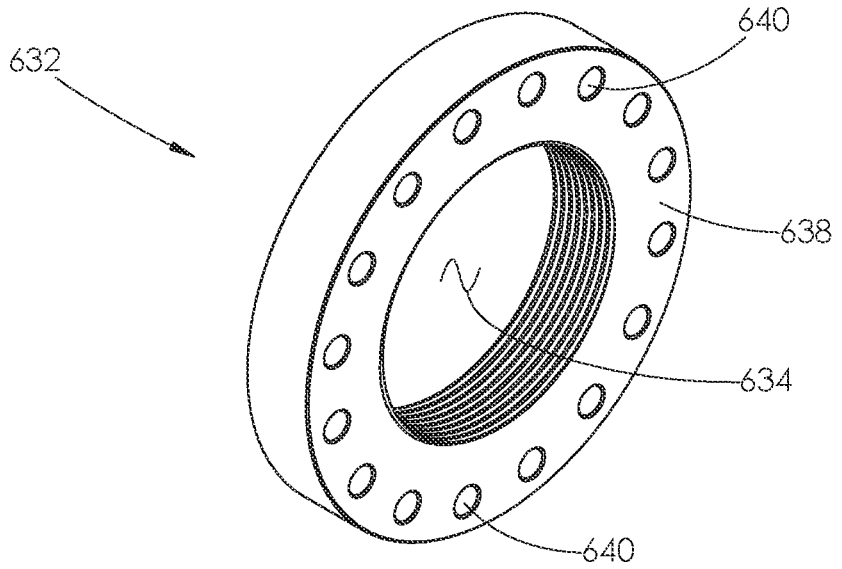
FIG. 36 is a bottom perspective view of the retainer shown in FIG. 35.

Turning to FIGS. 35 and 36, the sleeve 606 is held against the body 602 by a retainer 632. The retainer 632 has a threaded central passage 634 that interconnects its top and bottom surfaces 636 and 638. A plurality of passages 640 are formed in the retainer 632 and surround the central passage 634. The passages 640 are alignable with the passages 622 formed in the sleeve 606 and the passages formed in the base 628 of the counterbore 630. A fastening system, such as a plurality of screws, may be installed within each of the aligned passages to secure the sleeve 606 to the body 602. A packing nut 642 is installed within the central passage 634 of the retainer and comprises a plunger packing 644. The packing nut 642 and plunger packing 644 are identical to those shown in FIGS. 10, 21 and 22.

Turning back to FIG. 32, a plunger 646 installed within the sleeve 606 and body 602 is identical to the plunger 226 shown in FIG. 10. The plunger 646 is attached to the inlet tee 344. A discharge conduit 647 is formed in the body 602 adjacent an outlet valve 648. Each bore 604 is sealed adjacent a front surface 650 of the body 602 by a discharge plug 652 and a retainer 654. Each retainer 654 is secured to the body 602 via a fastening system 656. The fastening system 656 comprises a plurality of studs 658, a plurality of nuts 660, and a plurality of washers 662.

A plurality of endless grooves 664 are formed in the body 602. Two grooves 664 are formed in the walls surrounding each bore 604. One groove 664 surrounds the installed sleeve 606 and one groove 664 surrounds the installed discharge plug 652. A plurality of seals 666 are installed within each groove 664, in a one-to-one relationship. Each seal 666 engages with an outer surface of each discharge plug 652 and each sleeve 606.

Figure 37:
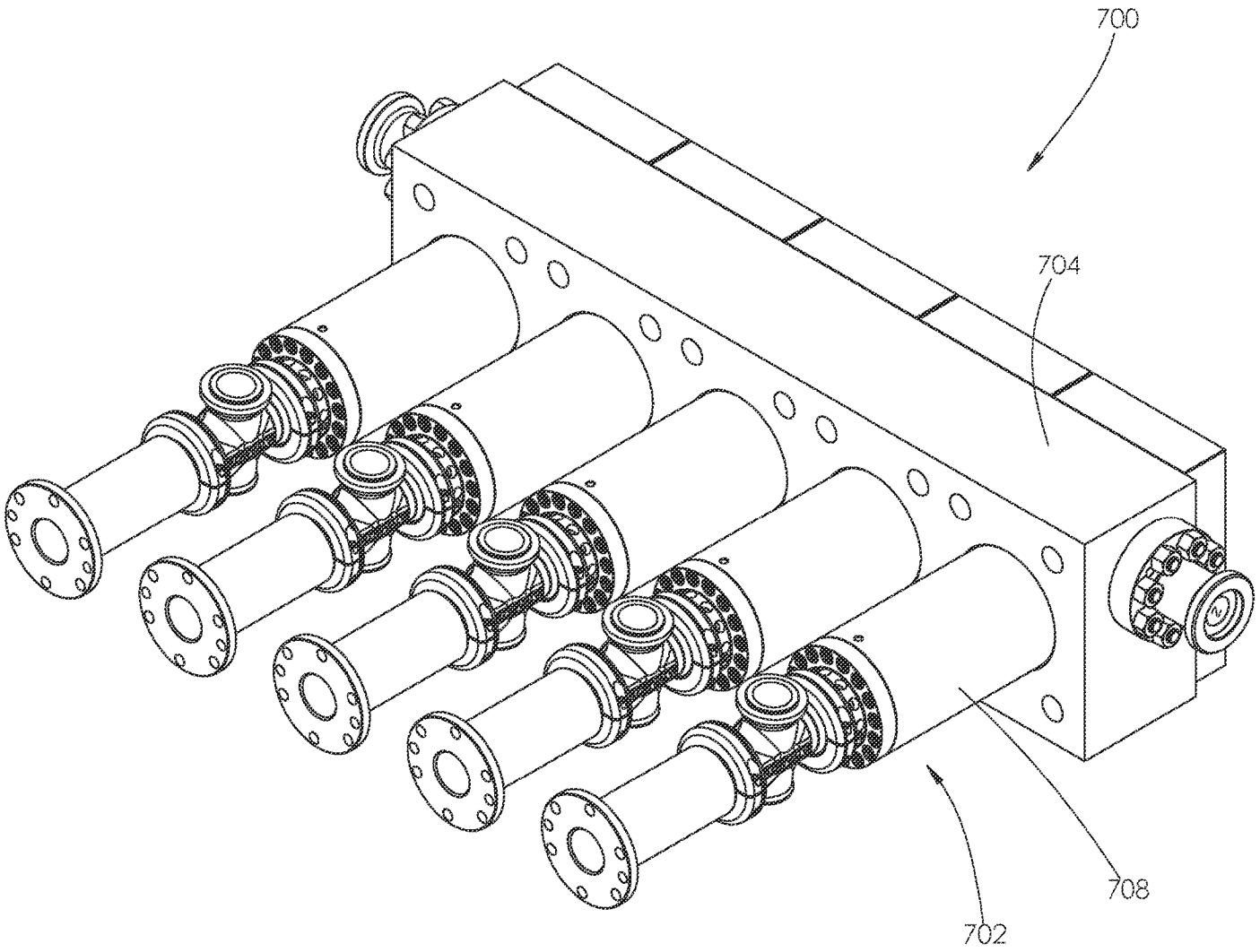
FIG. 37 is another embodiment of a fluid end.
Figure 38:
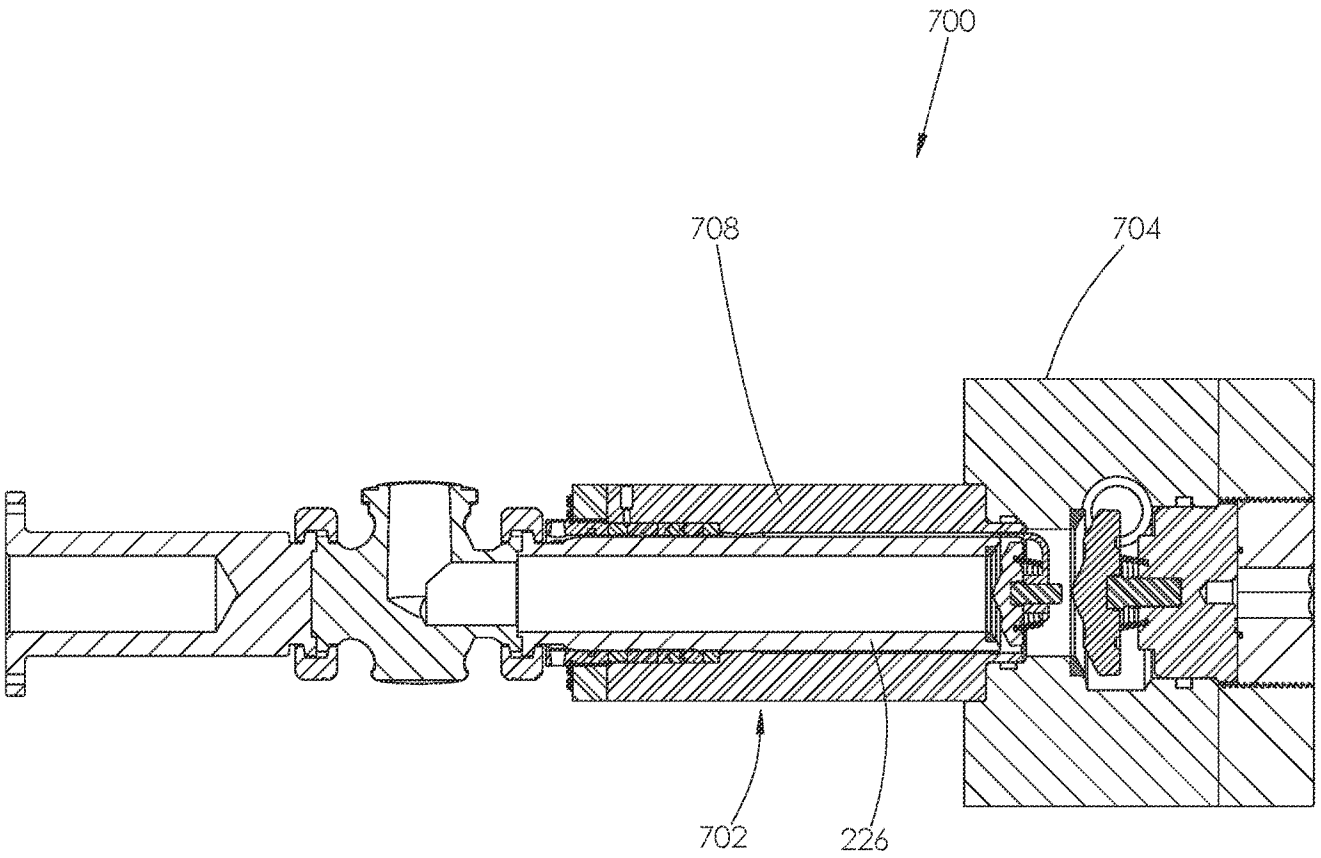
FIG. 38 is a cross-sectional view of the fluid end shown in FIG. 37.

Turning to FIGS. 37 and 38, another embodiment of a fluid end 700 is shown. The fluid end 700 is constructed like the fluid end 600, with the exception of its sleeves 702 and body 704. Each of the sleeves 702 is constructed like the sleeves 606, but has a substantially longer upper section 708. The upper section 708 of the sleeve 702 is lengthened in order to provide room for the plunger 226 to fully reciprocate. Using longer sleeves 702 allows the body 704 to have a decreased thickness, thereby using less material.

Figure 42:
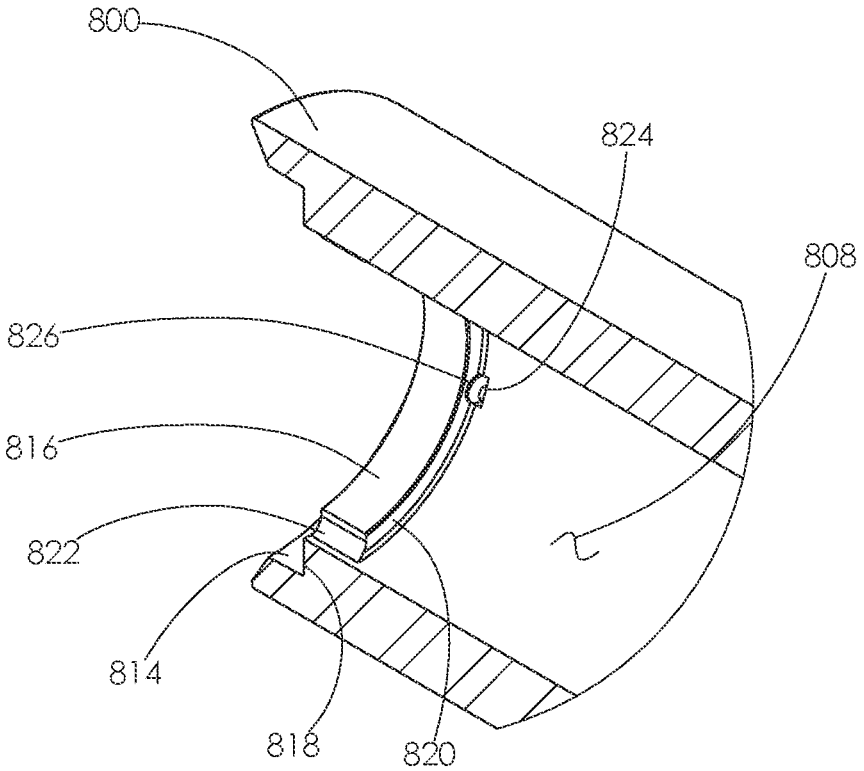
FIG. 42 is a perspective cross-sectional view of the same area of the plunger as shown in FIG. 41, but viewed from the opposite direction from that shown in FIG. 41.

Turning to FIGS. 39-46, an alternative embodiment of a plunger 800, an inlet valve 802, a valve retention system 804, and a valve return system 806 are shown. The plunger 800 includes a fluid passageway 808 that interconnects its opposed ends. The fluid passageway 808 opens into a counterbore 814 adjacent a first end 810 of the plunger 800. An annular shoulder 816 is formed within the fluid passage 808 immediately below the counterbore 814. The top surface of the shoulder 816 is the base 818 of the counterbore 814, while a bottom surface 820 of the shoulder 816 forms a step between the shoulder 816 and the walls surrounding the fluid passageway 808, as shown in FIG. 42.

Figure 39:
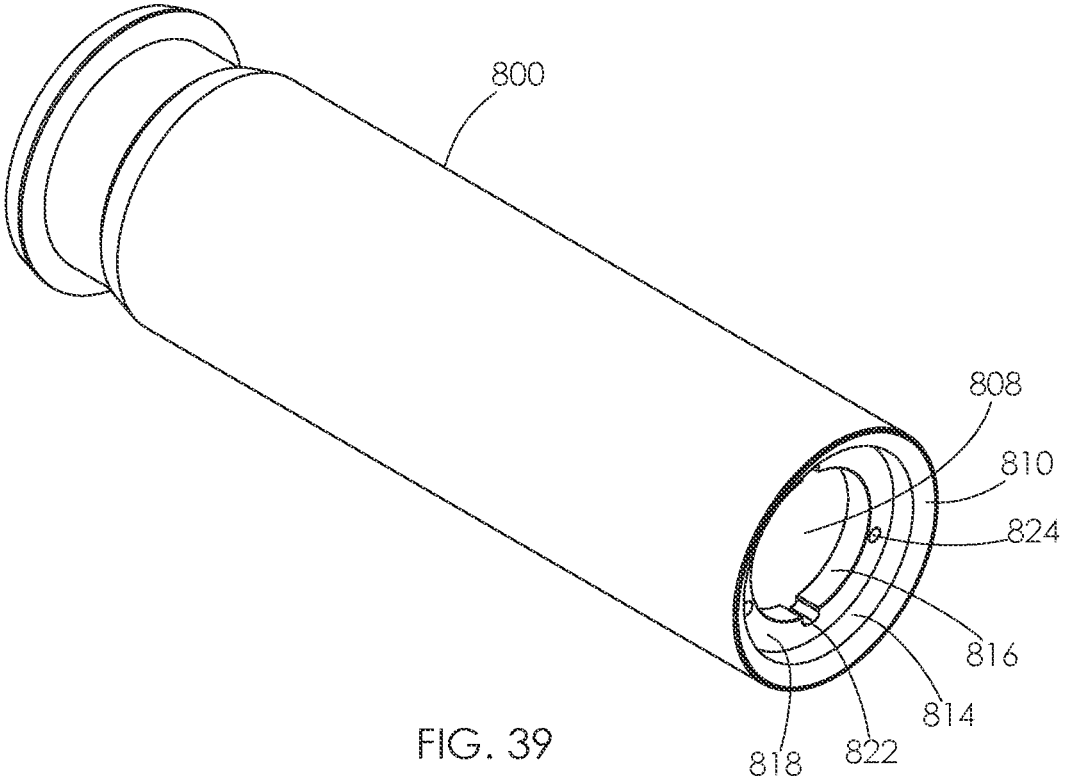
FIG. 39 is front perspective view of another embodiment of a plunger.
Figure 40:
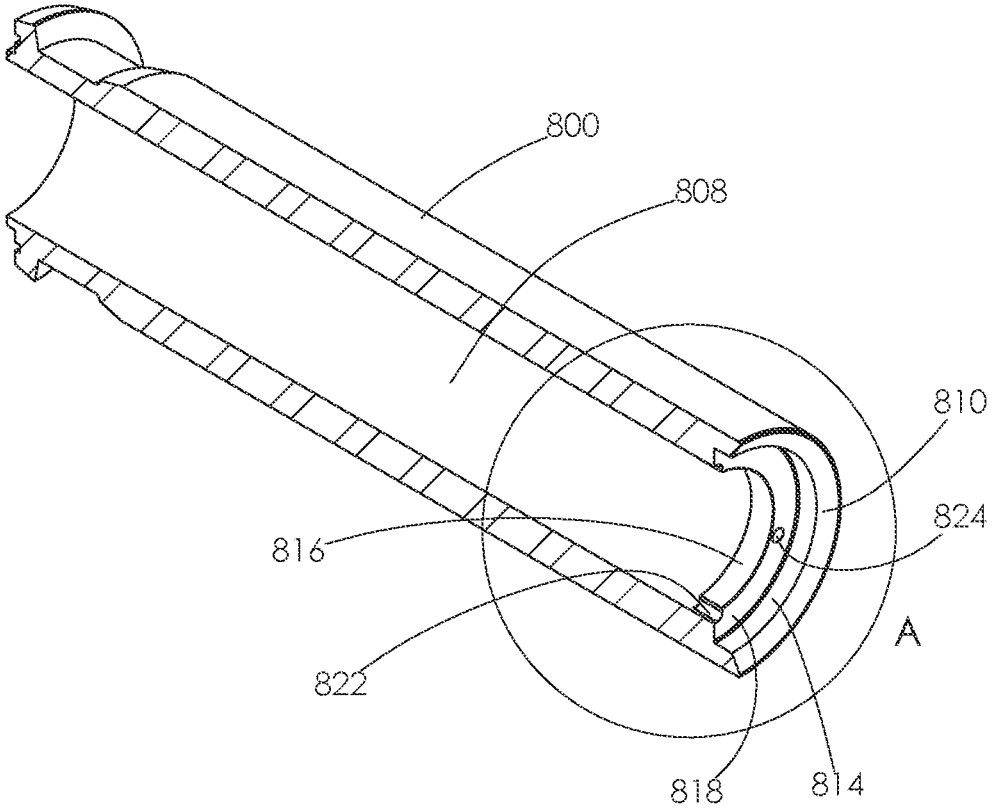
FIG. 40 is a perspective cross-sectional view of the plunger shown in FIG. 39.
Figure 41:
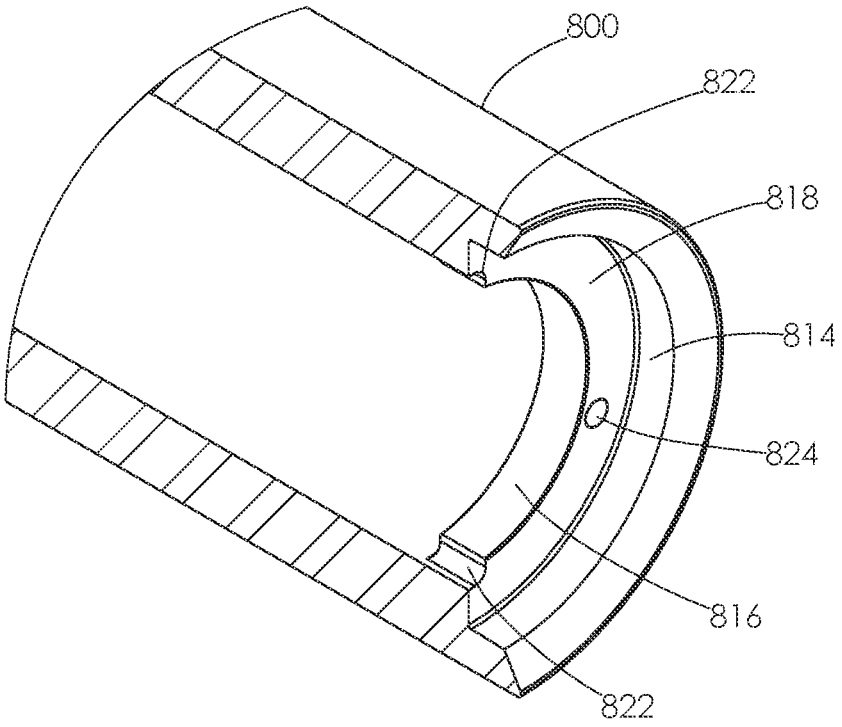
FIG. 41 is an enlarged view of area A shown in FIG. 40.

A plurality of alternating slots 822 and holes 824 are formed in shoulder 816, as shown in FIG. 39. The slots 822 are preferably diametrically opposed to one another, while the holes 824 are preferably not diametrically opposed to one another. With reference to FIG. 42, a pin 826 is installed within each of the holes 824 and projects through the bottom surface 820 of the shoulder 816 and into the fluid passageway 808.

Figure 43:
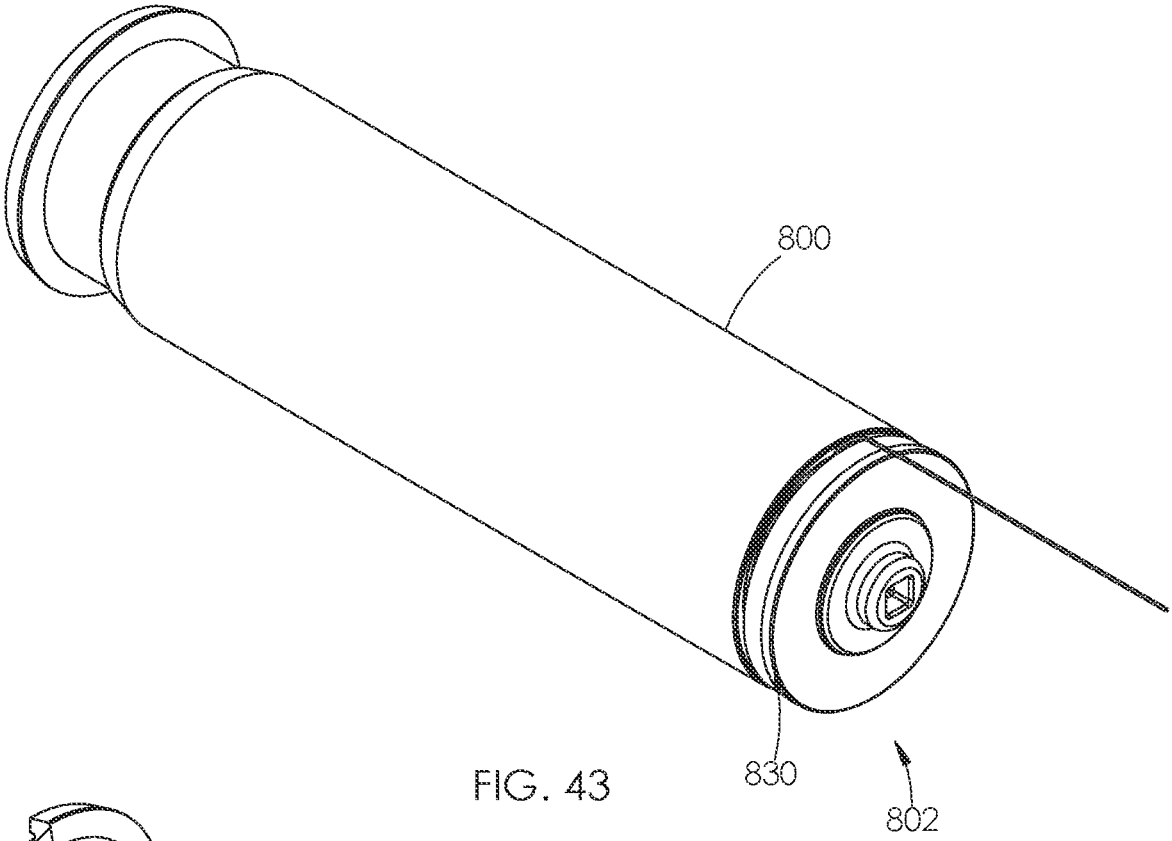
FIG. 43 is a perspective view of the plunger shown in FIG. 39, but with an inlet valve, valve retention system, and valve return system installed within the plunger.
Figure 44:
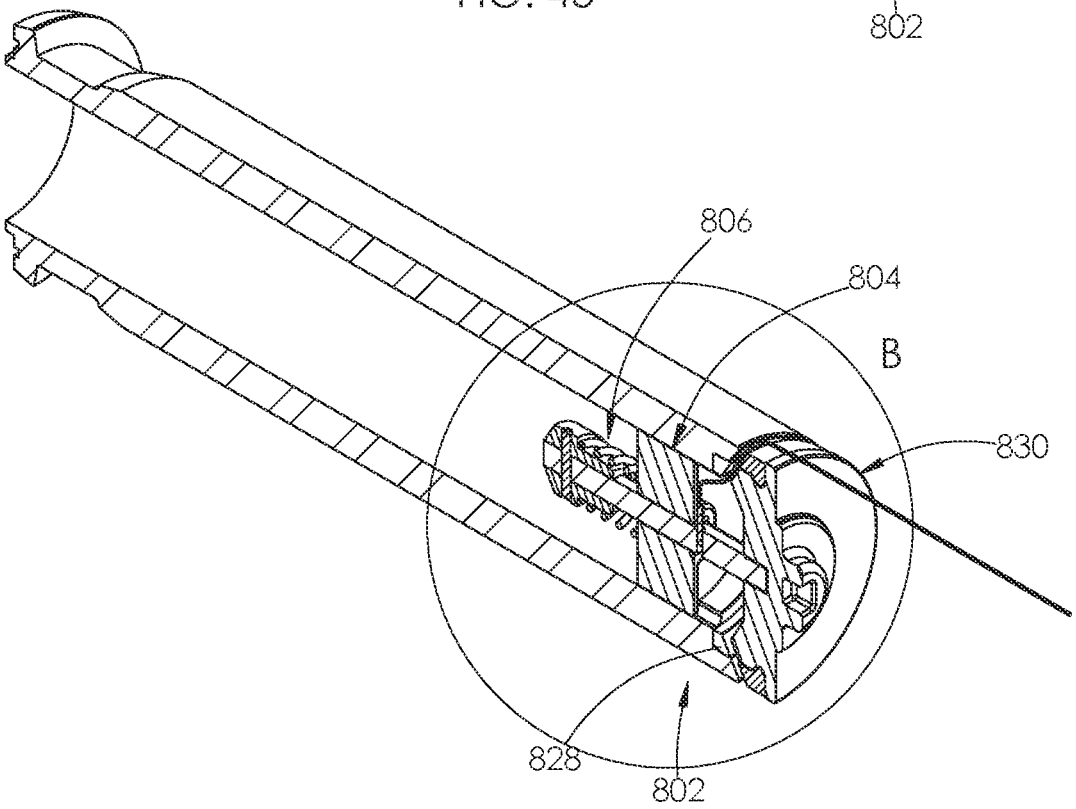
FIG. 44 is a perspective cross-sectional view of the plunger and installed components shown in FIG. 43.
Figure 46:
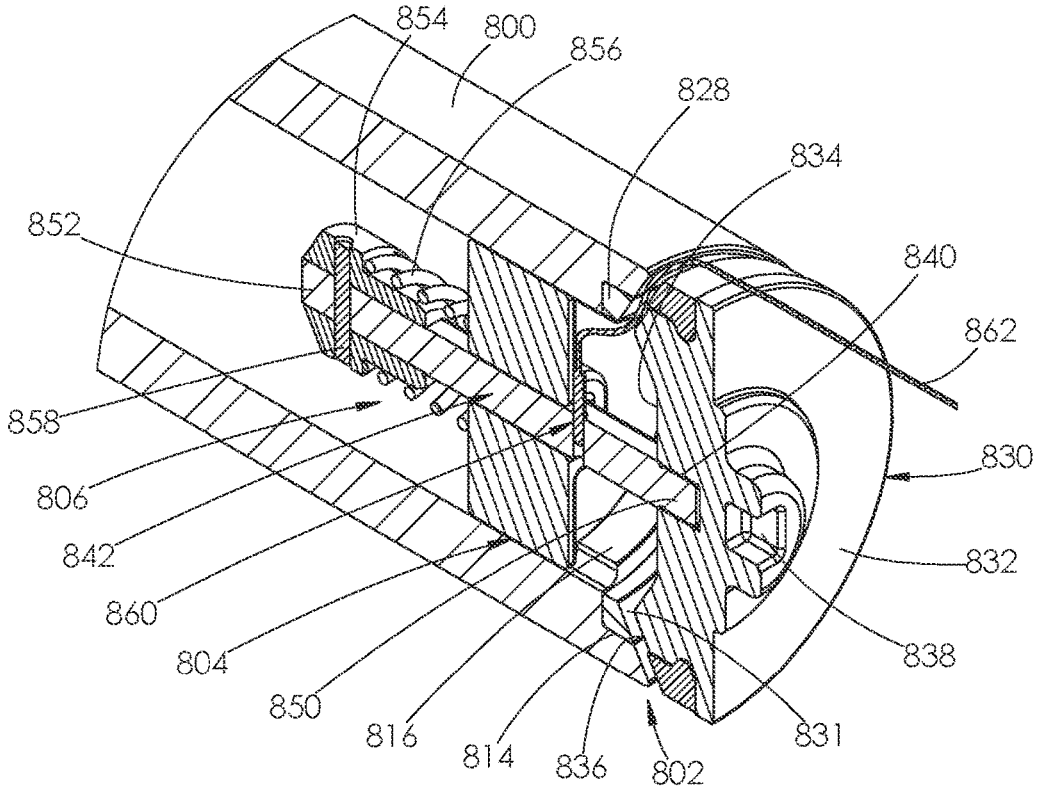
FIG. 46 is an enlarged view of area B shown in FIG. 44.

Turning to FIGS. 43, 44, and 46, the inlet valve 802 comprises a valve seat 828 and a valve body 830. The valve seat 828 is installed within the counterbore 814. When installed, the slots 822 and holes 824 are still exposed. The valve seat 828 includes a tapered top surface 831, as shown in FIG. 46. The valve seat 828 may be formed of the same material as the insert 278.

Continuing with FIG. 46, the valve body 830 has opposed top and bottom surfaces 832 and 834. A sealing surface 836 is formed at the bottom surface 834 of the valve body 830 that corresponds with the tapered top surface 831 of the valve seat 828. A socket connection 838 is formed on the top surface 832 of the valve body 830, and a threaded hole 840 is formed in the center of the bottom surface 834 of the valve body 830. The threaded hole 840 is configured for receiving a portion of the valve retention system 804.

Figure 45:
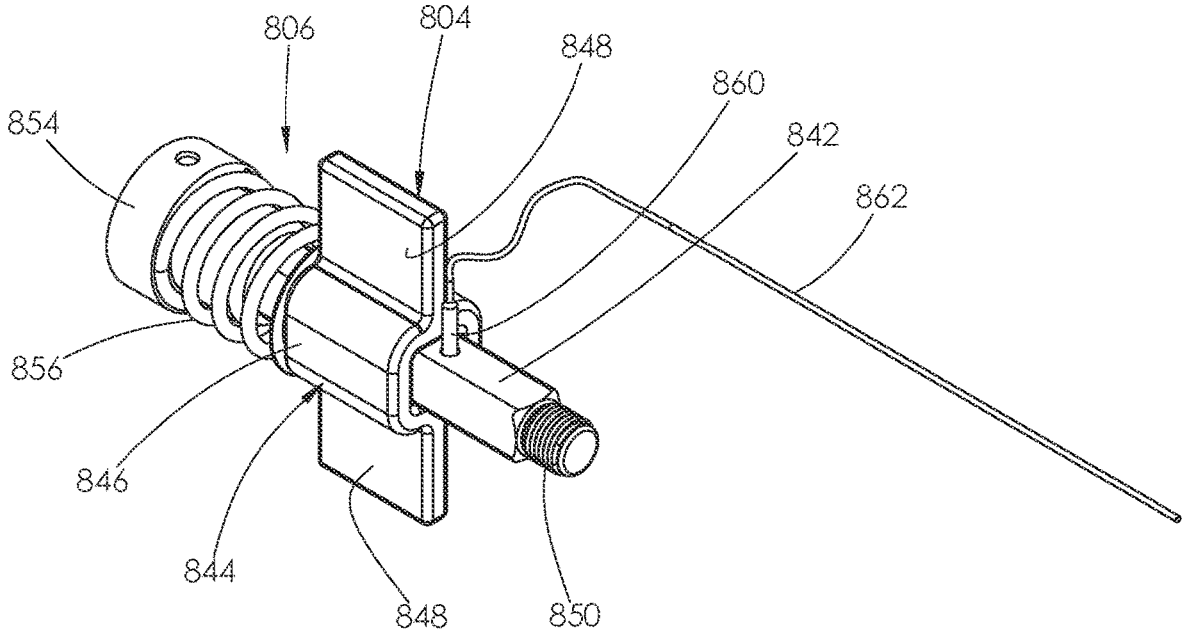
FIG. 45 is a perspective view of the valve retention system and valve return system shown in FIG. 44.

With reference to FIGS. 45 and 46, the valve retention system 804 comprises an elongate stem 842 installed within a retainer 844. The retainer 844 comprises a central support 846 joined to two opposed tabs 848. The tabs 848 are sized to fit within the slots 822. The stem 842 has a square cross-section that corresponds to a central passage formed in the central support 846 having a square cross-section. The stem 842 is installed within the central passage formed in the central support 846. Once installed, a threaded first end 850 of the stem 842 is installed within the threaded hole 840 formed in the valve body 830. An opposed second end 852 of the stem 842 is attached to the valve return system 806.

The valve return system 806 comprises a spring stop 854, a spring 856, and a retainer pin 858. The spring 856 is disposed around the second end 852 of the stem 842 and the spring stop 854 is attached to the second end 852 of the stem 842 via the retainer pin 858. The spring 856 is positioned on the stem 842 between the spring stop 854 and the central support 846 of the retainer 844. When the valve retention system 804 and valve return system 806 are attached to the valve body 830, the retainer 844 rotates with the stem 842, but is free to move up and down relative to the stem 842.

Prior to installing the valve body 830, valve retention system 804, and valve return system 806 into the passageway 808 of the plunger 800, a pull pin 860 is installed within a hole formed in the stem 842, as shown in FIG. 45. The pull pin 860 holds the retainer 844 and spring 856 in a desired position relative to the stem 842 for ease of installation. Specifically, the pull pin 860 holds the retainer 844 in a position so that it compresses the spring 856. To install the retainer 844 within the plunger 800, the tabs 848 are aligned with the slots 822 and pushed through the slots 822 until the tabs 848 are positioned below the bottom surface 820 of the shoulder 816, as shown in FIG. 46.

A tool is subsequently installed within the socket connection 838 of the valve body 830 and used to rotate the valve body 830 and the attached retainer 844 until the tabs 848 engage the pins 826 projecting from the bottom surface 820 of the shoulder 816. Once the tabs 848 engage the pins 826, more torque is applied to the valve body 830 until the spring 856 is compressed more, allowing the tabs 848 to continue rotating. Once the tabs 828 rotate past the pins 826, the spring 856 extends applying a force to the retainer 844 and keeping the front surfaces of the tabs 848 engaged with the bottom surface 820 of the shoulder 816. Once returned to such position, the pins 826 prevent the tabs 848 from rotating back towards the slots 822 and becoming unintentionally uninstalled from the plunger 800.

After the retainer 844 in installed within the plunger 800, a cable 862 attached to the pull pin 860 may be pulled, thereby pulling the pull pin 860 from the stem 842. Once removed, the spring 856 may move from a compressed state to a less compressed, pre-loaded state. When the spring 856 is in a pre-loaded state, the valve body 830 is held against the valve seat 828. During operation, fluid pushing against the bottom surface 834 of the valve body 830 moves the valve body 830 away from the seat 828, further compressing the spring 856 and opening the inlet valve 802.

Figure 47:
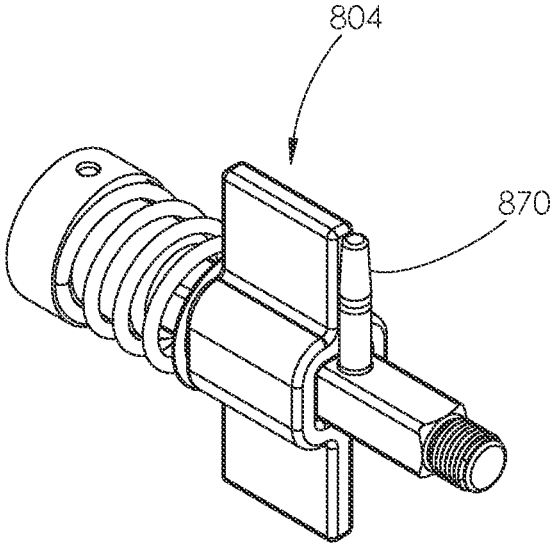
FIG. 47 is the perspective view of the valve retention system and valve return system shown in FIG. 45, but with a shear pin installed within the valve retention system in place of the pull pin.
Figure 48:
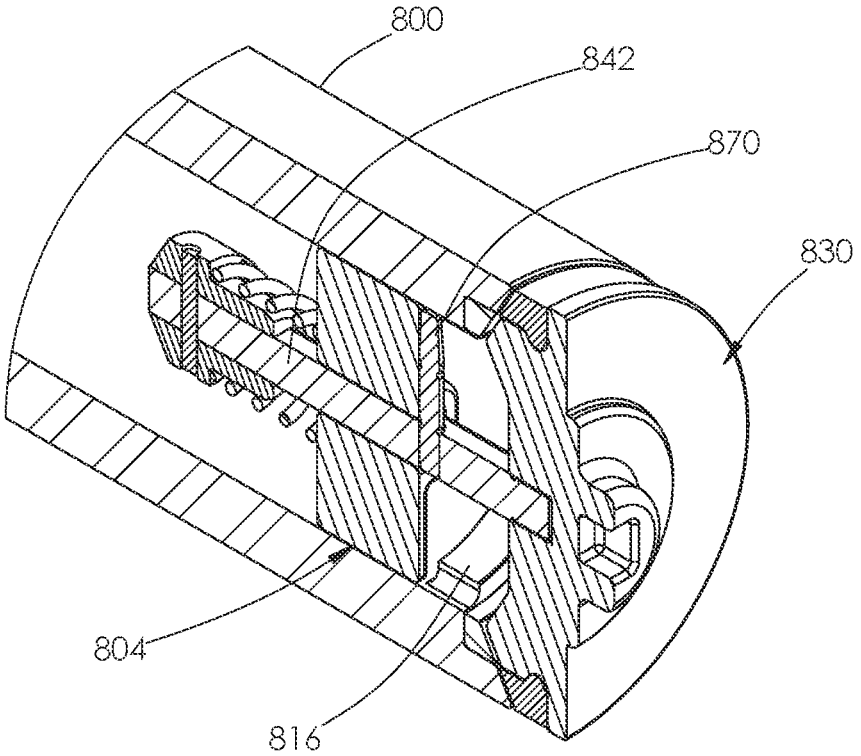
FIG. 48 is a perspective cross-sectional view of the plunger shown in FIG. 44 with the shear pin shown in FIG. 47 installed within the valve retention system in place of the pull pin.

Turning to FIGS. 47 and 48, a shear pin 870 may be used with the valve retention system 804 in place of the pull pin 860 and cable 862. The shear pin 870 is water-soluble. Once the valve retention system 804 is installed within the plunger 800, the stem 842 is rotated via the valve body 830 until the pin 870 shears. Any parts of the pin 870 remaining within the stem 842 will dissolve during operation.

Figure 49:
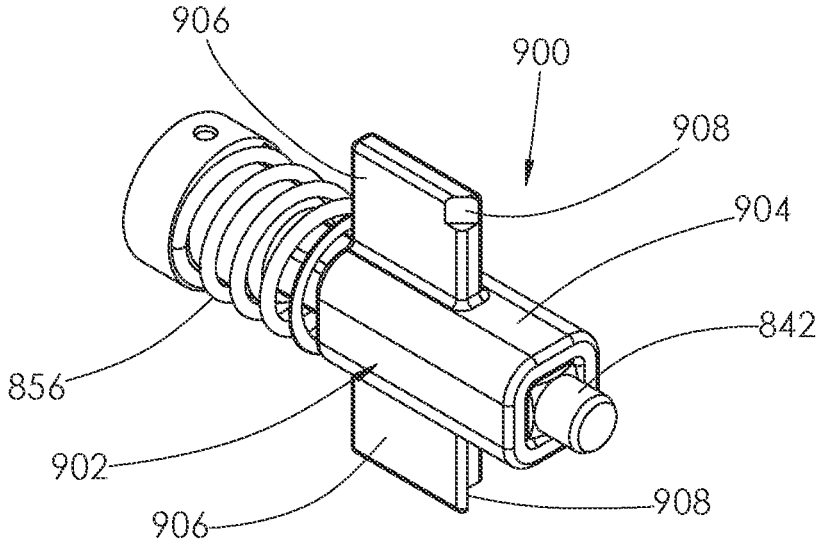
FIG. 49 is a perspective view of an alternative embodiment of a valve retention system used with the valve return system shown in FIG. 45.
Figure 50:
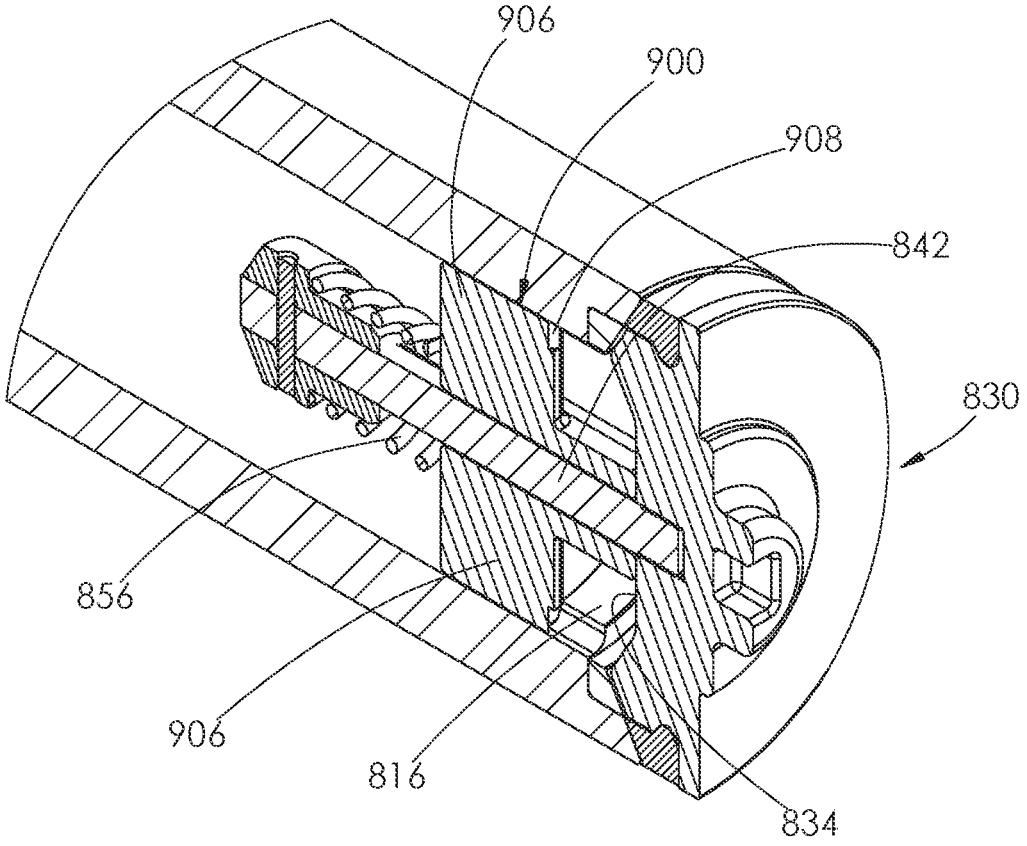
FIG. 50 is a perspective cross-sectional view of the plunger shown in FIG. 44 with using the valve retention system shown in FIG. 49.

Turning to FIGS. 49 and 50, another embodiment of a valve retention system 900 is shown. Rather than use a pull pin or shear pin, the valve retainer system 900 has a modified retainer 902. The retainer 902 comprises a central support 904 joined to two tabs 906. The central support 904 has an extended length as compared to the central support 846 used with the system 806. The extended length allows the support to engage the bottom surface 834 of the valve body 830. The edges of the tabs 906 are modified from the tabs 848 to include a beveled edge 908.

The tabs 906 are inserted within the slots 822, but are not pushed below the shoulder 816. When torque is applied to the valve body 830 at the socket connection 838, the retainer 902 compresses the spring 856 and the tabs 906 are pushed below the shoulder 816. The beveled edges 908 ramp over the pins 826 as the tabs 906 are rotated. Once the tabs 906 are rotated past the pins 826, the retention system 900 is locked in place and ready for operation.

Changes may be made in the construction, operation and arrangement of the various parts, elements, steps and procedures described herein without departing from the spirit and scope of the invention as described in the following claims.

The invention claimed is:

1. An apparatus comprising:

a fluid end body having a borehole formed therein, the borehole extending along a longitudinal axis of the fluid end body; in which the fluid end body is configured to be attached to a power end having a rotatable crankshaft installed therein;

a plunger installed within the borehole and having front and rear ends joined by an internal fluid passage; in which the plunger is configured to reciprocate within the borehole along the longitudinal axis of the fluid end body; in which the plunger has an outer diameter, D1;

a suction valve assembly, at least a portion of the suction valve assembly positioned within the internal fluid passage, the suction valve assembly comprising:

a suction valve seat; and a suction valve body configured to seal against the suction valve seat;

in which the suction valve body has a maximum outer diameter, D3;

a discharge valve assembly installed within the borehole, the discharge valve assembly comprising a discharge valve body and a discharge valve seat; in which the discharge valve seat has an inner diameter, D2; in which the discharge valve body has an outer diameter, D4; in which the discharge valve assembly and the suction valve assembly are coaxially aligned along the longitudinal axis; and an inlet conduit in fluid communication with the internal fluid passage of the plunger, the inlet conduit comprising:

a fluid intake end joined to a reciprocating end;

in which the fluid intake end is configured to be attached to a stationary inlet manifold; and in which the reciprocating end is attached to the rear end of the plunger and is configured to move with the plunger as the plunger reciprocates within the borehole; in which the plunger reciprocates within the borehole along the longitudinal axis;

in which D2 is greater than D1; and in which D4 is greater than D3.

2. The apparatus of claim 1, further comprising:
an inlet component interposed between the reciprocating element end of the inlet conduit and the rear end of the plunger.

3. The apparatus of claim 2, in which the inlet component has opposed top and bottom surfaces and opposed front and rear surfaces; and in which a first fluid passageway opens on the top surface and the front surface of the inlet component.

4. A pump, comprising:
the apparatus of claim 1; and
a power end that is the power end of claim 1, the power end comprising:
a pony rod mechanically coupled to the rotatable crankshaft;
in which the pony rod is attached to the rear end of the plunger using a clamp.

5. The pump of claim 4, further comprising:
an inlet component interposed between the reciprocating element end of the inlet conduit and the rear end of the plunger;
in which the clamp is attached to the inlet component.

6. The apparatus of claim 1, further comprising:
a stationary inlet manifold that is the stationary inlet manifold of claim 1; in which the fluid intake end of the inlet conduit is attached to the stationary inlet manifold.

7. The apparatus of claim 1, further comprising:
a connect plate removably secured to the rear surface of the fluid end body; in which the connect plate is configured to connect the fluid end body to the power end; in which at least a portion of the plunger is received within the connect plate; and
a discharge manifold removably attached to the fluid end body, in which the discharge manifold comprises a flow passage which is in fluid communication with the borehole.

8. The apparatus of claim 1, further comprising a valve retention system installed within the internal fluid passage.

9. The apparatus of claim 8, in which the suction valve body is situated within the internal fluid passage intermediate the valve retention system and the rear end of the plunger.

10. The apparatus of claim 1, in which the internal fluid passage has a maximum diameter; and in which D3 is smaller than the maximum diameter of the internal fluid passage.

11. An apparatus, comprising:
a fluid end body having a borehole formed therein; the borehole having a central longitudinal axis;
a plunger positioned within the borehole and having an internal fluid passage formed therein;
a suction valve assembly, at least a portion of the suction valve assembly positioned within the internal fluid passage; in which the suction valve assembly comprises a suction valve body having a maximum outer diameter, D3, and a suction valve seat;
a discharge valve assembly installed within the borehole; in which the discharge valve assembly and the suction valve assembly are coaxially aligned along the central longitudinal axis; and in which the discharge valve assembly comprises a discharge valve body having a maximum outer diameter, D4, and a discharge valve seat; in which the discharge valve body comprises a first surface and an opposed second surface, the opposed second surface configured to mate with the discharge valve seat;
a discharge chamber situated adjacent the first surface of the discharge valve body;
in which the fluid end body is configured to be attached to a power end having a rotatable crankshaft installed therein; in which the plunger is configured to be operatively connected to the crankshaft such that the plunger reciprocates within the borehole in response to rotation of the crankshaft;
in which the plunger has an outer diameter, D1;
in which the discharge valve seat comprises a sealing surface having an opening formed therein; in which the opening has a minimum inner diameter, D2;
in which D2 is greater than D1; and
in which D4 is greater than D3.

12. The apparatus of claim 11, further comprising:
an inlet conduit in fluid communication with the internal fluid passage of the plunger, the inlet conduit comprising:
a fluid intake end joined to a reciprocating end;
in which the fluid intake end is configured to be attached to a stationary inlet manifold; and
in which the reciprocating end is attached to a rear end of the plunger and is configured to move with the plunger as the plunger reciprocates within the borehole; in which the plunger reciprocates within the borehole along the longitudinal axis.

13. The apparatus of claim 11, comprising a discharge manifold, in which the discharge chamber is formed within the discharge manifold, in which the discharge manifold is removeable from the fluid end body.

14. The apparatus of claim 13, in which the fluid end body comprises a first surface and an opposed second surface, the first surface engaging the discharge manifold; in which the plunger is configured to pass entirely through openings formed to the borehole at both the first and second surfaces of the fluid end body.

15. The apparatus of claim 11, in which at least a portion of the fluid end body is exposed to an ambient environment.

16. A pump fluid end comprising:
a pump chamber, comprising:
a bore formed within the pump chamber;
a discharge valve comprising a discharge valve seat and a discharge valve body; in which the discharge valve body comprises a first surface and an opposed second surface, the opposed second surface configured to mate with the discharge valve seat;
a suction valve assembly comprising a suction valve seat and a suction valve body; and
a reciprocating element having a central longitudinal axis;
wherein the discharge valve assembly and the suction valve assembly are coaxially aligned along the central longitudinal axis;
wherein the discharge valve seat has an inner diameter, D1;
wherein the suction valve body has an outer diameter, D2;
wherein the suction valve seat has an outer diameter, D3;
wherein the reciprocating element has an outer diameter, D4;
wherein the discharge valve body has an outer diameter, D5; and
wherein D1 is greater than D2, D3 and D4; and
wherein D5 is greater than D2;
a removable discharge manifold attached to the pump chamber, the removable discharge manifold comprising a discharge passage situated adjacent the first end of the discharge valve body;

in which the pump fluid end is configured to be attached to a power end having a rotatable crankshaft installed therein; in which the reciprocating element is configured to be operatively connected to the crankshaft such that the reciprocating element reciprocates within the bore in response to rotation of the crankshaft; and in which the discharge valve is situated entirely within the pump chamber.

17. The pump fluid end of claim 16, wherein the pump fluid end is a concentric bore pump fluid end.

18. A pump, comprising:

the pump fluid end of claim 16; and the power end of claim 16, wherein the power end is operable to reciprocate the reciprocating element within the pump chamber.

19. The pump fluid end of claim 16, further comprising:

an inlet conduit in fluid communication with an internal fluid passage formed in the reciprocating element, the inlet conduit comprising:

a fluid intake end joined to a reciprocating end;

in which the fluid intake end is configured to be attached to a stationary inlet manifold; and in which the reciprocating end is attached to a rear end of the reciprocating element and is configured to move with the reciprocating element as the reciprocating element reciprocates within the pump chamber.

20. A pump fluid end, comprising:

at least one pump chamber, wherein each pump chamber further comprises:

a discharge valve assembly comprising a discharge valve seat and a discharge valve body;

a single suction valve assembly comprising a suction valve seat and a suction valve body;

a reciprocating element; and an access port on a side of the discharge valve assembly opposite the suction valve assembly;

wherein the pump fluid end is configured to transport fluid around the discharge valve body and into a flow passage;

wherein the discharge valve assembly and the suction valve assembly are coaxially aligned along a central axis thereof, wherein the discharge valve seat has an inside diameter across a radially innermost surface thereof, wherein the suction valve body has an outside diameter across a radially outermost surface thereof, wherein the suction valve seat has an outside diameter across a radially outermost surface thereof, wherein a minimum of the inside diameter of the discharge valve seat along a length of the discharge valve seat along the central axis is greater than: (a) a maximum of the outside diameter of the suction valve body along a length of the suction valve body along the central axis, (b) a maximum of the outside diameter of the suction valve seat along a length of the suction valve seat along the central axis, (c) a maximum of an outside diameter of the reciprocating element along a length of the reciprocating element along the central axis; or (d) a combination thereof;

wherein the suction valve body, the suction valve seat, the reciprocating element, or a combination thereof is removable from the pump fluid end via passage through the discharge valve seat and the access port; and wherein the pump fluid end is configured to be attached to a power end having a rotatable crankshaft installed therein; wherein the reciprocating element is configured to be operatively connected to the crankshaft such that the reciprocating element reciprocates within the at least one pump chamber in response to rotation of the crankshaft.

21. The pump fluid end of claim 20, wherein the pump fluid end is a concentric bore pump fluid end.

22. A pump, comprising:

the pump fluid end of claim 20; and a power end which is the power end of claim 20, wherein the power end is operable to reciprocate the reciprocating element within the at least one pump chamber.

23. The pump fluid end of claim 20, further comprising:

an inlet conduit in fluid communication with an internal fluid passage formed in the reciprocating element, the inlet conduit comprising:

a fluid intake end joined to a reciprocating end;

in which the fluid intake end is configured to be attached to a stationary inlet manifold; and in which the reciprocating end is attached to a rear end of the reciprocating element and is configured to move with the reciprocating element as the reciprocating element reciprocates within the at least one pump chamber.

* * * * *